US010683128B1

(12) United States Patent
Lau et al.

(10) Patent No.: US 10,683,128 B1
(45) Date of Patent: Jun. 16, 2020

(54) ADJUSTABLE STORAGE COMPARTMENT FOR A BOTTLE

(71) Applicants: Lawrence Michael Lau, San Francisco, CA (US); Charlene Lyu, Campbell, CA (US); Alexander Christopher Lau, Newtown, PA (US)

(72) Inventors: Lawrence Michael Lau, San Francisco, CA (US); Charlene Lyu, Campbell, CA (US); Alexander Christopher Lau, Newtown, PA (US)

( * ) Notice: Subject to any disclaimer, the term of this patent is extended or adjusted under 35 U.S.C. 154(b) by 233 days.

(21) Appl. No.: 15/961,658

(22) Filed: Apr. 24, 2018

Related U.S. Application Data

(63) Continuation of application No. 14/931,484, filed on Nov. 3, 2015, now Pat. No. 9,950,827.

(60) Provisional application No. 62/074,286, filed on Nov. 3, 2014, provisional application No. 62/162,669, filed on May 16, 2015, provisional application No. 62/194,749, filed on Jul. 20, 2015.

(51) Int. Cl.

| | |
|---|---|
| ***B65D 1/04*** | (2006.01) |
| ***B65D 51/16*** | (2006.01) |
| ***B65D 23/00*** | (2006.01) |
| ***B65D 1/02*** | (2006.01) |
| ***B65D 23/02*** | (2006.01) |

(52) U.S. Cl.
CPC ..... *B65D 1/04* (2013.01); *B65D 1/0246* (2013.01); *B65D 23/001* (2013.01); *B65D 23/02* (2013.01); *B65D 51/1644* (2013.01)

(58) Field of Classification Search
CPC .... B65D 1/06; B65D 1/0246; B65D 83/0055; B65D 23/001; B65D 23/02; B65D 81/26; B65D 81/245; B65D 51/1644
USPC ..... 206/217
See application file for complete search history.

(56) References Cited

U.S. PATENT DOCUMENTS

| | | | | |
|---|---|---|---|---|
| 1,854,458 | A * | 4/1932 | De Quincy | A47G 19/24 222/215 |
| 4,881,666 | A * | 11/1989 | Tullman | B65D 23/00 222/386.5 |
| 2009/0224002 | A1* | 9/2009 | Bakhos | B65D 47/2018 222/209 |
| 2011/0024450 | A1* | 2/2011 | Maas | B29C 49/0073 222/95 |
| 2019/0168950 | A1* | 6/2019 | Gabriel | B65D 81/24 |

* cited by examiner

*Primary Examiner* — King M Chu
*Assistant Examiner* — L Kmet

(57) ABSTRACT

A bottle has a storage compartment to store an item. The bottle includes a top opening, a bag inside the bottle defining the storage compartment, a bottom opening formed by an opening of the bag, and a bottom cap that includes at least one hole. The bottom cap is removably connected over the bottom opening to provide access to the storage compartment.

20 Claims, 38 Drawing Sheets

ADJUSTABLE STORAGE COMPARTMENT FOR A BOTTLE

CROSS-REFERENCE TO RELATED APPLICATIONS

This application is a continuation of U.S. patent application Ser. No. 14/931,484, filed Nov. 3, 2015, which claims the benefit of U.S. provisional patent applications 62/074,286, filed Nov. 3, 2014; 62/162,669, filed May 16, 2015; and 62/194,749, filed Jul. 20, 2015. These applications along with other cited references in this application are incorporated by reference.

BACKGROUND OF THE INVENTION

The present invention relates to containers, and more specifically, to a personal hydration container.

It is important to stay hydrated. Water, for example, helps to regulate body temperature, remove waste, and transport nutrients. Many people try to make carrying a water bottle a part of their daily routine. For example, a person may carry a water bottle to the office, gym, or store. People who participate in vigorous physical activity (e.g., exercising, cycling, running, hiking, and rock climbing) have an especially acute need to stay hydrated. People also have a need to carry other things as well such as their keys, credit cards, identification cards, public transit cards, money, pills, snacks, and so forth.

It can be burdensome to carry and keep track of these individual items. Further, it is difficult to anticipate the preferences of people regarding individual hydration needs and what particular items a person wishes to carry. In some cases, a particular person's needs will vary depending on factors such as the type of activity, climatic conditions, activity duration, and other factors. Current products for carrying water and other things people may want to take with them fail to meet these widely diverse needs.

Therefore, there is a need for a new type of hydration and storage container that is capable of adjusting to accommodate an individual user's need to carry hydration fluids and other things.

BRIEF SUMMARY OF THE INVENTION

A container includes a body, a bag, and a bottom cap. The body includes a top opening, and a bottom end, opposite the top opening. The bag is positioned inside the body and includes an opening at the bottom end of the body. The bottom cap includes a hole. The bottom cap is removably connected over the opening of the bag. The hole in the bottom cap allows fluid in the bag to escape. When a drink is poured into the body through the top opening, the drink at least partially collapses the bag as the fluid in the bag is allowed to escape through the at least one hole in the bottom cap.

The bottom cap may include a foot extending away a bottom surface of the bottom cap, the foot including a side surface between the bottom surface of the bottom cap and a bottom surface of the foot, where the at least one hole is located on the side surface of the foot. The body may include a rigid material, metal, or both. The at least one hole may include a valve, where the valve allows the fluid in the bag to escape, and blocks fluid outside the bag from entering into the bag. A surface of the bag may include a set of bumps.

In another specific embodiment, the container includes a connector including a threaded cylindrical bore, a threaded cylindrical stem, opposite the threaded cylindrical bore, and a passageway extending through the cylindrical bore and stem. The threaded cylindrical bore engages threads at the bottom end of the body. The bag passes through the passageway and is connected to an inside surface of the threaded cylindrical stem. The bottom cap engages threads on an outside surface of the threaded cylindrical stem, opposite the inside surface of the threaded cylindrical stem. There can be a top cap removably connected over the top opening of the body, the top cap may include a top surface that is flat.

In another specific embodiment, there is a container including a body including a top opening and a bottom neck, opposite the top opening, a bag including an opening, a connector that connects the bag to the bottom neck of the body, and a bottom cap removably connected over the opening of the bag and including a one-way valve, where the one-way valve is positioned to allow air to escape from an inside of the bag to an outside of the bag.

In a specific embodiment, the bottom neck comprises first male threads. The connector includes first female threads on a first side of the connector, and second male threads on a second side of the connector, opposite the first side. The bottom cap includes second female threads. The first male threads of the bottom neck engage the first female threads of the connector, and the second male threads of the connector engage the second female threads of the bottom cap.

In another specific embodiment, the bottom neck includes first female threads within an inside of the bottom neck, and first male threads around an outside of the bottom neck. The connector includes second male threads. The bottom cap includes second female threads. The second male threads of the connector engage the first female threads of the bottom neck, and the first male threads of the bottom neck engage the second female threads of the bottom cap.

In a specific embodiment, the one-way valve includes a sealing flap positioned over a first opening on an outside surface of the bottom cap. The sealing flap lifts away from the first opening to allow the air inside the bag to escape, and seals the first opening to block air outside the bag from entering into the bag. The bottom cap may include a set of feet extending away from a bottom surface of the bottom cap, and the one-way valve can be on the bottom surface.

In a specific embodiment, when the bottom cap is removably connected over the opening of the bag, a side surface of the connector remains accessible. In another specific embodiment, when the bottom cap is removably connected over the opening of the bag, the connector is not accessible.

In another specific embodiment, a container includes a non-flexible body including a top opening, and a bottom neck, opposite the top opening, a bag including an opening, the bag being positioned inside the non-flexible body such that the bottom neck encircles a portion of the bag and the opening of the bag is closer to the bottom neck than the top opening of the non-flexible bottle, a first compartment to store a drink, the first compartment being formed by the non-flexible body and an outside of the bag, a second compartment to store an item, the second compartment being formed by an inside of the bag, and a bottom cap including at least one hole. The bottom cap is removably connected at the bottom neck of the non-flexible body, and covers the opening of the bag. When the drink is introduced into the first compartment through the top opening, the drink at least partially collapses the bag around the item as air in the second compartment is permitted to escape from the second compartment through the at least one hole in the bottom cap.

The bottom cap may include an umbrella valve having a sealing flap that is seated on an outside surface of the bottom cap. The sealing flap seals against the outside surface and covers the at least one hole to block outside air from entering through the at least one hole and into the second compartment. The sealing flap lifts away from the outside surface to permit the air to escape from the second compartment through the at least one hole. The bag may include a non-permeable material. The inside of the bag may include a textured surface.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
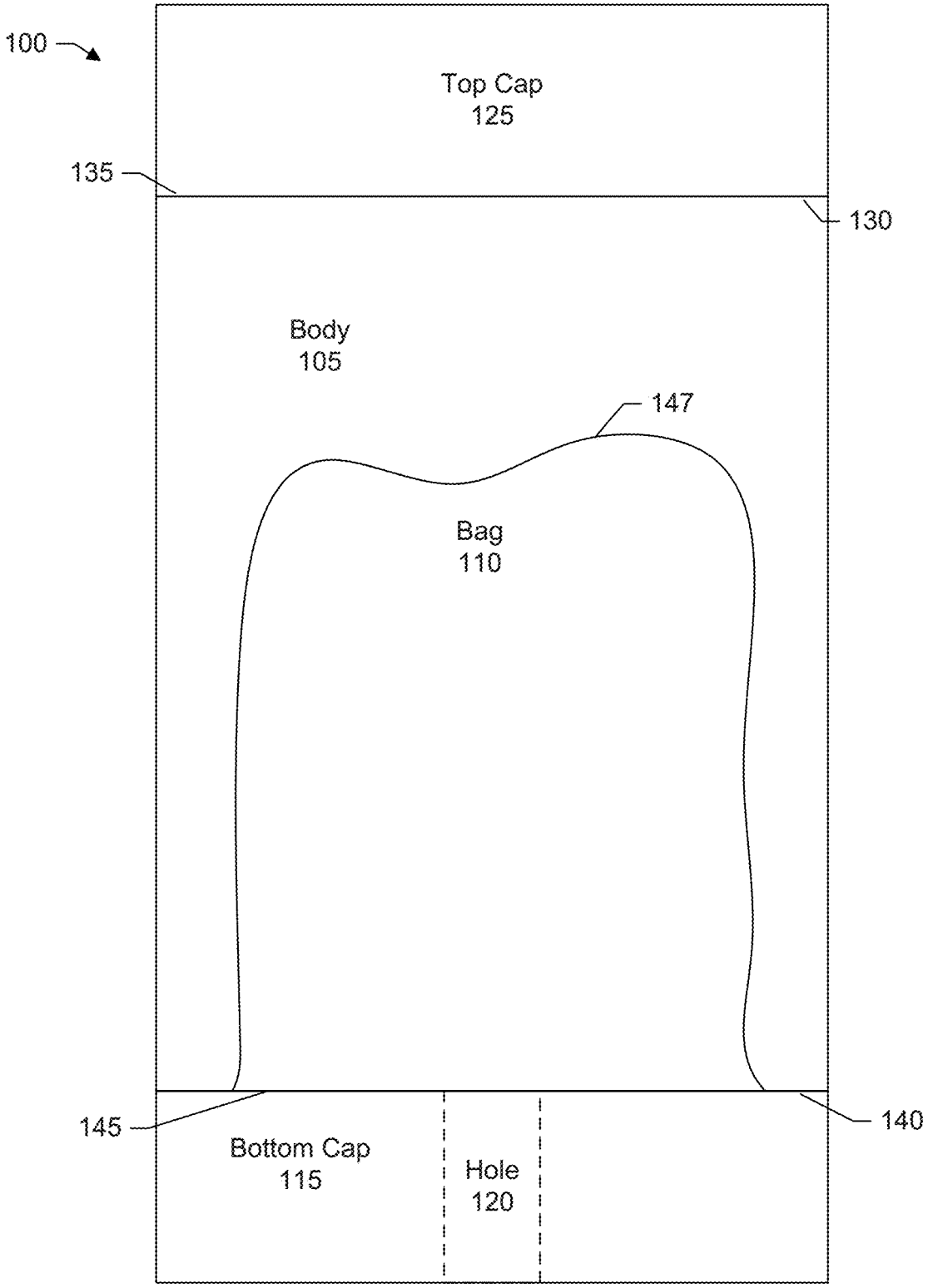
FIG. 1 shows a block diagram of a bottle having self-adjusting compartments.

FIG. 1 shows a block diagram of a container or bottle 100. This bottle includes a body 105, a bag 110 positioned inside the body, a bottom cap 115 having at least one hole 120, and a top cap 125. The top cap is removably connected at a top end 130 of the body and covers an opening 135 at the top end. The bottom cap is removably connected at a bottom end 140 of the body, opposite the top end, and covers an opening 145 of the bag. The opening of the bag is opposite a closed end 147 of the bag. The bag divides an interior space of the bottle body into first and second interior spaces. The body and exterior or outside of the bag defines a first compartment or chamber. The first compartment may be referred to as a drink compartment. The interior or inside of the bag defines a second compartment. The second compartment may be referred to as a storage or accessory compartment.

Figure 3:
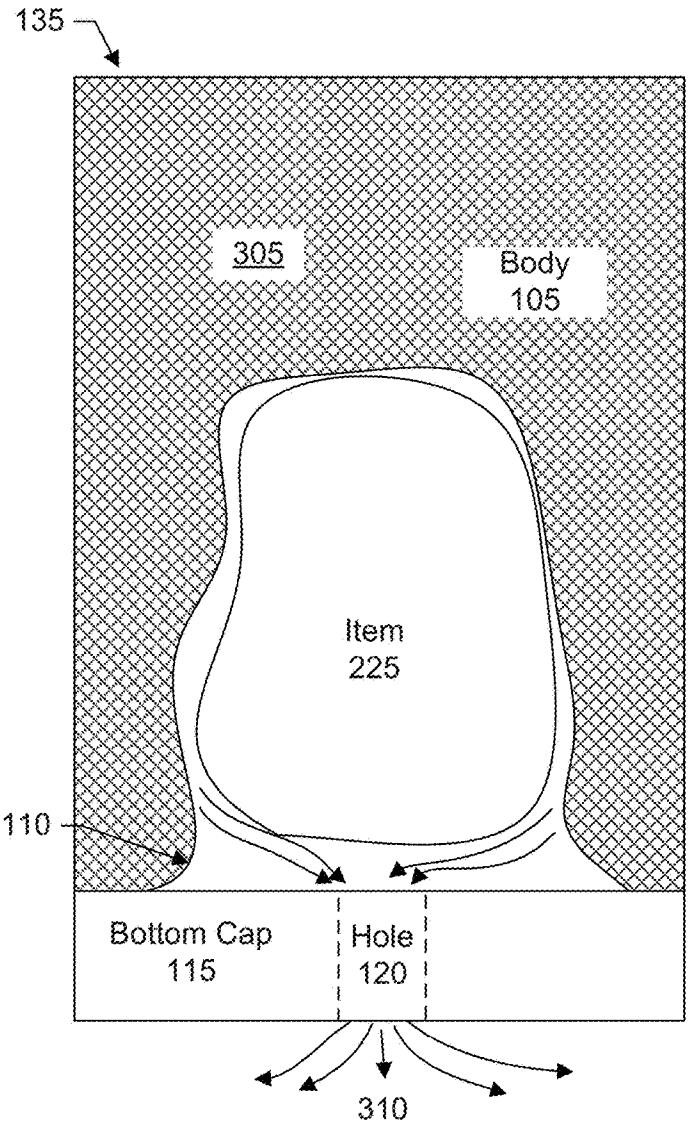
FIG. 3 shows a block diagram of the bottle in a second position with a drink having been poured into the bottle.
Figure 2:
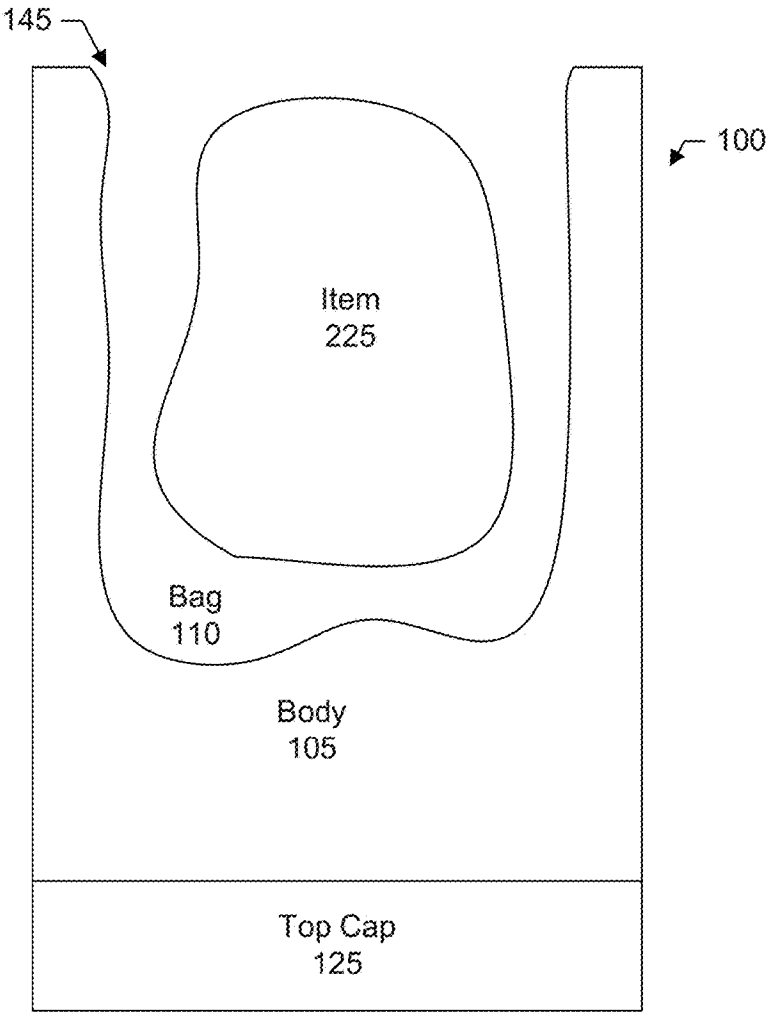
FIG. 2 shows a block diagram of the bottle in a first position with an item having been placed inside the bottle for storage.

A feature of the bottle includes self-adjusting compartments provided by the bag. For example, FIGS. 2-3 show first and second states, respectively, of bottle 100. FIG. 2 shows the bottle in an inverted, upside down, or flipped position. In FIG. 2, the bottom cap has been removed to expose bag opening 145 of bag 110. A user can place one or more items 225 inside the bag, replace the bottom cap, and flip the bottle right-side up.

FIG. 3 shows the bottle flipped right-side up with bottom cap 115 having been placed back on the bottle and the top cap removed to expose opening 135 at the top of the body. The user can pour a drink 305 through the top opening and into the bottle body. The pressure exerted by the drink on the bag at least partially collapses or shrinks the bag around the item as air in the bag is pushed out and allowed to escape 310 through at least one hole 120 in bottom cap 115. The at least one hole passes from an inside surface of the bottom cap to an outside surface of the bottom cap. The at least one hole provides a passage or airway for fluid (e.g., air) to pass from an inside of the bag to an outside of the bag. That is, a flow path of air is from an interior space of the bag and out the at least one hole.

The at least partial collapsing of the bag increases or redistributes the volume available in the bottle body (or first compartment) for the drink. The bag allows the available volume in the bottle for the drink to vary based on the item (e.g., based on the size of the item, number of items, or both). The pressure or fluid pressure of the drink on the bag causes the bag to conform around the item placed inside the bag and to compress at least some of the unused or empty space within the bag which then results in additional space available for the drink. In other words, the space or volume within the bag becomes smaller as the space or volume within the bottle body for the drink becomes larger.

In a specific embodiment, the bottle is designed as a hydration bottle or hydration container. A user can use the bottle while running errands, commuting, traveling, cycling, hiking, running, walking, at the gym or health club, working out, or participating in any other activity. In many cases, the user will have a need or desire to carry additional items. Such items may include keys, money, credit cards, food (e.g., energy bars, energy gels, or supplements), first aid supplies (e.g., adhesive bandages), pills (e.g., aspirin), tools, spare parts, and so forth. For example, if the user is at a health club, the user can use the storage compartment to store things such as a locker key, energy bar, or both while exercising. The user will not have to keep track of multiple things such as a separate water bottle, locker key, and energy bar because these items can all be carried in a single bottle. As another example, if the user is a cyclist the user may want to carry an extra inner tube, a multi-tool, or both in case of an emergency. One or more of these items can be placed inside the bag (see item 225—FIG. 2) and the bottle can then be filled (see drink 305—FIG. 3).

With this bottle, each individual user can decide for themselves how they would like to make the trade-off between the space or volume available for the drink and the space or volume available for the item. For example, storing a large item in the bag results in less available space for a drink. Alternatively, storing a small item in the bag results in more available space for a drink. In some cases, a user may elect to have more space available for a drink and less space available for an item. In other cases, the user may elect to have more space available for an item and less space available for the drink. The same bottle can be used in both cases because the bottle drink and storage compartments are self-adjusting. Combining functions such as drink and item storage into a single container also helps to reduce the likelihood that the user will forget to take something when preparing for the activity or lose something during the activity.

Referring now to FIG. 1, in a specific embodiment, the bag includes or is made of silicone or silicone rubber. Silicone is a flexible, rubberlike plastic with insulating properties and low toxicity. These features can be desirable. The bag may include a plastic material or may be a plastic bag. The bag may be made of a thin, flexible, plastic film, nonwoven fabric, or plastic textile. The bag material may include thermoplastic polyurethane (TPU), polyethylene (e.g., low-density polyethylene (LDPE), or linear low-density polyethylene (LLDPE)), nylon, silicone, rubber, or combinations of these. The material for the bag can be any material that is flexible, durable, and has a low toxicity. The bag material may include a bisphenol A (BPA)-free and phthalates-free plastic made from Food and Drug Administration (FDA) food-grade materials.

The bag is designed to be pliable, deformable, and collapsible. The bag, however, is also made to be durable and resistant to cracking, puncturing, or tearing so that the bottle can be reused multiple times. The bag may or may not be seamless. A seamless design can help to facilitate cleaning and can help prevent the accumulation of bacteria, residue, or other contaminates. The bag may be referred to as a pouch, sack, bladder, pocket, or membrane. The bag is non-permeable so that liquids stored in the drink compartment will not leak or pass through the bag and into the storage compartment.

Figure 4:
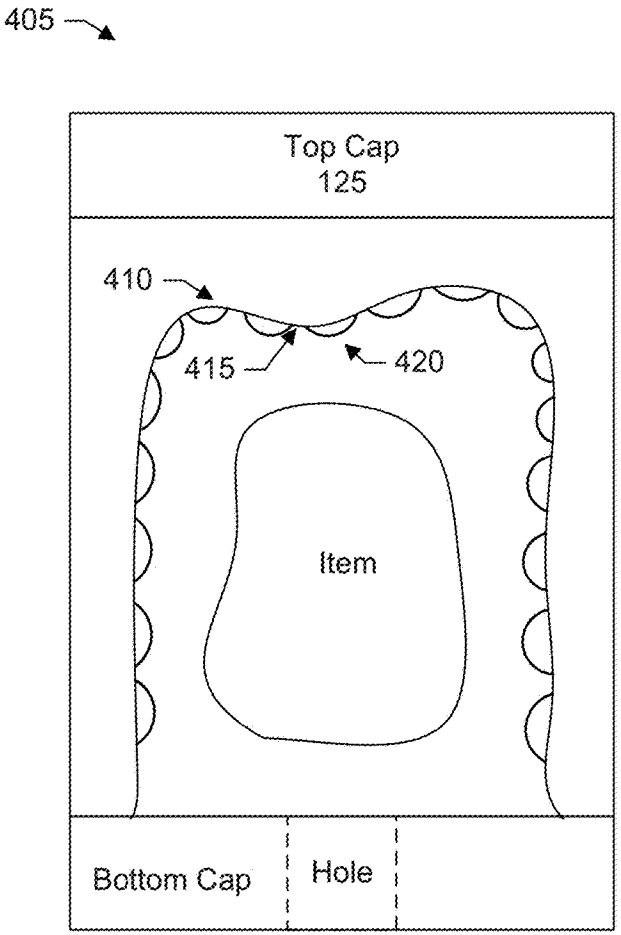
FIG. 4 shows a block diagram of a bottle having a textured storage bag.

FIG. 4 shows a block diagram of a container or bottle 405 according to another specific embodiment. This bottle is similar to the bottle shown in FIG. 1. In this specific embodiment, however, a bag 410 of the bottle includes an inside surface 415 that is at least partially covered with bumps, nubs, knobs, ridges, or other protrusions 420. The surface may be textured (e.g., having a rough or raised texture). These surface features can help to facilitate the flow of air around the item placed in the bag, help to prevent condensation, and help to prevent the bag from sticking or clinging to the item. Condensation is water that collects as droplets on a cold surface when humid air is in contact with the surface. It is desirable to prevent items stored in the bag from becoming wet or moist when, for example the bottle is used on a hot day to store a cold drink. Surface features such as a raised grid pattern can help to facilitate the evaporation of any water that might collect on the surface by helping to prevent small water droplets from combining to form large water droplets.

In a specific embodiment, the inside surface of the bag or at least a portion of the inside surface includes a channel or conduit. The channel may be molded into the bag. The channel may extend longitudinally along the side of the bag. The channel can be used to funnel, direct, or guide condensation that might form on the inside surface of the bag out of the bag towards the bottom cap.

Figure 5:
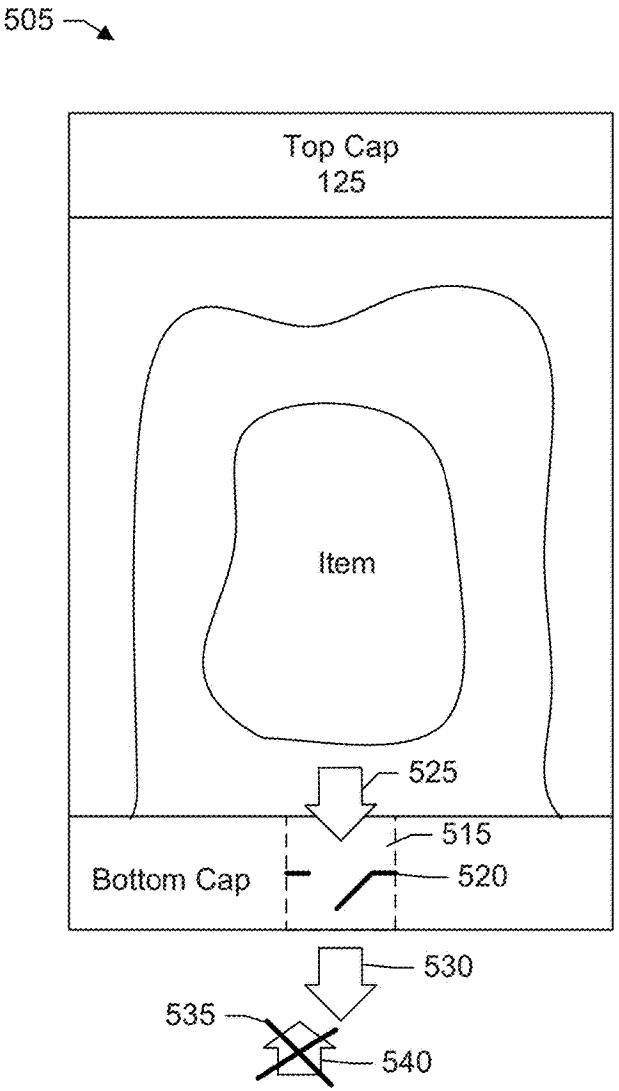
FIG. 5 shows a block diagram of a bottle having a bottom cap with a valve.

FIG. 5 shows a block diagram of a container or bottle 505 according to another specific embodiment. This bottle is similar to the bottle shown in FIG. 1. In this specific embodiment, however, a bottom cap 510 of the bottle includes a hole 515 having or being associated with a valve 520. The valve allows fluid (e.g., air) to flow through it in only one direction. The valve is positioned or configured within the bottom cap to allow fluid or air 525 trapped in the bag to flow out in a first direction 530 and block or prevent 535 outside fluid or air from flowing in a second direction 540, opposite the first direction, into the bag. The valve helps to reduce condensation by preventing outside or ambient air that may be warm or humid from entering through the hole in the bottom cap and into the bag.

The valve can be a one-way valve, check valve, clack valve, or non-return valve. Some specific examples of valves include an umbrella valve, pull-in type umbrella valve, push-in type umbrella valve, Belleville type, duckbill valve, ball check valve, diaphragm check valve, swing check valve or tilting disc check valve, stop-check valve, lift-check valve, and in-line check valve among others. There can be a single valve or multiple valves. For example, there can be two, three, four, five, six, seven, eight, nine, ten, or more than ten valves. Having multiple valves helps to ensure that the bag can collapse quickly when the bottle is being filled with a drink. A quickly collapsing bag improves the user experience by reducing the amount of time the user must wait for the compartments to self-adjust. Multiple valves can help to increase the volume flow rate, volumetric flow rate, rate of fluid flow, or volume velocity of fluid (e.g., air) escaping from the bag to permit the bag to collapse rapidly.

Figure 6:
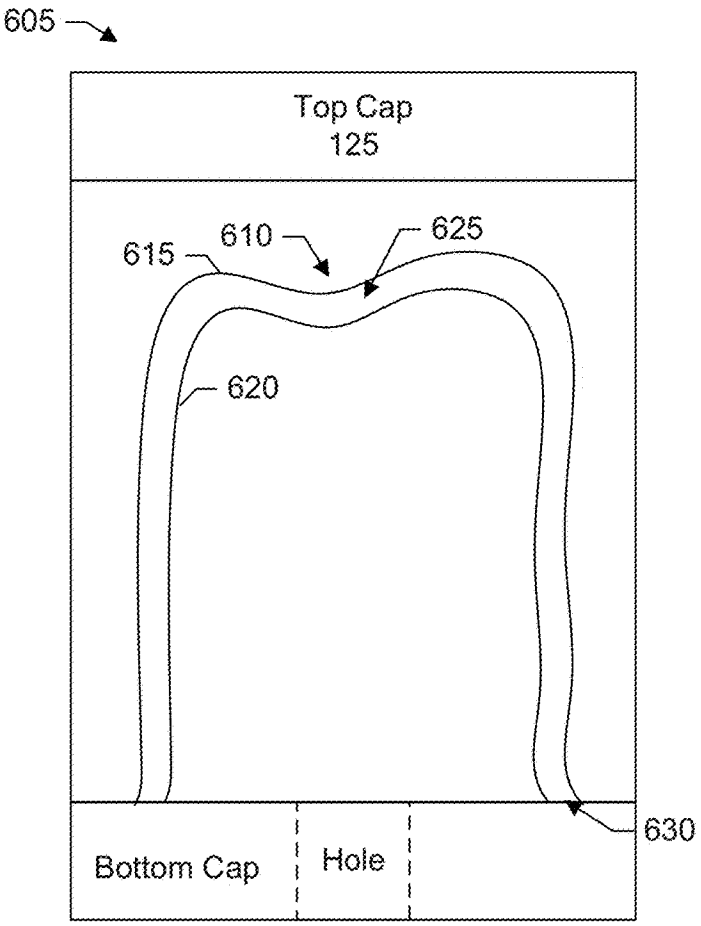
FIG. 6 shows a block diagram of a bottle having a double-ply storage bag.

FIG. 6 shows a block diagram of a container or bottle 605 according to another specific embodiment. This bottle is similar to the bottle shown in FIG. 1. In this specific embodiment, however, a bag 610 of the bottle is an insulated bag or includes insulation. In this specific embodiment, the bag includes an outer layer (or outer bag) 615, an inner layer (or inner bag) 620, and an air gap 625 that is maintained between the outer and inner bag layers. For example, edges or rims 630 of the inner and outer layers may be sealed so that the air gap is permanent. The air gap helps to insulate the environment inside the bag. The insulation can help to prevent or reduce condensation within the bag. Condensation may be sealed within the inner and outer layers. In this specific embodiment, bag 610 may be referred to as a double-ply bag.

The bag may include one or more insulating materials such as an air cellular sheet material or a bubble type material. Any technique, material, or combination of materials and techniques that help to maintain an appreciable temperature difference between the storage and drink compartments may be used as long as the bag is flexible and collapsible so that it can at least partially collapse due to the fluid pressure from the drink. An insulating material may be sandwiched between an inner and outer bag layer. In a specific embodiment, the outer and inner layers may be made from the same material (e.g., silicone). In another specific embodiment, the outer and inner layers may be made from different materials. The outer and inner layers may be of the same or different thickness. The outer and inner layers may have the same or different coatings.

Figure 7:
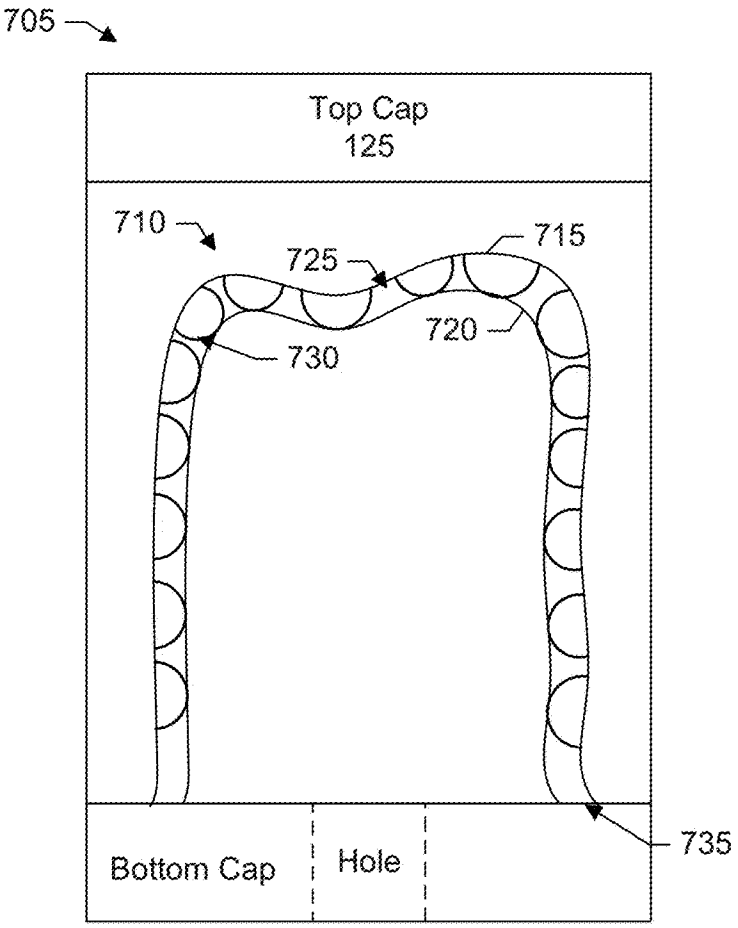
FIG. 7 shows a block diagram of a bottle having a double-ply storage bag according to another specific embodiment.

FIG. 7 shows a block diagram of a container or bottle 705 according to another specific embodiment. This bottle is similar to the bottle shown in FIG. 6. For example, a bag 710 of the bottle includes an outer layer (or outer bag) 715, an inner layer (or inner bag) 720, and an air gap 725 between the outer and inner bag layers. In this specific embodiment, however, there is a spacing structure 730 between or sandwiched between the outer and inner bag layers to provide the air gap. A set of vents 735 between edges or rims of the inner and outer layers allows excess air trapped between the outer and inner bag layers to escape and helps to facilitate good compression of the bag. In other words, in this specific embodiment, air between the outer and inner bag layers may flow out through the vents and into the ambient environment. A vent may include a valve (e.g., one-way valve) that allows air to flow out of the vent, but blocks air from flowing into the vent.

The spacing structure may include protrusions, nubs, ribs, or bumps sandwiched between the outer and inner layers. The spacing structure may be formed on the inner layer, outer layer, or both. For example, bumps may be formed on the outer surface of the inner layer, the inner surface of the outer layer, or both.

The bag may include multiple layers (e.g., two or more layers), a laminate or laminate structure or material. The bag may include a composite of materials. The bag may include an insulating material. An insulating material may have a thermal resistance greater than the corresponding thermal resistance of air. Some examples of materials that may be used to construct the bag include foam (e.g., polyethylene foam or polyethylene closed cell foam), an air cellular sheet material, aerogel materials, bubble wrap, a barrier sheet (e.g., a thermoplastic film or paper), a barrier coating, a thermal coating, a thermal barrier coating, a hydrophobic coating or material, a hydrophilic coating or material, metal foil, silicone, polyethylene, or combinations these. A hydrophobic coating or water-repelling material can allow condensation that forms on the bag to slide down towards the bottom cap and drain out through one or more holes in the bottom cap. A hydrophilic coating or water-absorbing material can absorb the condensation. An example of a water-absorbing material includes cotton.

In a specific embodiment, the closed end of the bag includes a reinforcement. For example, the reinforcement may include a thicker section or portion of bag material, a rigid cap, dome, or combinations of these. For example, a plastic dome may be fused or otherwise attached to the closed end of the bag to help reinforce the closed end of the bag. The reinforcement can help to prevent punctures through the closed end of the bag due to items placed in the bag where the items may have sharp corners or edges.

The bottle may or may not include an internal frame or skeleton attached or molded to the bag. The internal frame or skeleton can be used to help control the direction in which the bag collapses. For example, depending upon the design of the internal frame and desired direction of bag collapse, the bag may collapse in a first direction but may resist collapsing in a second direction, different from the first direction. The first and second directions may be orthogonal or at an angle to each other. For example, the first direction may be along a lateral axis of the bottle. The second direction may be along a longitudinal axis of the bottle, or vice-versa.

A bag may include grooves formed on the surface of the bag to help control and facilitate the collapse of the bag. For example, a groove can provide a fold line at which the bag will collapse. Forming a groove or fold line can help to prevent or reduce pockets of air that may become trapped in the bag. These air pockets in the bag can decrease the volume available in the drink compartment. Alternatively, in some cases, it may be desirable to have some unused space around the item to facilitate removal of the item, insertion of the item, or both. Features such as grooves formed on the bag can help to control the collapse of the bag and maintain some space around the item for clearance during item removal, item insertion, or both.

Referring now back to FIG. 1, in a specific embodiment, the bottle body is made of stainless steel. A stainless steel material is durable, lightweight, easy to maintain, and is generally free of certain chemicals that may be found in plastics. The top and bottom cap may be made of plastic. Plastic is relatively inexpensive and can be easily molded or formed into intricate shapes and designs.

In another specific embodiment, the bottle body is made of plastic. Plastic is generally less expensive than stainless steel. Plastic is generally soft and thus less likely to scratch other objects that may come into contact with the bottle. For example, the bottle may be placed in a satchel, messenger bag, duffel bag, brief case, backpack, or purse. A plastic bottle can be less likely to scratch objects such as a tablet computer that may come into contact with the bottle.

In another specific embodiment, the bottle body is made of glass. Some people have more sensitive palates than others and may prefer drinking from a glass bottle rather than a stainless steel or plastic bottle. In this specific embodiment, the bottle may include protective sleeve such as a silicone sleeve. The sleeve helps to prevent the bottle from breaking by absorbing shock and other impacts. The glass may or may not be tempered. Tempered glass is generally stronger than ordinary, non-tempered, or annealed glass. Further, tempered glass when broken fractures into small relatively harmless pieces. A benefit of ordinary non-tempered glass, however, is that it is less expensive than tempered glass.

In a specific embodiment, the bottle is not designed to be squeezable. That is, the bottle body is rigid, non-squeezable, non-compressible, non-resilient, non-elastic, or non-flexible. In this specific embodiment, if the body is deformed or squeezed, the body may not regain its original shape. In this specific embodiment, the material of the bottle body may include a rigid, hard, or stiff material such as a metal (e.g., stainless steel, aluminum, titanium, or glass), a rigid plastic (e.g., copolyester or Eastman Tritan™ copolyester), carbon fiber, or wood. A rigid bottle may be more resistant to punctures than a soft bottle. The material of the bottle body may be the same as or different from the material of the bag. A bottle may include a combination of materials.

The parts of the bottle including the bottle body, top cap, and bottom cap may be made using any competent material or combination of competent materials to provide desired characteristics. Such materials may include metal, plastic, rubber, silicone, wood, carbon fiber, glass, or combinations of these. The bottle or parts of the bottle material may include silicone, rubber, metal, polycarbonate, polypropylene, polyethylene terephthalate (PET), low density plastics, high density plastics, polycarbonate, polyvinyl chloride (PVC), glass, thermoplastic polyurethane (TPU), thermoplastic elastomer (TPE), thermoplastic rubber (TPR), fiberglass, carbon fiber, or other, wood, or a composite or combination of materials. The body material may include a bisphenol A (BPA)-free and phthalates-free plastic made from FDA food-grade materials. The body material may include a low-density polyethylene (LDPE) thermoplastic. In a specific embodiment, the rigidity of the body is greater than the rigidity of the bag.

In another specific embodiment, the bottle body is designed to be flexible so that it can be easily squeezed. In this specific embodiment, the bottle body may be made of plastic. A soft or flexible bottle may be more likely to flex and not break when dropped as compared to a hard or rigid bottle.

In another specific embodiment, the bottle body is designed—like the bag—to be collapsible as well. In this specific embodiment, the bottle can be collapsed (e.g., made smaller) when not in use. For the example, the bottle having the bag can be collapsed and stored in a user's pocket or handbag. The ability of the bottle to collapse helps to increase the portability of the bottle. When the user desires to use the bottle, the user can expand the bottle. In a specific embodiment, the bottle body includes a set of flexible telescoping concentric tubular sections that telescope or slide into one another as the bottle is collapsed. The user may expand the bottle having the bag by grasping the bottom cap with one hand, the top cap with the other hand, and pulling. The material of the bottle body may include silicone and the material of the bag may likewise include a flexible material. In another specific embodiment, the bottle body is itself like a bladder or pouch. In this specific embodiment, the bottle having the bag can be rolled or folded for storage and unrolled or unfolded for use.

Surfaces of the bottle such as the interior surface of the bottle body, the exterior surface of the bag, or both may include a coating. The coating can be used to mitigate or prevent microbial growth, enhance wear resistance, enhance nonstick properties, facilitate cleaning, provide insulating features, or combinations of these. The bottle may include dishwasher-safe materials so that the bottle can be washed in a dishwasher. The bottle may include freezer-safe materials so that the bottle can be placed in a freezer in order to help lengthen the time a drink remains cold when the bottle is taken out for use. The bottle may be designed to store cold liquids, hot liquids (e.g., hot coffee or hot tea), or both.

A bottle or a portion of the bottle may be clear or translucent so that a user can see the amount of water or other drink remaining inside the bottle. A bottle or a portion of the bottle may be opaque or at least partially opaque so that the contents inside the bottle are hidden, concealed, not visible, or not easily visible. A bottle may include markings such as graduations so that the user can obtain an accurate assessment of the remaining water or other drink inside the bottle. The markings may be made using any technique for making a visible impression on the bottle including, but not limited to, printing, silkscreen printing, masking, painting, anodizing, or etching.

An exterior surface of the bottle may include surface textures to help improve grip and ensure that the bottle does not accidently slip from the user's hand. Some examples of surface textures include nubs, bumps, dimples, ridges, patterns, knurling, a tacky coating, and the like.

Figure 8:
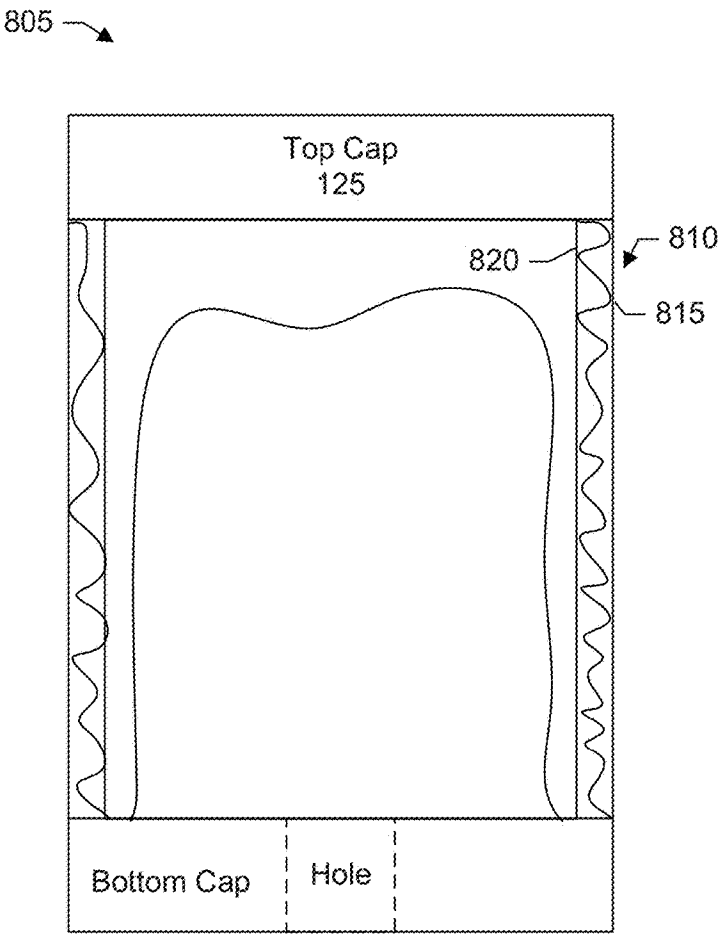
FIG. 8 shows a block diagram of an insulated bottle with self-adjusting compartments.

FIG. 8 shows a block diagram of a container or bottle 805 according to another specific embodiment. This bottle is similar to the bottle shown in FIG. 1. In this specific embodiment, however, the bottle is an insulated bottle or includes insulation. A bottle body 810 include a dual-wall construction. The dual-wall construction includes an outer wall 815 and an inner wall 820. The dual-wall construction helps insulate the bottle contents (e.g., keep a drink in the bottle cold or hot).

There can be an insulating layer of air, glass, or foam between the walls, a foil liner, coatings (e.g., coatings of silver or chromium on surfaces facing the vacuum to reduce heat transfer to or from the interior of the bottle), or combinations of these. In a specific embodiment, the bottle body includes a double-wall construction having a vacuum between the inner and outer walls. In other words, a space between the inner and outer walls has most or all of the air removed. In another specific embodiment, the bottle body includes a single-wall construction.

Figure 9:
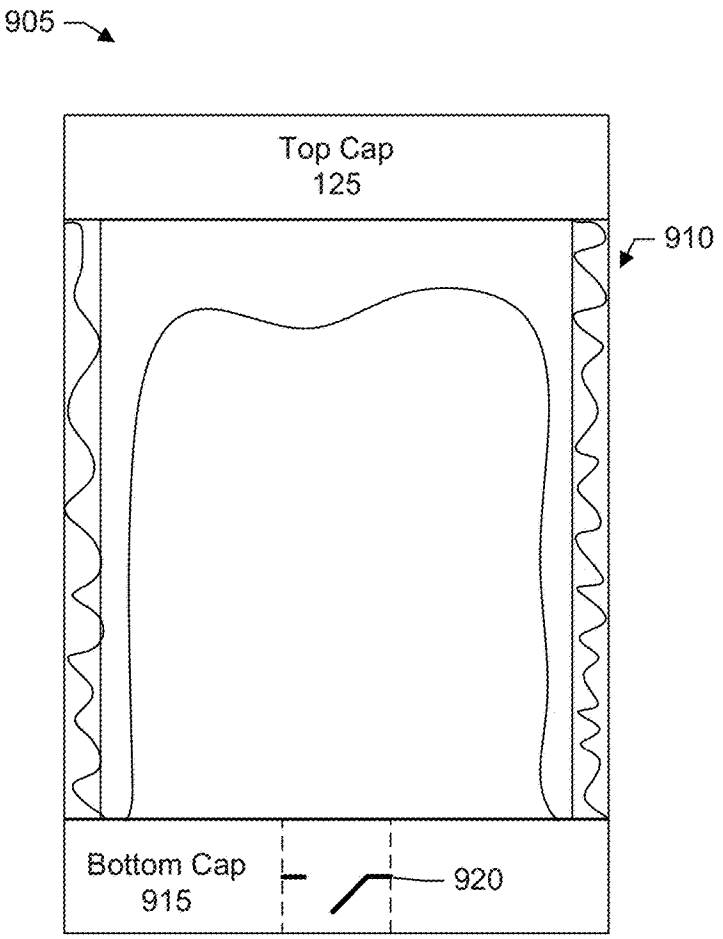
FIG. 9 shows a block diagram of an insulated bottle with self-adjusting compartments and a bottom cap having a valve.

A bottle may include any combination of features described. For example, FIG. 9 shows a block diagram of a container or bottle 905. In this specific embodiment, bottle 905 includes a dual-wall construction 910 for insulation as described in the discussion accompanying FIG. 8, and further includes a bottom cap 915 having a valve 920 as described in the discussion accompanying FIG. 5.

Referring now back to FIG. 1, the top cap may be removably attached to the bottle using any suitable attachment mechanism that provides a fluid or liquid-tight seal between the top cap and the top end of the bottle. The fluid or liquid-tight seal helps to ensure that the drink does not accidently leak out. In a specific embodiment, the top cap is attached to the bottle using threads or screw threads (e.g., continuous or non-continuous threads). In this specific embodiment, the top end of the body includes a threaded male plug. The top cap includes a threaded female jack. In another specific embodiment, the gender of the threads may be swapped. The top cap can be turned or twisted relative to the body to screw the top cap on or off (e.g., turn top cap clockwise to screw onto body, or turn top cap counter-clockwise to unscrew from body). There may be a seal such as a gasket or O-ring between the top cap and top end of the bottle help ensure that the first compartment is watertight.

The bottom cap may be removably attached to the bottle using any suitable attachment mechanism. In a specific embodiment, the bottom cap does not have to provide a watertight seal because the bag will typically store a solid item or object rather than a fluid such as another drink. In this specific embodiment, it is not necessary that the bottom cap be designed to hold, for example, a gasket or O-ring. For example, the bottom cap does not include a channel to retain a gasket. In this specific embodiment, the joint between the bottom cap and the bottom end of the bottle body is not required to be fluid-tight and the joint can be a non-hermetic seal. This can allow for lower manufacturing tolerances as compared to tolerances required for a fluid or water-tight seal.

In another specific embodiment, the bottom cap is designed to form a fluid or water-tight seal. This specific embodiment can allow the bag to be used as a storage compartment for fluids or liquids such as a different type of drink. In this specific embodiment, the bottom cap does not include a hole.

The bottom cap may be removably attached to the bottle using threads or screw threads (e.g., continuous or non-continuous threads). In this specific embodiment, the bottom end of the body includes a threaded male plug. The bottom cap includes a threaded female jack that mates or engages with the threads of the body. The bottom cap can be turned relative to the body to screw the bottom cap on or off (e.g., turn bottom cap clockwise to screw onto body, or turn bottom cap counter-clockwise to unscrew from body).

It should be appreciated, however, that any suitable joining or fastening system may be used to removably secure the bottom cap to the bottle. One of the bottom cap or bottle may include internal threads, and another of the bottom cap or bottle may include external threads. Alternatively, both may include external threads. In another specific embodiment, bottom cap may be removably secured to the bottle using a press-fit, interference fit, friction fit, lug-closure, channel closure, or snap fit.

A press-fit is a fastening between two parts which is achieved by friction after the parts are pushed together. In a press-fit, the external dimension of one part slightly exceeds the internal dimension of the part into which it has to fit. As an example, the bottom cap material may include silicone, rubber, or other stretchable or elastic material so that the bottom cap can be pulled and stretched over the bag opening. A lug closure is a closure system where the bottle has multiple threads and the cap has an equal number of lugs or tabs that grip the corresponding threads. A lug closure may be referred to as a "twist-on."

A snap fit or snap joint is a self-locking joint whose mating parts exert a cam action, flexing until one part slips past a raised lip on the other part, preventing their separation. Some examples of snap fit joints that may be used to removably join the bottom cap to the bottle include a cantilever snap joint, torsion snap joint, or annular snap joint.

In a specific embodiment, the bottom cap is unscrewed (and screwed on) using a direction opposite from a direction used to unscrew (and screw on) the top cap. For example, the threads for the top cap may include right-hand threads. The threads for the bottom cap may include left-hand threads. Thus, if the user happens to grasp the top cap while unscrewing the bottom cap, the top cap will not inadvertently unscrew. In another specific embodiment, the bottle may include markings to indicate where the user should grip the bottle to unscrew the bottom cap. In another specific embodiment, both the top and bottom cap includes right-hand threads.

In a specific embodiment, a shape of a cross section of the bottle includes a circle. That is, the bottle may be shaped like a cylinder or tube. A cylindrical shape helps make the bottle easy to grasp and hold. In another specific embodiment, a shape of a cross section of the bottle includes an oval, ellipse, or is kidney-shaped. A bottle having an oval shape may offer better aerodynamics than a bottle having a circular shape. In another specific embodiment, a shape of a cross section of the bottle includes a square or polygon. A bottle having a square cross section is less likely to roll away should the bottle be tipped on its side. In a specific embodiment, the bottle or a body of the bottle has an elongated shape or form factor. It should be appreciated, however, that the bottle may have any type of form factor, shape, or combination of shapes. For example, the bottle may be molded or contoured so that it can be comfortably held against a person's waist, back, or hip.

The top cap, bottom cap, or both may have any profile, shape, or form factor. In a specific embodiment, a top surface of the top cap is flat. This allows the bottle to flipped upside down (see, e.g., FIG. 2) and remain stable so that the bag compartment can be accessed. For example, in this specific embodiment, the bottle can be flipped upside down so that the top cap is resting against a surface (e.g., a table or counter top). The user can remove their hands from the upside down bottle and the bottle will not tip over. The top cap, bottom cap, or both may include an eyelet so that the bottle can be easily carried. For example, to carry the bottle, the user may hook their finger, a carabineer, or rope through the eyelet. Edges or corners of the top cap, bottom cap, or both may be rounded to help absorb impacts if the bottle is accidently dropped.

In the example of FIG. 1, the at least one hole is shown positioned along a central or longitudinal axis of the bottle. It should be appreciated, however, that the diagram shown in FIG. 1 is merely a schematic to illustrate the operation of the bottle. The at least one hole may be positioned at any location on the bottom cap so long as air in the bag can pass from the bag and out through the at least one hole. An axis passing through the at least one hole may be parallel to the longitudinal axis of the bottle, may intersect the longitudinal axis, may not intersect the longitudinal axis, or may be coincident with the longitudinal axis.

The at least one hole is defined by a first opening formed on an inside surface of the bottom cap and a second opening formed on an outside surface of the bottom cap. The cross-sectional areas of the first and second openings may be the same or different. The cross-sectional area of the first opening may be greater or less than the cross-sectional area of the second opening. The cross-sectional shapes of the first and second openings may be the same or different. For example, the shape of the first and second openings may be a circle. Alternatively, the shape of the first opening may be a circle and the shape of the second opening may be an oval. The first and second openings may be aligned with or a mirror image of each other. The first and second openings may be concentric. Alternatively, the first and second openings may be offset from each other.

There can be any number holes in the bottom cap. For example, there can be one, two, three, four, five, six, seven, eight, or more than eight holes. A hole may be covered by a mesh or screen to help prevent small items stored in the bag from falling out. The hole may be of any shape such as a circle, square, rectangle, diamond, triangle, obround, semicircle, and so forth.

Figure 10:
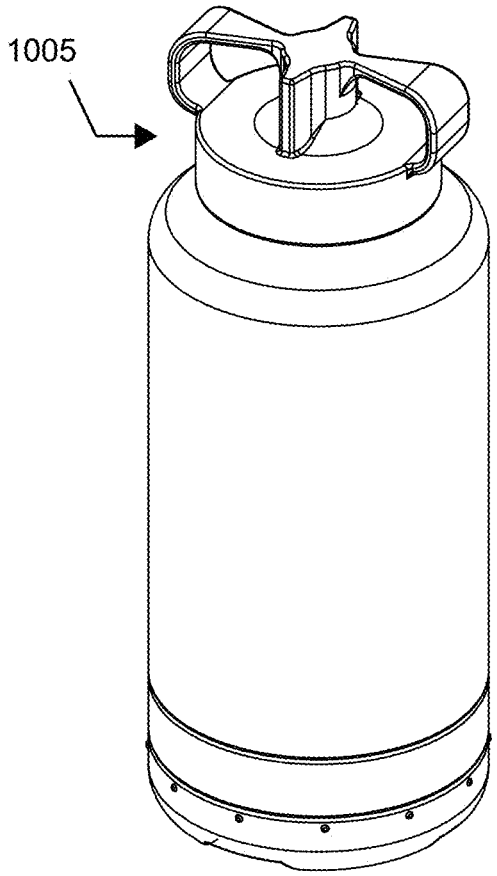
FIG. 10 shows a trimetric view of a specific embodiment of a bottle.
Figure 11:
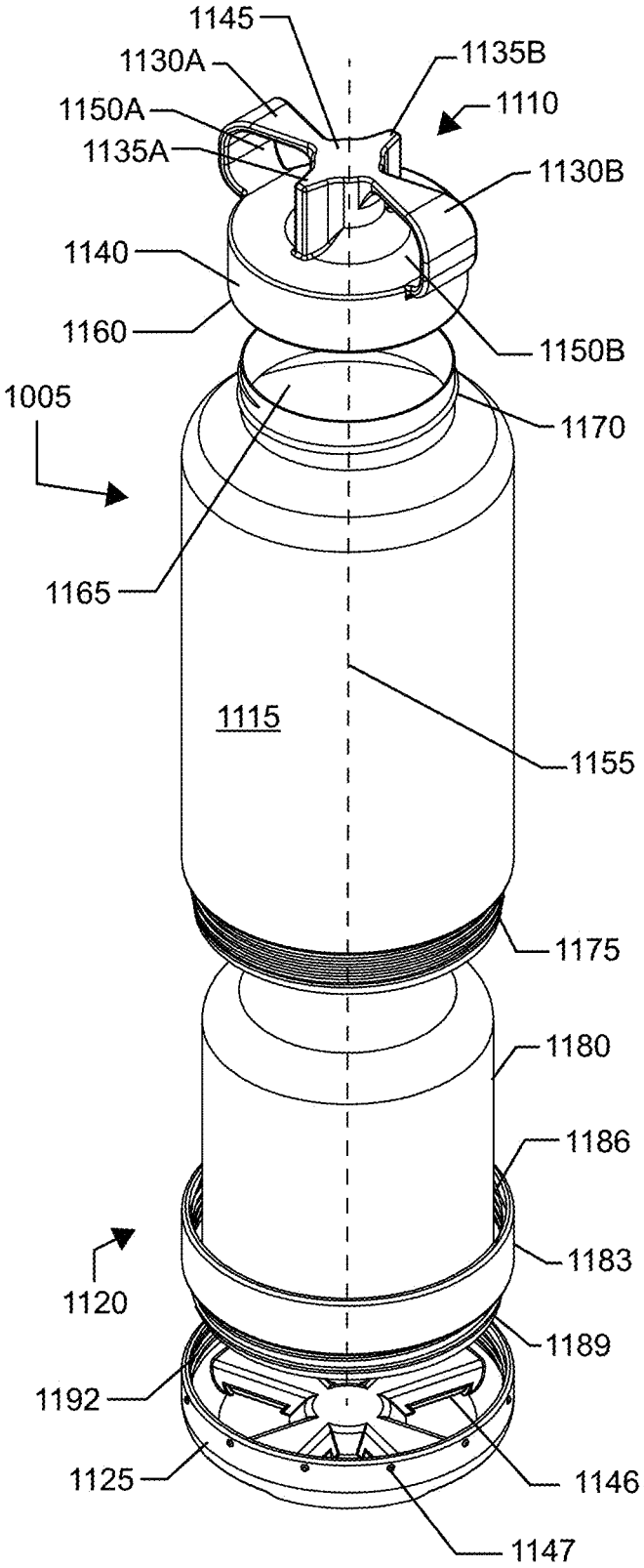
FIG. 11 shows an exploded trimetric view of the bottle shown in FIG. 10.
Figure 12:
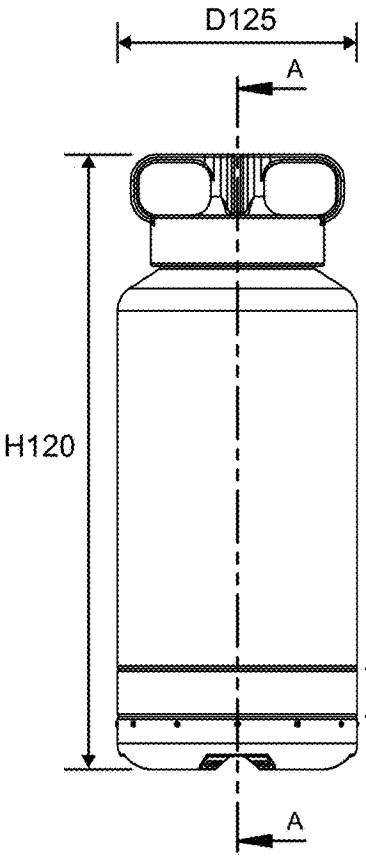
FIG. 12 shows a front view of the bottle.
Figure 13:
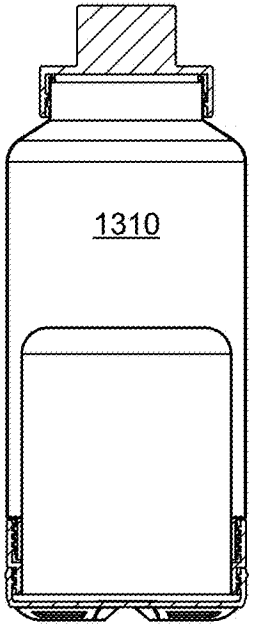
FIG. 13 shows a section view of the bottle.
Figure 14:
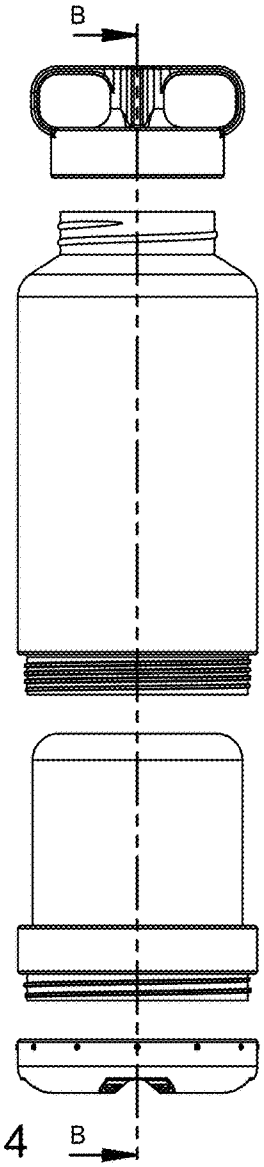
FIG. 14 shows an exploded front view of the bottle.
Figure 15:
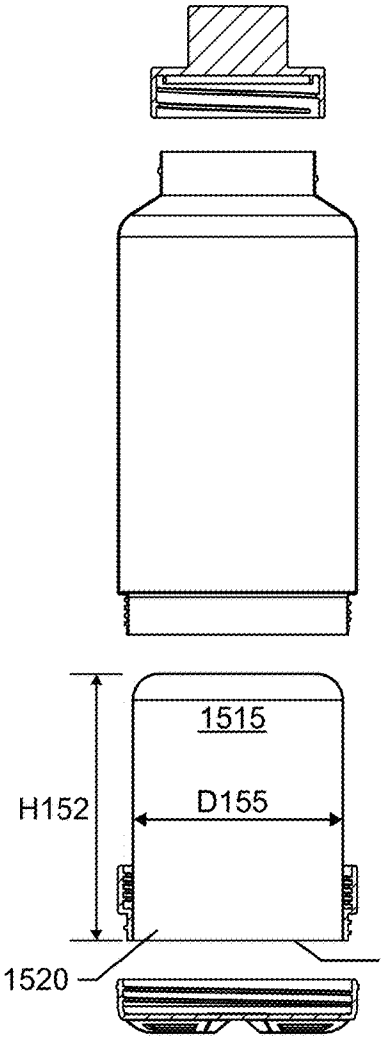
FIG. 15 shows an exploded section view of the bottle.
Figure 16B:
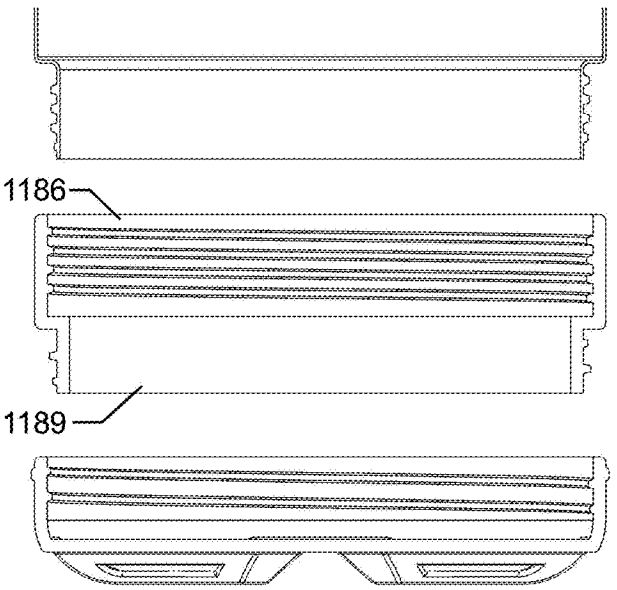
FIG. 16B shows another separated section view of the bottom portion of the bottle.
Figure 16A:
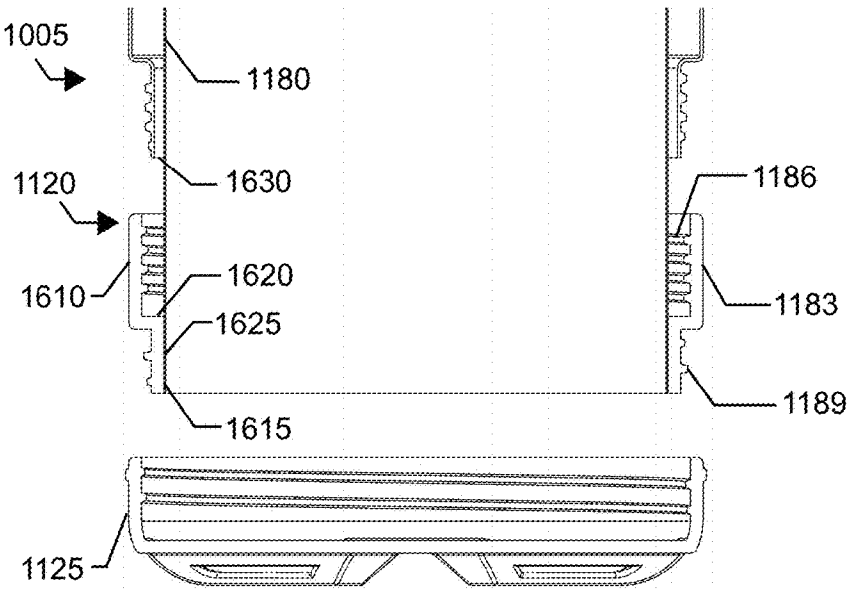
FIG. 16A shows a separated section view of a bottom portion of the bottle.
Figure 16D:
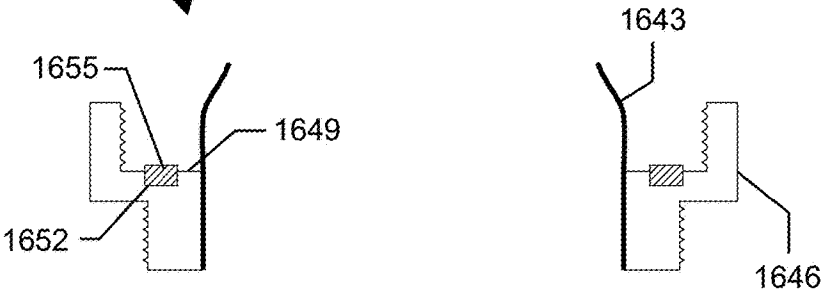
FIG. 16D shows a block diagram of a bag connector according to another specific embodiment.
Figure 16C:
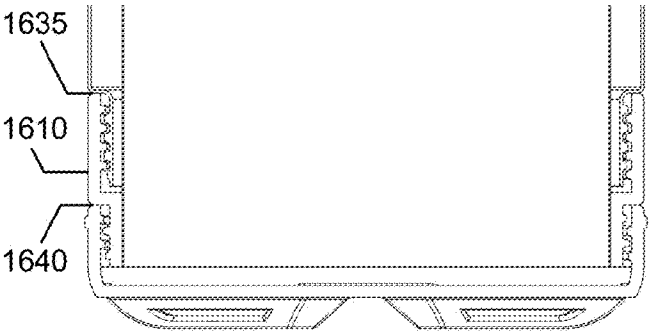
FIG. 16C shows a section view of the bottom portion of the bottle as assembled.
Figure 19:
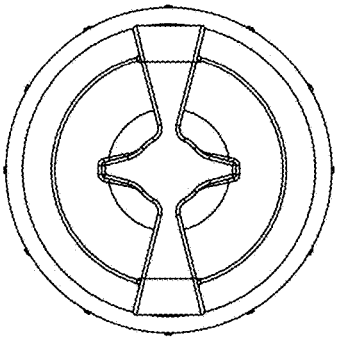
FIG. 19 shows a top view of the bottle.
Figure 17:
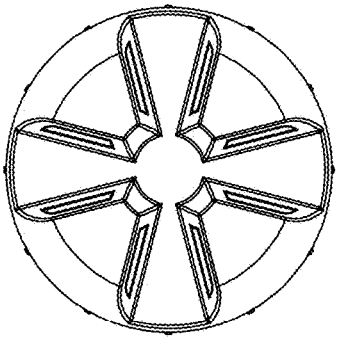
FIG. 17 shows a bottom view of the bottle.
Figure 18:
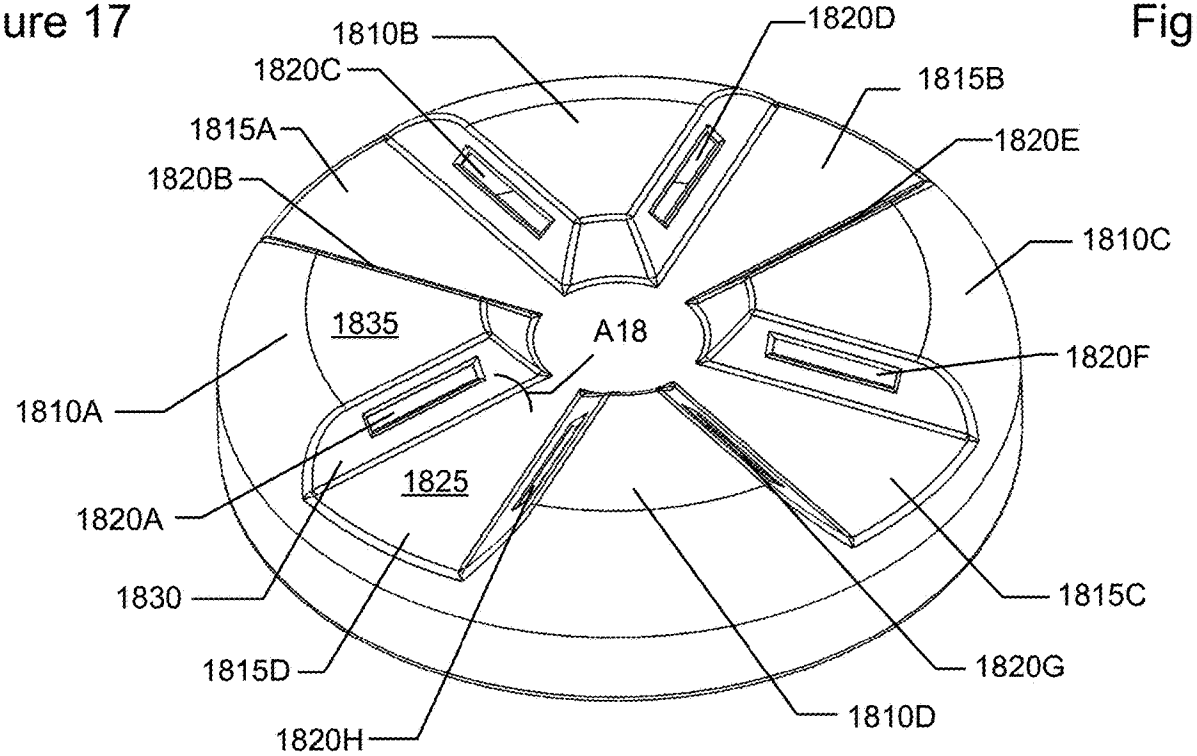
FIG. 18 shows an outside view of a bottom cap of the bottle.

FIG. 10 shows a trimetric view of a specific embodiment of a bottle 1005 having self-adjusting drink and storage compartments. FIG. 11 shows an exploded trimetric view of the bottle shown in FIG. 10. FIG. 12 shows a front view of the bottle. FIG. 13 shows a section view of the bottle taken along a section line A-A as indicated in FIG. 12. FIG. 14 shows an exploded front view of the bottle. FIG. 15 shows a section view of the bottle taken along a section line B-B as indicated in FIG. 14. FIG. 16A shows a separated section view of a bottom portion of the bottle. FIG. 16B shows a separated section view of the bottom portion of the bottle without the bag. FIG. 16C shows a section view of the bottom portion of the bottle in an assembled state. FIG. 17 shows a bottom view of the bottle. FIG. 18 shows an outside view of a bottom cap of the bottle. FIG. 19 shows a top view of the bottle.

Referring now to FIG. 11, bottle 1005 includes a top cap 1110, bottle body 1115, bag assembly 1120, and bottom cap 1125. The top cap includes a first set or pair of spokes 1130A-B, a second set or pair of spokes 1135A-B, a lid portion 1140, and a top surface 1145.

The bottom cap includes at least one hole 1146 and a set of nubs 1147 or other surface texturing on a side surface of the bottom cap. The set of nubs allow the user to securely grip the bottom cap.

The first set of spokes on the top cap include openings or loops 1150A and B. The openings allow the bottle to be easily carried. For example, the user may carry the bottle by inserting their index and middle fingers through openings 1150A and B, respectively. Alternatively, a rope, carabiner, hook, or clip can be passed through an opening. The edges of openings 1150A and B (and other edges of the top cap) may be contoured or curved to make the bottle comfortable to carry. Curved edges can also resist chipping better than sharp edges.

In this specific embodiment, the first and second set of spokes extend radially outward from a central axis 1155 passing through the bottle. The first and second set of spokes are orthogonal to each other. Widths of the first set of spokes increase as one moves in a direction radially outward from the central axis. The increasing width helps to strengthen the top cap and reduces the probability that a spoke will break or crack if the bottle is accidentally dropped.

Widths of the second set of spokes decrease as one moves in a direction radially outward from the central axis. The decreasing widths help to maintain clearance on each side of openings 1150A and B. For example, the user can place their fingers through the openings without encountering interference from the second set of spokes. A spoke may be referred to as a prong.

Top surface 1145 is flat. The top surface along with the arrangement of the first and second set of spokes help to stabilize the bottle when the bottle is flipped upside down to access the storage compartment. For example, the bottle may be flipped upside down and placed on a surface (e.g., a table top) such that the top surface forms a base for the bottle. The bottle, while in the upside down position, is not likely to fall or tip because the top surface is flat.

Another benefit of this top cap design is that the top cap can be manufactured using a single process or mold. For example, there can be a single part line for a mold that extends parallel to the first set of spokes and perpendicular to the second set of spokes. The part line divides the top cap into mirror images. The decreasing widths of the second spokes provide draft angles for the mold to be removed. The mold will not be locked.

The top cap can be molded as a single piece which can reduce manufacturing costs. Reducing the number of processes helps to lower manufacturing costs as compared to other designs which may require additional processes. In another specific embodiment, a particular top cap design may manufactured using two or more separate pieces. The two or more separate pieces may then be joined to form the top cap. The lid portion of the top cap includes female threads 1160.

The bottle body includes a top neck 1170, and a bottom neck 1175, opposite the top neck. The top neck includes an opening 1165. The top and bottom neck include male threads.

The male threads on top neck 1170 of the bottle body engage female threads 1160 of the top cap. The threads allow the top cap to be screwed on or off. Opening 1165 allows the user to access a drink compartment 1310 (FIG. 13) of the bottle.

The bag assembly includes a bag 1180 and a connector 1183, connected at an opening 1510 (FIG. 15) of the bag. The connector includes a passageway 1520 (FIG. 15), bore 1186 (FIG. 11), and stem 1189 (FIG. 11). In this specific embodiment, bore 1186 includes female threads and may be referred to as a threaded cylindrical bore. Stem 1189 includes male threads and may be referred to as a threaded cylindrical stem. A shape of a cross section of the bore and stem is a circle.

The threaded cylindrical bore is on a top side of the connector. The threaded cylindrical stem is on a bottom side of the coupler, opposite the top side. The passageway passes through the threaded cylindrical bore and stem. Bag 1180 is positioned inside the passageway of the connector. The connector may be referred to as a collar, ring, coupler, nipple, or sleeve.

Female threads of threaded cylindrical bore 1186 engage male threads of bottle bottom neck 1175. The threads allow the bag assembly to be screwed on or off the bottle. The bag assembly can be removed from the bottle so that the bottle and bag can be cleaned easily.

Male threads of threaded cylindrical stem 1189 of the connector engage female threads 1192 of the bottom cap. The threads allow the bottom cap to be screwed on or off the bag assembly. For example, the bottom cap can be unscrewed to expose opening 1510 (FIG. 15) of the bag. Opening 1510 allows the user to access a storage compartment 1515 that is provided by the bag.

FIG. 16A shows a separated section view of a bottom portion of the bottle. As discussed above, bottle 1005 includes bag assembly 1120 and bottom cap 1125. The bag assembly includes bag 1180 and connector 1183. The connector includes threaded cylindrical bore 1186 with female threads on the top side of the connector and threaded cylindrical stem 1189 with male threads on the bottom side of the connector, opposite the top side. In the example of FIG. 16A, the bag is shown partially inserted through an opening of the bottle bottom neck. An outside diameter of the bottom neck opening may be slightly less than an outer diameter of the bag. This allows the bag to pass through the bottom neck opening without crinkling. The bottom neck encircles at least a portion of the bag.

The connector includes an outside surface 1610 of the threaded cylindrical bore, an inside surface 1615 of the threaded cylindrical stem, and an inside shoulder 1620 between the cylindrical bore and stem. The shoulder may be referred to as a shelf, inside flange, or ledge. An inner diameter of the threaded cylindrical bore may be greater than an inner diameter of the threaded cylindrical stem.

Outside surface 1610 is opposite an inside surface of the threaded cylindrical bore having the female threads. Outside surface 1610 is between a first joint or seam 1635 (FIG. 16C) and a second joint or seam 1640 (FIG. 16C). The first joint is formed by the connecting of the connector to the bottom neck of the bottle. The second joint is formed by the connection of the bottom cap to the connector. In this specific embodiment, the outside surface of the connector remains exposed or accessible when the bottom cap is attached.

In a specific embodiment, the outside surface includes a surface texture. The surface texture helps the user to grip the connector when the connector is being joined to the bottle body or removed from the bottle body. The outside surface may instead or additionally be made from a tacky material or have a tacky coating. The outside surface may include a textured pattern or knurling. The pattern forms grooves, indentations, or recesses into the connector material. The pattern may include raised features such as ridges that rise from the surface of the connector material.

The pattern helps to increase the friction between the connector and the user's fingers so that the connector can be securely tightened onto the bottle body and easily removed for cleaning. For example, the connector may be removed or attached by pinching the connector between the first and second joints and turning or twisting.

The pattern may include one or more finger depressions to indicate where the user should hold when removing the bottom cap from the bottle. For example, when unscrewing the bottom cap, the user may hold the connector so that the connector does not unscrew with the bottom cap. The pattern may be formed or molded with the connector. Other processes that may be used to form the pattern include etching, stamps, dies, deposition, coating, and many others.

In a specific embodiment, the outside surface of the bag connector piece includes a visible marking to indicate the location at which the bottle should be held when unscrewing the bottom cap. The visible marking may include text, e.g., "Hold here to unscrew bottom cap," symbols, diagrams, pictures, or combinations of these. Such a marking may be made using any technique for making a visible impression on the outside surface of the bag connector including, but not limited to, printing, silkscreen printing, masking, stamping, plating, thermography, embossing, painting, engraving, etching, anodizing, oxidizing, deposition, imprinting, and chemical processing.

When the bottom cap is removably connected at the bottom neck and over the opening of the bag, a portion of the connector (e.g., outside surface 1610) will remain accessible or exposed. The user can grip the connector and rotate the bottom cap relative to the connector. In a specific embodiment, a height H2 (FIG. 12) of the outside connector surface is about 18 millimeters (mm). It should be appreciated, however, that the height can vary greatly. Height H2 may range from about 10 mm to about 100 mm. This includes, for example, 11, 12, 13, 14, 15, 16, 17, 18, 19, 20, 21, 22, 23, 24, 25, 26, 27, 28, 30, 35, 40, 45, 50, 60, 70, 80, 90, or more than 100 mm. Height H2 may be less than 10 mm.

The outside surface of the bag connector piece, outside perimeter side surface of the bottom cap, or both may be flush with a side surface of the bottle body. This helps to prevent the bottle from catching, snagging, or hooking other objects may come into contact with the bottle. The bottle body may include a first outer diameter. The connector may include a second outer diameter. The bottom cap may include a third outer diameter. In this specific embodiment, the first, second, and third outer diameters are the same. In another specific an outer diameter of the bottle body, connector, and bottom cap may be different from an outer diameter of another of the bottle body, connector, and bottom cap. Having different outer diameters can help the user to distinguish between the parts.

In a specific embodiment, a surface or surface texture of the bag connector piece is different from a surface or surface texture of the bottom cap. For example, the connector may include a first type of surface texture. The bottom cap may include a second type of surface texture, different from the first type of surface texture. The first surface texture may be rougher than the second surface texture, or vice-versa. The first surface texture may include a greater density of numbs than the second surface texture, or vice-versa. The first surface texture may include numbs having a shape that is different from numbs on the second surface texture. The connector may be a first color. The bottom cap may be a second color, different from the first color.

The differences in surface textures, colors, or both help the user to distinguish between the connector and bottom cap. Any technique or combination of techniques that allows for a visual difference, tactile difference, or both between the side surfaces of the connector and bottom cap may be used. Similarly, the side surface of the bottle body may include a third surface texture, color, or both. The third surface texture may be different from the first surface texture, the second surface texture, or both. The different types of surfaces, colors, or both help the user to determine whether they are holding the bottle body, the connector, or the bottom cap.

In a specific embodiment, there can be a locking mechanism to secure the connector to the bottle body. The locking mechanism helps to ensure that the connector is not inadvertently loosened when the bottom cap is removed. The locking mechanism may include, for example, a coating or high-friction coating that is applied to the bottom neck of the bottle, cylindrical bore of the connector, or both. The coating may not be applied to the cylindrical stem of the connector. The coating helps to increase the friction between the bottom neck and connector. A coefficient of friction between the bottom neck and connector may be greater than a coefficient of friction between the connector and the bottom cap.

A connector may be made from a composite of materials. For example, the bore may be made from a first material. The stem may be made from a second material, different from the first material. The first material may provide for a higher coefficient of friction between the bore and bottom neck. The second material may provide for a lower coefficient of friction between the stem and bottom cap.

In another specific embodiment, the locking mechanism is implemented using different attachment designs for the connector-to-bottle body interface and the connector-to-bottom cap interface. For example, parameters associated with screw thread design include handedness, gender, form, angle, lead, pitch, start, thread size (e.g., coarse versus fine), major diameter, minor diameter, pitch diameter, fit classes (e.g., lose versus tight), surface finish, thread depth, and taper. Values for one or more of these parameters or properties may be selected such that the friction between the connector-to-bottle body interface is greater than the friction between the connector-to-bottom cap interface. There can be a lock nut to secure the connector to the bottom neck.

The torque specification of the bore to the bottom neck may be greater than the torque specification of the stem to the bottom cap. The bore may be configured to be torqued more tightly to the bottom neck than the stem to the bottom cap. This helps to ensure that the connector does not unscrew with the bottom cap.

In another specific embodiment, the interface for connecting the connector to the bottle body is different from the interface for connecting the connector to the bottom cap. Having different connection interface types can reduce the likelihood of the connector being inadvertently removed or loosened when the bottom cap is removed. For example, in a specific embodiment, a connector includes first and second connection interfaces. The first connection interface connects the connector to the bottle body. The second connection interface connects the connector to the bottom cap. The first connection interface is different from the second connection interface. The first connection interface may include screw threads. The second connection interface may include a press-fit or interference fit.

The first connection interface may specify a first type of motion to remove the connector from the bottle body (e.g., rotary or twisting motion). The second connection interface may specify a second type of motion to remove the connector from the bottle body (e.g., a linear or pulling motion).

Referring now to FIG. 16A, inside surface 1615 is opposite an outside surface of the threaded cylindrical stem having the male threads. The bag includes a rim 1625. The inside surface of the connector is joined to an outside surface of bag rim 1625. The bottle bottom neck is between the bag and threaded cylindrical bore. The bottle bottom neck at least partially encircles, surrounds, or extends around a portion of the bag.

Any competent technique or combinations of techniques may be used to join the connector and bag. In a specific embodiment, a welding, ultrasonic welding, or heating process is used to create a solid-state weld between the connector and bag. In another specific embodiment, an adhesive may instead or additionally be used to join the parts together. The joining can create a permanent attachment between the connector and the bag. In another specific embodiment, the connector and bag may be molded as a single or integrated unit. There can one or more mechanical clamps or pieces (e.g., collar) that may instead or additionally be used to join the connector and bag together. The design of the bag assembly as shown in FIG. 16A allows for a very wide bag opening. A wide bag opening allows for the insertion (and removal) of large items.

It is desirable that a joint or mating surface formed between inside shoulder 1620 and an edge 1630 of the bottom neck of the bottle body be watertight. This helps to ensure that liquids in the drink compartment do not leak out from the bottle body. This may be facilitated by, for example, providing a thread design that allows the connector to be securely tightened to the bottom neck of the body, selecting a material for the connector that can resiliently deform against edge 1630 to help seal any gaps, or both.

In another specific embodiment, a washer, gasket, or O-ring may be used at the joint. For example, FIG. 16D shows a detailed section view of a bag assembly 1640. This bag assembly is similar to the bag assembly shown in FIG. 16A. For example, the bag assembly includes a bag 1643 and a connector 1646.

An inside shoulder 1649 of connector 1646, however, includes an annular groove or channel 1652 formed along the circumference of the shoulder. The groove receives or houses a washer 1655. The washer can be a rubber washer. The washer compresses to provide a mechanical seal that fills the space between the shoulder of the connector and the edge of the bottom neck of the bottle. The edge of the bottle bottom neck may include a lip that contacts the inner shoulder (or washer) to form a seal.

It should be appreciated that the sealing elements may be swapped. For example, in another specific embodiment, the annular groove may be formed on edge 1630 (FIG. 16A) of the bottle bottom neck. The annular groove on the bottle bottom neck receives a washer. The washer contacts the connector to form a watertight seal.

FIG. 18 shows an enlarged bottom view of a specific embodiment of the bottom cap. The bottom cap includes a set of feet including feet 1810A-D, a set of channels including channels 1815A-D, and a set of holes including holes 1820A-H.

The feet extend away from a bottom surface 1825 of bottom cap in a direction parallel to the central axis. The feet are distributed radially about the central axis. Holes are located on each side of a foot. For example, foot 1810A includes a first side surface 1830 extending between the bottom surface of the bottom cap and a bottom surface 1835 of the foot. Locating or positioning the holes on the sides of the feet helps to reduce the probability that small items placed in the bag will fall out. Locating the holes on the sides further helps to facilitate the flow of air out of the bag.

More particularly, the channels are distributed radially about the central axis. A channel is formed between two feet. For example, channel 1815D is between foot 1810A and foot 1810D. The channel provides a clear passageway for air flowing out of the holes. For example, when the bottle is placed on a surface, the holes will not be blocked by the surface because the holes are on the sides of the feet. Air escaping from the bag can pass unobstructed through the holes and channels in the bottom cap.

It should be appreciated that a hole may be located anywhere on the bottom cap as long as the hole can be in fluid communication with the interior of the bag. For example, a hole may be located on the bottom surface of the bottom cap. A hole may be located on a bottom surface of a foot. A side of the foot may include multiple holes (e.g., two, three, four, five, or more than five holes). In the example shown in FIG. 18, the holes are shaped as rectangles or slots. Other examples of shapes that may be used in other embodiments include circles, squares, rectangles, diamonds, triangles, ovals, and many others. A hole may be located on a single side of a foot or on two or more sides of a foot.

An angle A18 is between the side surface of the foot and bottom surface of the bottom cap. In a specific embodiment, angle A18 is obtuse or greater than 90 degrees. Angle A18 may range from about 100 degrees to about 160 degrees. This includes, for example, 110, 120, 130, 140, 150, or more than 160 degrees. The angle may be less than 100 degrees. The angle may be less than 90 degrees (e.g., an acute angle).

In the example of the bottom cap shown in FIG. 18, the surface area of the bottom surfaces of the feet increase as one moves radially outward from the central axis. The large surface area helps to provide good stability when the bottle is placed on a surface.

As discussed above, in a specific embodiment, the bag and bag assembly are removable from the bottle body. This helps to facilitate cleaning. In another specific embodiment, the bag or bag assembly is permanently attached to the bottle body. For example, an adhesive may be used to permanently attach the bag to the bottom neck of the bottle. Instead or additionally, a bag assembly may be permanently press-fitted into a bottom neck of a bottle. In this specific embodiment, a bore of a connector of the bag assembly may not include threads. Likewise the bottom neck of the bottle may also not include threads. In this specific embodiment, the connector is press-fitted into the bottom neck. A press-fit or interference fit may be designed as a permanent connection. Having the bag permanently attached to the bottle can help to reduce the probability of leaks.

In a specific embodiment, a cross-sectional shape of the connector bore and stem may be of a shape other than a circle. For example, the cross-sectional shape of the connector bore, connector stem, or both may be a square, rectangle, oval, or other shape. The cross-sectional shape of the connector bore may be the same as or different from the cross-sectional shape of the connector stem.

Referring now back to FIGS. 12 and 15, some dimensions are shown for a specific embodiment of the bottle. A dimension H120 (FIG. 12) indicates a height of the bottle. A dimension D125 indicates a diameter of the bottle. A dimension H152 (FIG. 15) indicates an inner height or depth of the bag. A dimension D155 indicates an inner diameter of the bag.

In a specific embodiment, the height of the bottle (H120) is about 231 millimeters (mm), the diameter of the bottle (D125) is about 90 mm, the height or depth of the bag (H152) is about 101 mm, and the diameter (D155) of the bag is about 80 mm. It should be appreciated, however, that these dimensions can vary greatly depending upon the application, user, and other factors. For example, different people may have different size preferences for a bottle. Some people, such as children, may want a small bottle for portability and ease of handling. Other people may want a large bottle.

The height of the bottle (H120) may range from about 60 mm to about 400 mm. This includes, for example, 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 290, 300, 350, or more than 400 mm. The height of the bottle may be less than 60 mm.

The diameter of the bottle (D125) may range from about 50 mm to about 160 mm. This includes, for example, 55, 60, 65, 70, 75, 80, 85, 90, 95, 100, 105, 110, 115, 120, 125, 130, 135, 140, 145, 150, 155, or more than 160 mm. The diameter of the bottle may be less than 50 mm.

The depth of the bag (H152) may range from about 50 mm to about 350 mm. This includes, for example, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 290, 300, or more than 350 mm. The depth of the bag may be less than 50 mm.

The diameter (D155) of the bag may range from about 40 mm to about 150 mm. This includes, for example, 45, 50, 55, 60, 65, 70, 75, 80, 85, 90, 95, 100, 105, 110, 115, 120, 125, 130, 135, 140, 145, or more than 150 mm. The diameter of the bag may be less than 40 mm.

Figure 24:
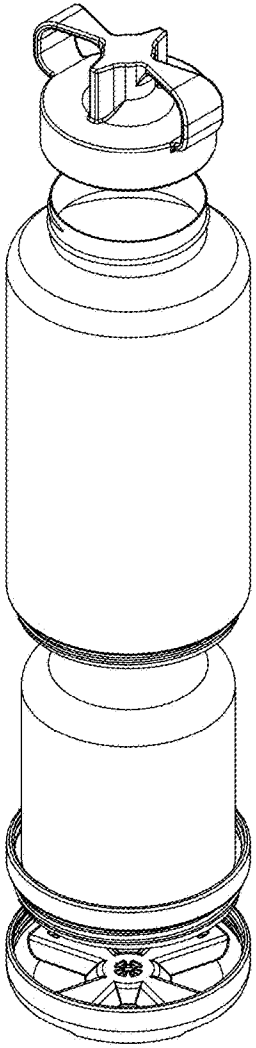
FIG. 24 shows an exploded trimetric view of the bottle.
Figure 23:
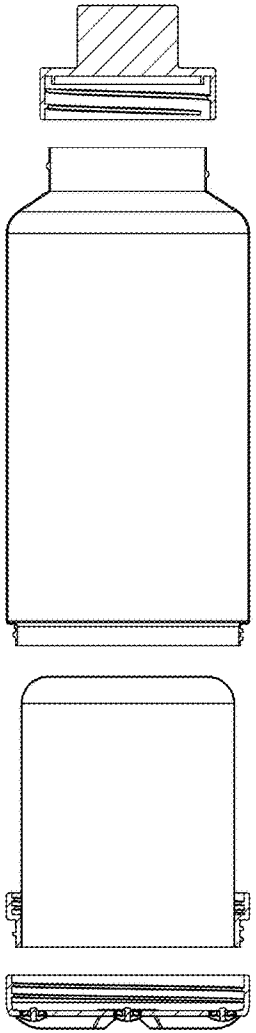
FIG. 23 shows an exploded section view of the bottle.
Figure 22:
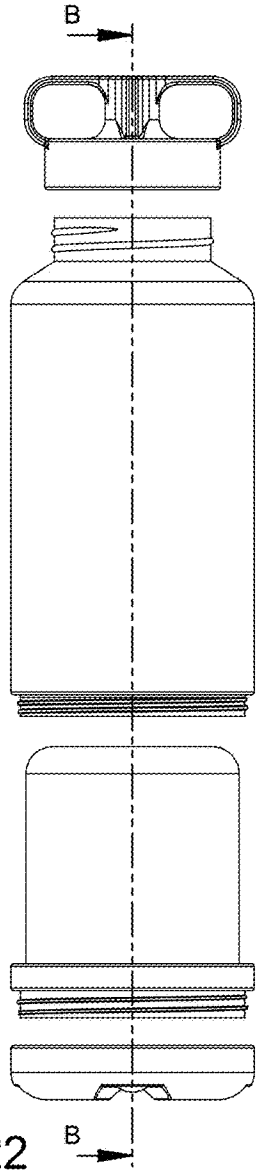
FIG. 22 shows an exploded front view of the bottle.
Figure 21:
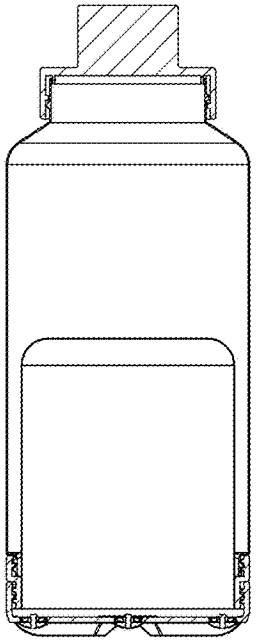
FIG. 21 shows a section view of the bottle.
Figure 20:
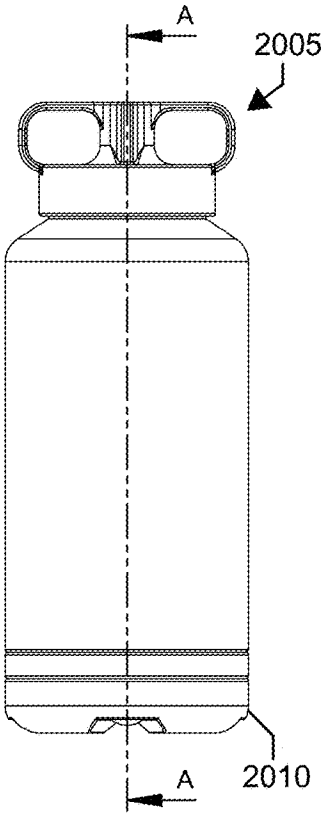
FIG. 20 shows a front view of another specific embodiment of a bottle.
Figure 26:
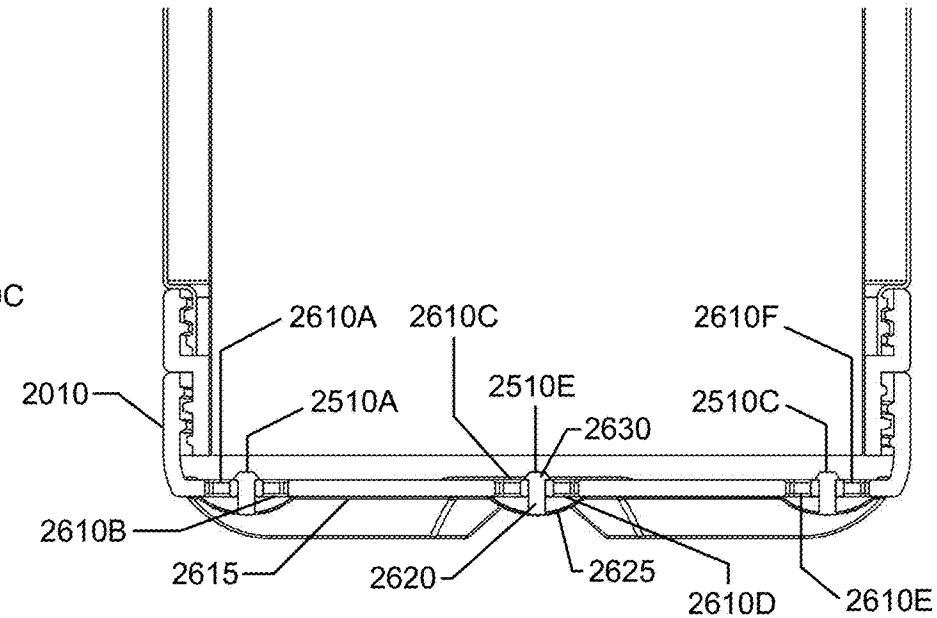
FIG. 26 shows an enlarged section view of a bottom portion of the bottle.
Figure 25:
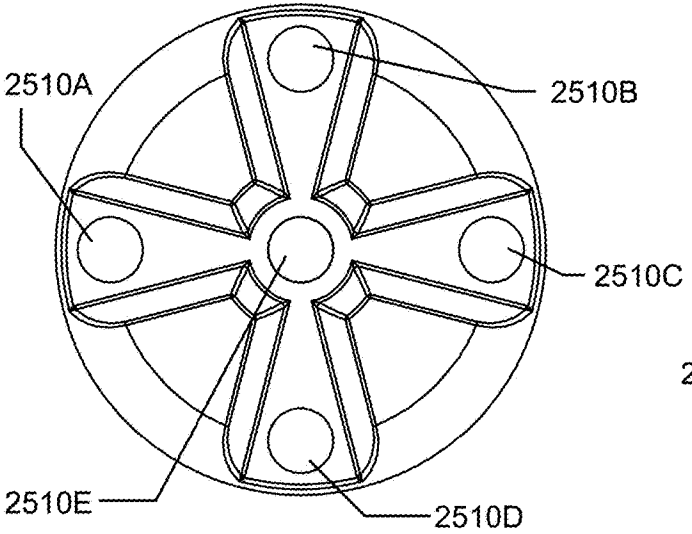
FIG. 25 shows a bottom view of the bottle.

FIG. 20 shows a front view of another specific embodiment of a bottle 2005 having self-adjusting drink and storage compartments. FIG. 21 shows a section view of the bottle taken along a section line A-A as indicated in FIG. 20. FIG. 22 shows an exploded front view of the bottle. FIG. 23 shows a section view of the bottle taken along a section line B-B as indicated in FIG. 22. FIG. 24 shows an exploded trimetric view of the bottle. FIG. 25 shows a bottom view of the bottle. FIG. 26 shows an enlarged section view of a bottom portion of the bottle.

The bottle shown in FIGS. 20-24 is similar to the bottle shown in FIGS. 10-15. The bottle shown in FIGS. 20-24, however, includes a bottom cap 2010 having a set of valves. For example, FIG. 25 shows bottom cap 2010 and valves 2510A-E. In this specific embodiment, valve 2510 is located at a center of the bottom cap and the remaining valves are located towards a perimeter or circumference of the bottom cap. The valves are oriented to allow air inside the bag to pass through the valves but to block air from outside the bag from coming into the bag.

More particularly, FIG. 26 shows bottom cap 2010, valves 2510A, E, and C, and holes 2610A-F. The valves and holes are located on a bottom surface 2615 of the bottom cap. Each valve includes a tail that is connected to a sealing disk or flap.

For example, valve 2510E includes a tail 2620 having one end connected to a sealing disk 2625 and an opposite end connected to a barb 2630. The valve may be attached to the bottom cap by passing the barb and tail through a tail opening in the bottom cap, i.e., by passing the barb from an outside surface of the bottom cap to an inside surface of the bottom cap. The barb helps to prevent the valve from falling out. The sealing disk of the valve is seated over one or more holes in the bottom cap. For example, the sealing disk of valve 2510E is seated over holes 2610C and 2610D.

Figure 28A:
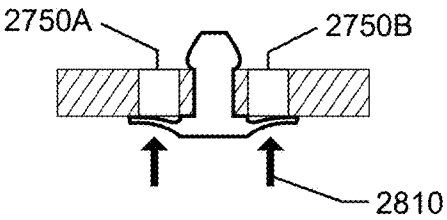
FIG. 28A shows the valve in a closed state.
Figure 27:
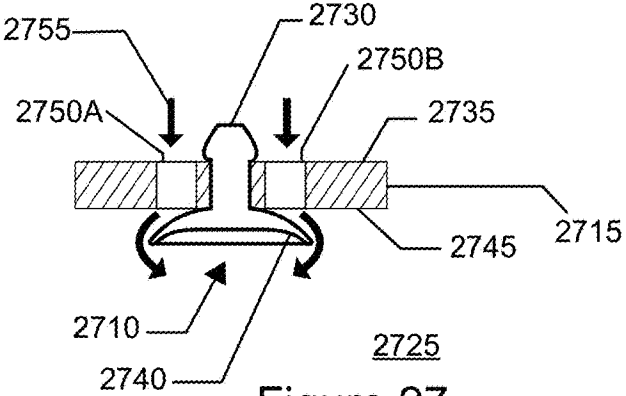
FIG. 27 shows a valve of a bottom cap in an open state.

FIGS. 27 and 28A show enlarged cross sections of a valve 2710 that may be installed in a bottom cap 2715. FIG. 27 shows the valve in an open state. The valve is between an inside environment 2720 of the bag and an outside environment 2725 of the bag. A barb 2730 of the valve is on an inside 2735 of the bottom cap. The inside faces the inside environment of the bag. In other words, the barb points towards the inside or inside environment of the bag.

A sealing disk or flap 2740 of the valve is on an outside 2745 of the bottom cap, opposite the inside. The sealing flap is seated over holes 2750A and 2750B of the bottom cap. The holes pass through the bottom cap, i.e., the holes pass from the inside of the bottom cap to the outside of the bottom cap.

As shown in FIG. 27, when the valve is in the open state the sealing flap is lifted away from its seat and air from inside the bag environment can pass 2755 through holes 2750A and 2750B and around the lifted sealing flap.

FIG. 28A shows the valve from FIG. 27 in a closed state. When the valve is in the closed state the sealing flap flattens out against the valve seat (e.g., against a portion of the outside surface of the bottom cap) and over holes 2750A and 2750B of the bottom cap. Outside air 2810 is blocked by the sealing flap from flowing into the inside bag environment.

In a specific embodiment, the valves include umbrella valves. Umbrella valves are elastomeric valve components that have a sealing flap or disk shaped like a diaphragm umbrella. These elastomeric components are used as sealing elements to prevent backflow into the inside environment of the bag. When mounted in a seat, the umbrella portion or convex diaphragm portion of the valve flattens out against the valve seat and absorbs a certain amount of seat irregularities and creates a certain sealing force.

The umbrella valve allows forward flow once the head pressure creates enough force to lift the convex diaphragm from the seat. It can allow flow at a predetermined pressure in one way and prevent back flow immediately in the opposite way. An umbrella valve can be designed to have a very low opening pressure. The low opening pressure allows air trapped inside the bag to quickly and easily escape and thus facilitates a rapid collapsing of the bag.

An umbrella valve functions based on its elastic material properties and its preloaded convex shape to create the sealing force against the seat and uses the central tail to hold the component in place. This helps to reduce or avoid the need for additional components such as a spring. This simplifies the design of the assembly and makes the valve adaptable to small spaces, reduces the number of pieces in a valve, simplifies assembly, and is very cost effective. Other benefits of an umbrella valve include an immediate positive seal, position independency, variable opening pressure trough seat thickness, high flow rate versus package size, corrosion resistance, and wear resistance.

Figure 28C:
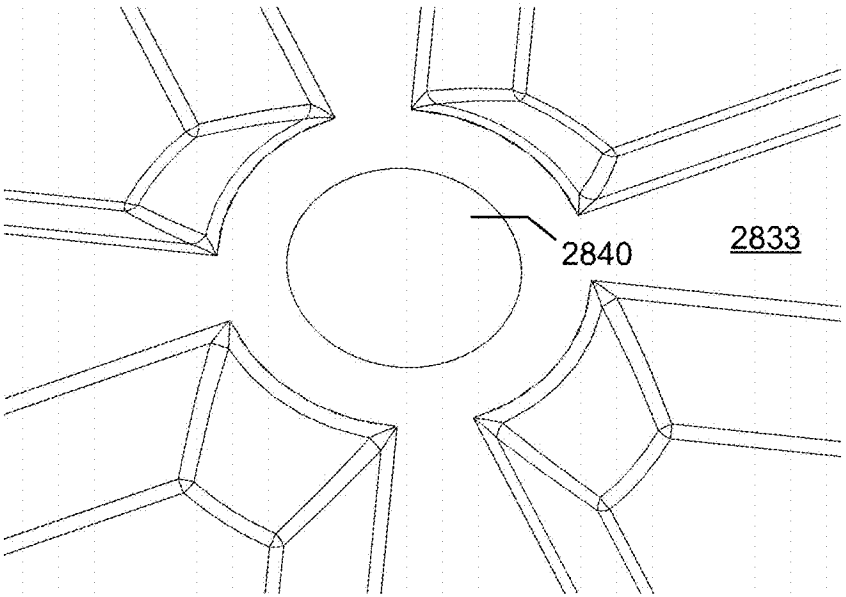
FIG. 28C shows an outside view of the bottom cap.
Figure 28B:
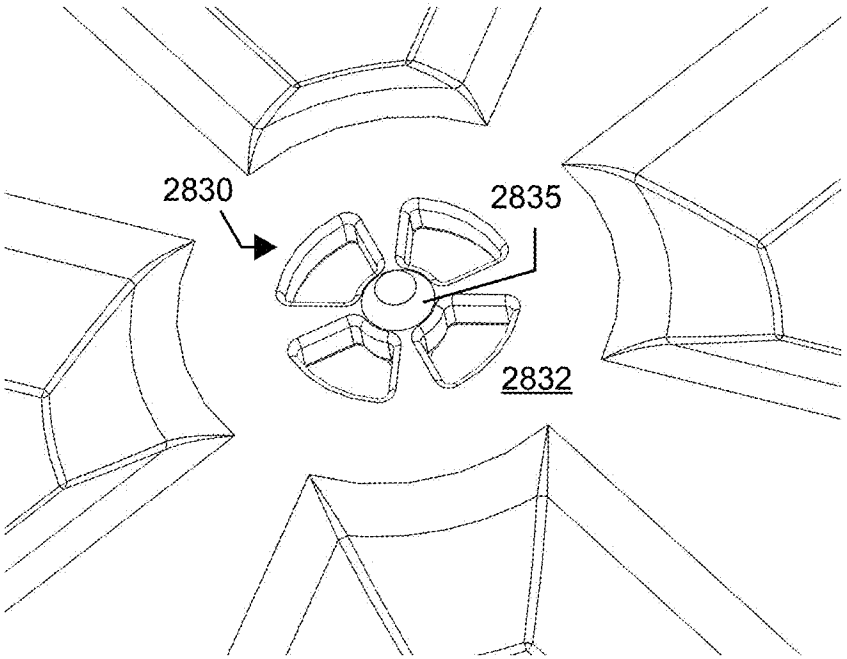
FIG. 28B shows an inside view of the bottom cap.

FIG. 28B shows an inside view of a region of the bottom cap according to a specific embodiment. As shown in the example of FIG. 28B, the bottom cap includes a set of holes 2830. The holes extend from an inside surface 2832 of the bottom cap to an outside surface 2833 (FIG. 28C) of the bottom cap, opposite the inside surface. There is a barb 2835 of an umbrella valve located on the inside surface of the bottom cap. The barb is connected to an end of a tail of the umbrella valve. The tail extends through a hole in the bottom cap. An opposite end of the tail is connected to a sealing disk 2840 (FIG. 28C).

FIG. 28C shows an outside view of the bottom cap shown in FIG. 28B. In this example, the valve is in a closed state. Sealing disk 2840 is flattened out against outside surface 2833 and covers valve openings 2830 (FIG. 28B). The valve may be attached to the bottom cap by providing a hole that extends through the bottom cap. A diameter of hole is slightly less than a diameter of the valve barb. The valve barb can be squeezed or compressed and then pushed through the hole from the outside surface of the bottom cap towards the inside surface of the bottom cap. The valve barb returns to its uncompressed state in which its diameter is greater than the diameter of the hole. This prevents the valve from falling out. Thus, the valve is oriented so that the valve barb is on the inside surface of the bottom cap and the valve sealing disk is on the outside surface of the bottom cap.

Figure 29:
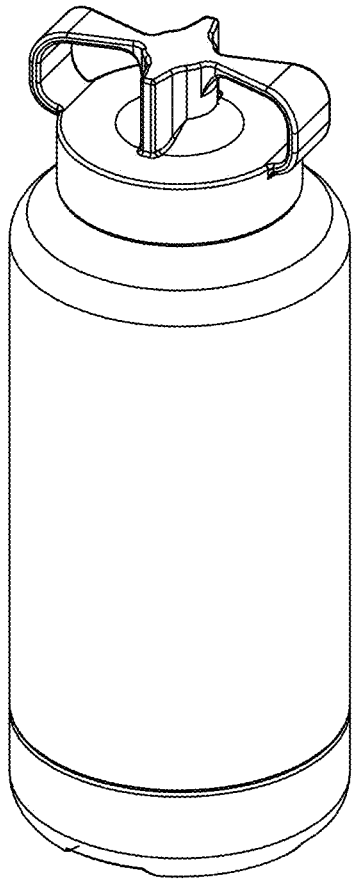
FIG. 29 shows a trimetric view of another specific embodiment of a bottle.
Figure 30:
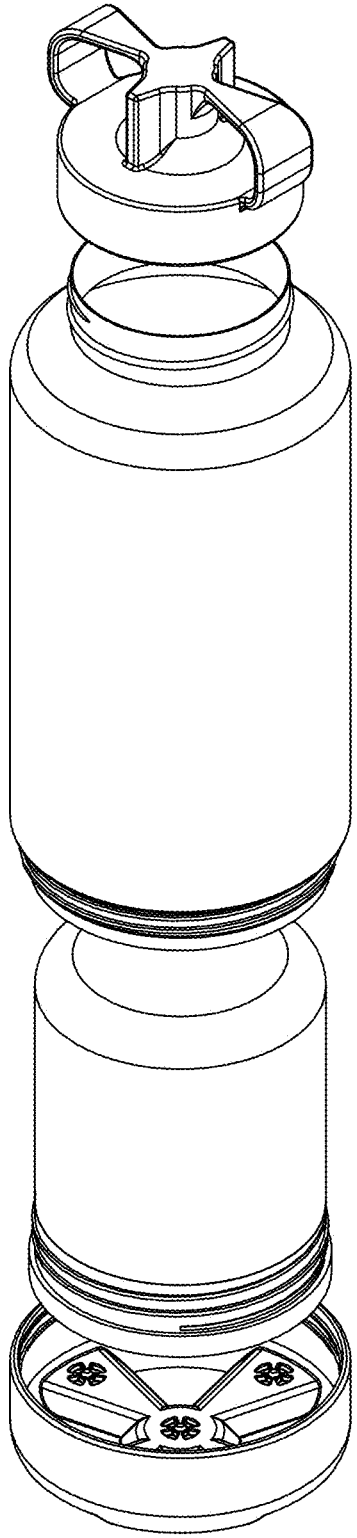
FIG. 30 shows an exploded trimetric view of the bottle.
Figure 31:
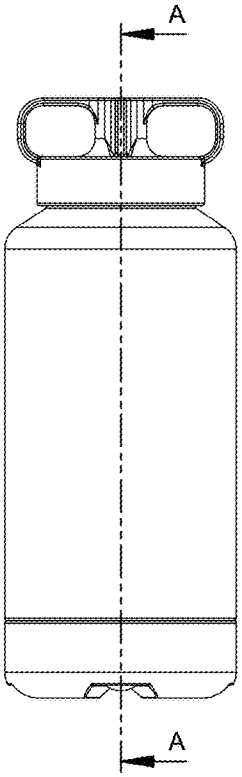
FIG. 31 shows a front view of the bottle.
Figure 32:
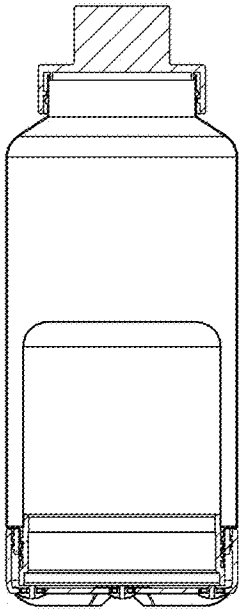
FIG. 32 shows a section view of the bottle.
Figure 33:
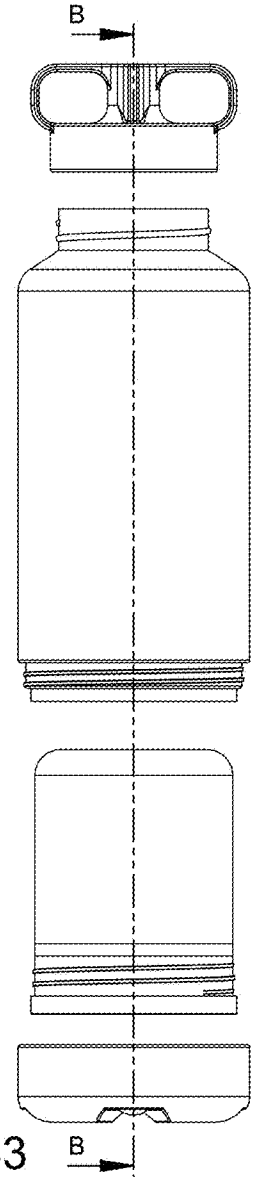
FIG. 33 shows an exploded front view of the bottle.
Figure 34:
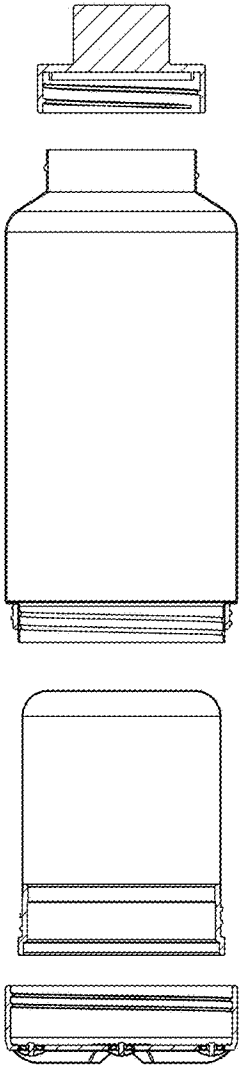
FIG. 34 shows an exploded section view of the bottle.
Figure 35B:
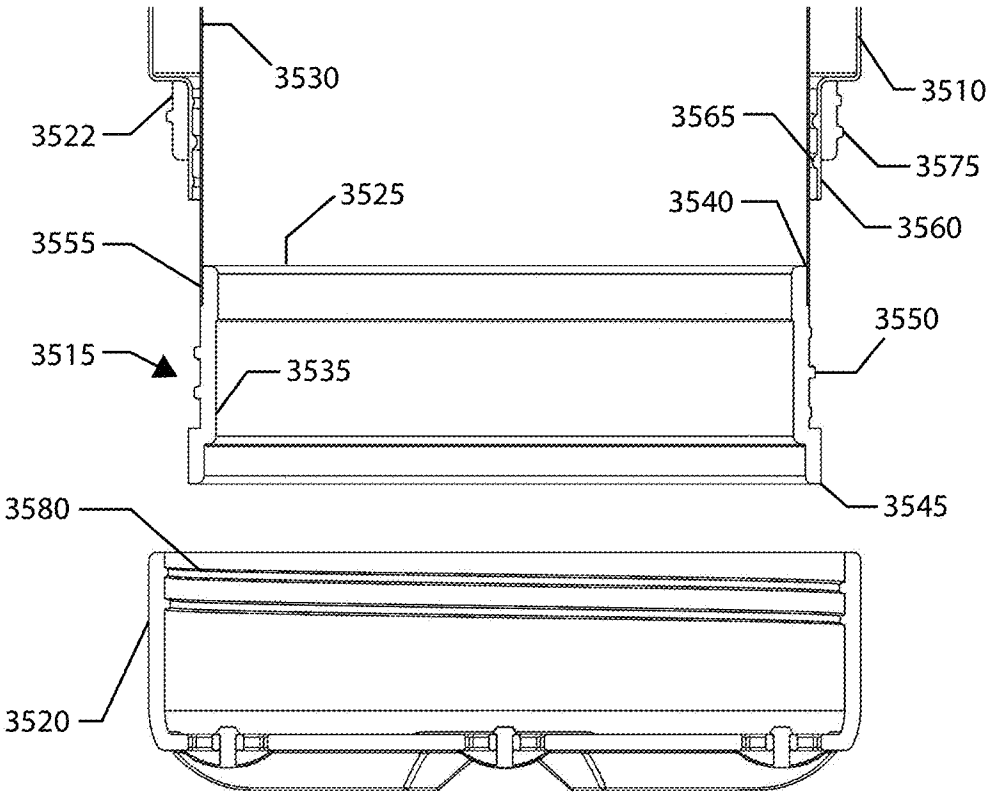
FIG. 35B shows an enlarged separated section view of the bottom portion of the bottle.
Figure 35A:
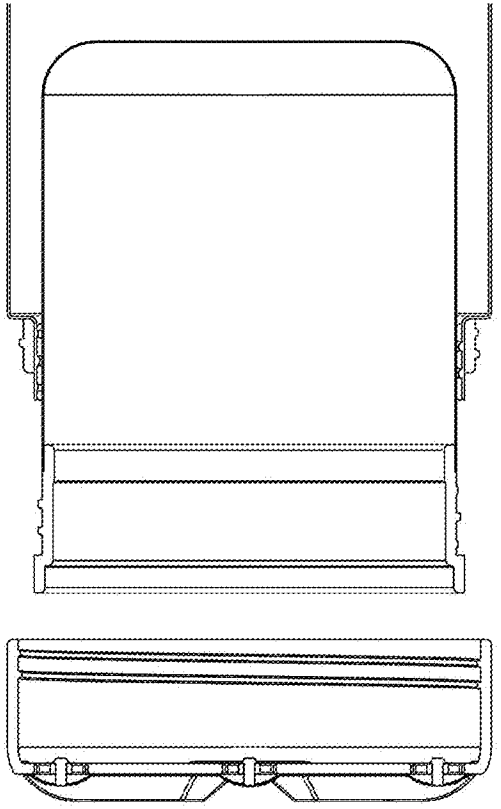
FIG. 35A shows a separated section view of a bottom portion of the bottle.
Figure 35D:
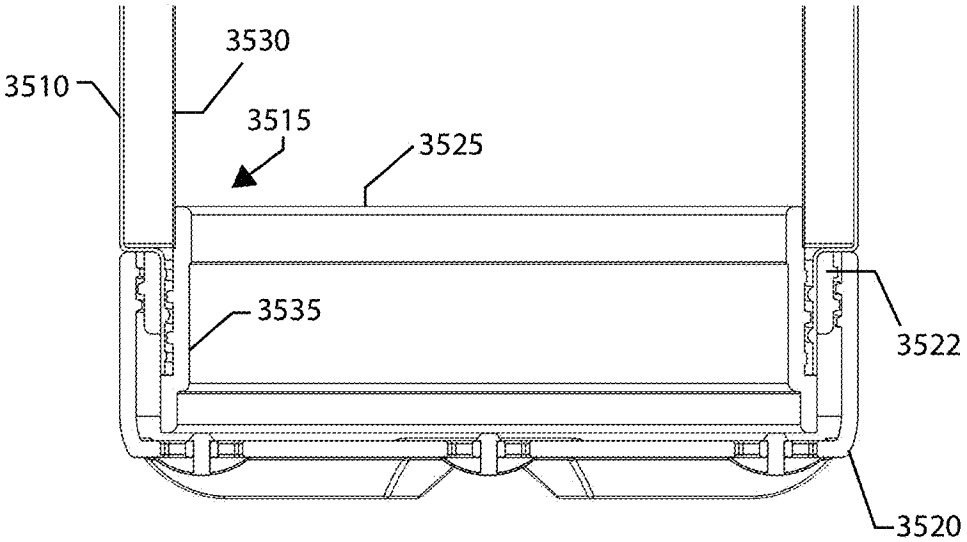
FIG. 35D shows a section view of the bottom portion of the bottle as assembled.
Figure 35C:
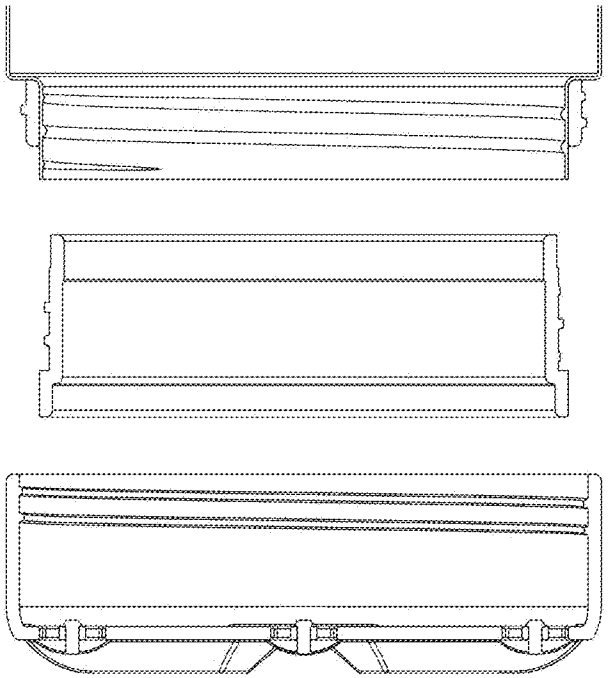
FIG. 35C shows another separated section view of the bottom portion of the bottle.

FIG. 29 shows a trimetric view of another specific embodiment of a bottle 2905 having self-adjusting drink and storage compartments. FIG. 30 shows an exploded trimetric view of the bottle shown in FIG. 29. FIG. 31 shows a front view of the bottle. FIG. 32 shows a section view of the bottle taken along a section line A-A as indicated in FIG. 31. FIG. 33 shows an exploded front view of the bottle. FIG. 34 shows an exploded section view of the bottle taken along a section line B-B as indicated in FIG. 33. FIG. 35A shows a separated section view of a bottom portion of the bottle. FIG. 35B shows an enlarged separated section view of the bottom portion of the bottle. FIG. 35C shows a separated section view of the bottom portion of the bottle without the bag. FIG. 35D shows a section view of the bottom portion of the bottle in an assembled state.

The bottle shown in FIGS. 29-34 is similar to the bottle shown in FIGS. 20-24. The bottle shown in FIGS. 29-34, however, includes a bottom cap that connects to a bottom neck of a bottle rather than a bag assembly. For example, FIG. 35B shows an enlarged section view of a bottom portion of the bottle shown in FIGS. 29-34. As shown in FIG. 35B, there is a bottle body 3510, a bag assembly 3515, a bottom cap 3520, and a ring or collar 3522.

The bag assembly includes a connector 3525 and a bag 3530. The connector includes a stem or insert 3535. The stem includes an upper perimeter 3540, a lower perimeter 3545, and a male threaded section 3550 between the upper and lower perimeters. The bag includes a rim 3555. An inside surface of the bag rim is connected to an outside surface of the upper perimeter of the connector stem. The bag assembly can be removed (and reinserted) by grasping opposite sides of lower perimeter 3545 and turning the bag assembly relative to the bottle body.

The bottle body includes a bottom neck 3560. The bottom neck includes female threads 3565. The female threads of the bottom neck engage the male threaded section of the connector stem.

The ring includes male threads 3575. The ring encircles or is connected around the bottom neck of the bottle. In a specific embodiment, the ring is manufactured as a piece that is separate from the bottle body. In this specific embodiment, the ring may be assembled to the bottle body by inserting bottle bottom neck through the ring. An adhesive may be used to join the ring to the bottle bottom neck. Instead or additionally, the ring and bottle bottom neck may be joined using a mechanical connection such as via an annular snap joint. For example, there can be a mating lip formed on one of the inside of the ring or the outside of the bottle bottom neck. There can be a corresponding groove formed on another of the inside of the ring or the outside of the bottle bottom neck. The mating lip engages the groove to connect the ring to the bottle bottom neck.

The ring and bottle body may be made from different materials. For example, the ring may be made of plastic and the bottle body may be made from stainless steel. Alternatively, the ring and bottle body may be made from the same material. For example, the ring and bottle body may be made of plastic.

In another specific embodiment, the ring and bottle body are formed as single unit. That is, the ring, and more particularly, the male threads of the ring may be formed or molded on the bottom neck of the bottle body.

The bottom cap includes female threads 3580. The female threads of the bottom cap engage the male threads of the ring. The bottom cap can be rotated relative to or independent of the bag assembly because the bottom cap is not directly connected to the bag assembly. Rather, the bottom cap connects to the bottle bottom neck. The bottom cap can be unscrewed without imparting any rotational force on the bag assembly. Thus, once the bag assembly is fully tightened to seal the bag assembly against the bottle bottom neck, the seal can be maintained independent of the movement of the bottom cap. In this specific embodiment, the connector is not exposed or accessible when the bottom cap is attached. When the bottom cap is removably connected at the bottom neck and over the opening of the bag, the connector is covered as well and a user will not be able to access or grip the connector (see, e.g., FIGS. 31 and 35D).

Figure 36:
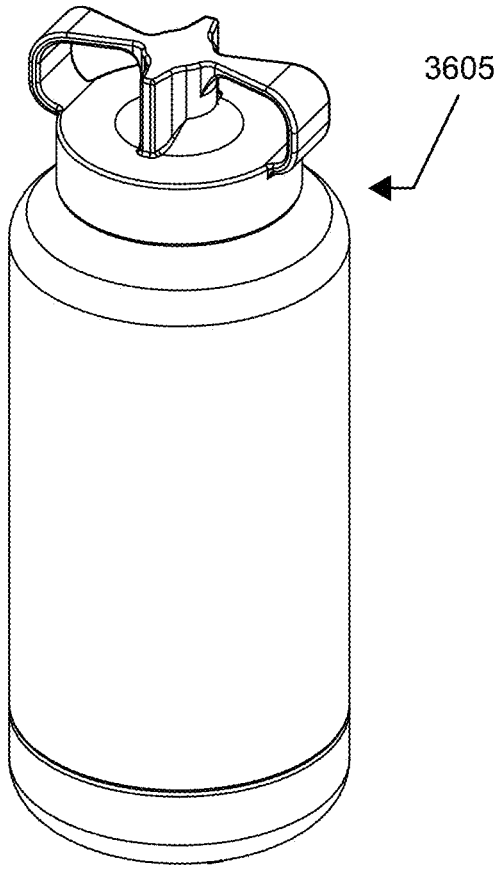
FIG. 36 shows a trimetric view of another specific embodiment of a bottle.
Figure 37:
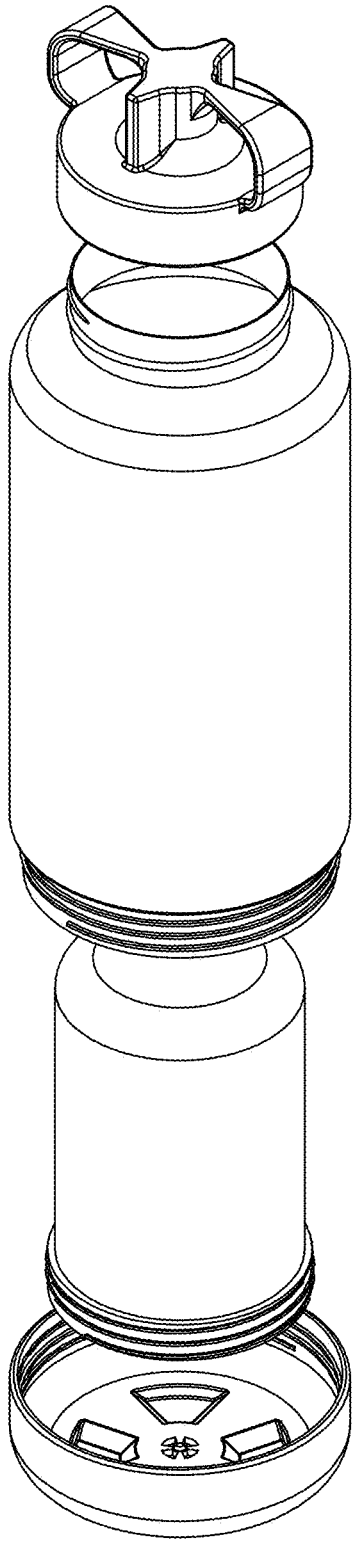
FIG. 37 shows an exploded trimetric view of the bottle.
Figure 41:
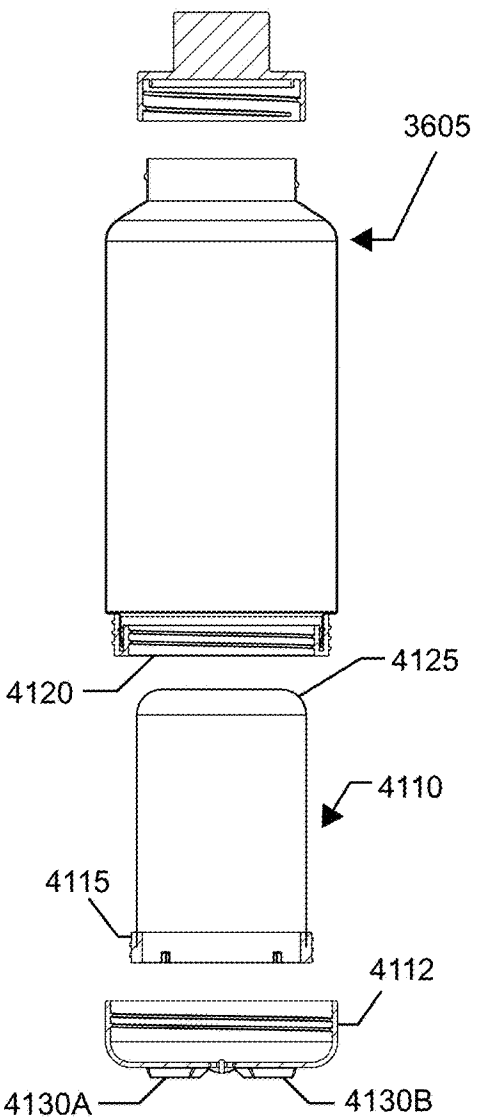
FIG. 41 shows an exploded section view of the bottle.
Figure 40:
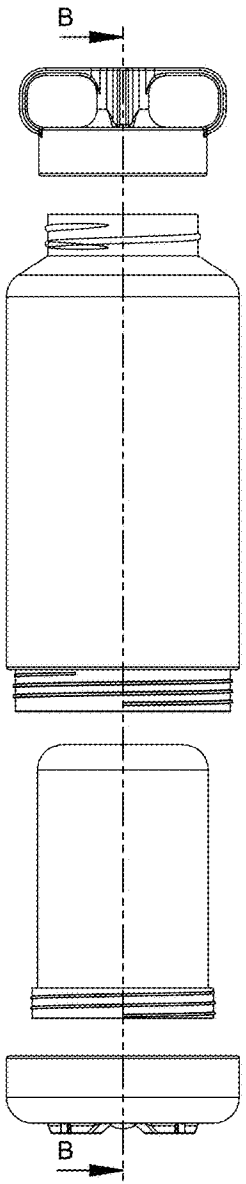
FIG. 40 shows an exploded front view of the bottle.
Figure 39:
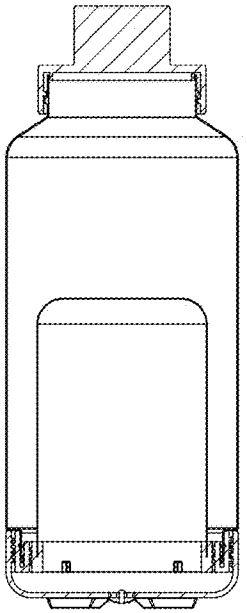
FIG. 39 shows a section view of the bottle.
Figure 38:
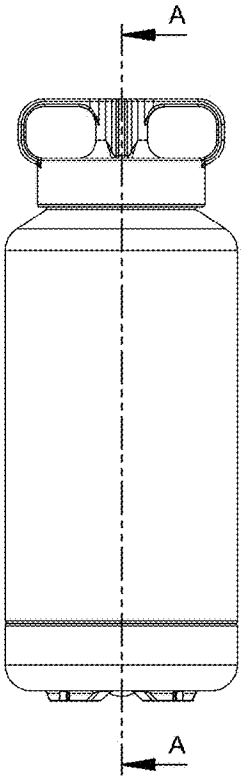
FIG. 38 shows a front view of the bottle.
Figure 43:
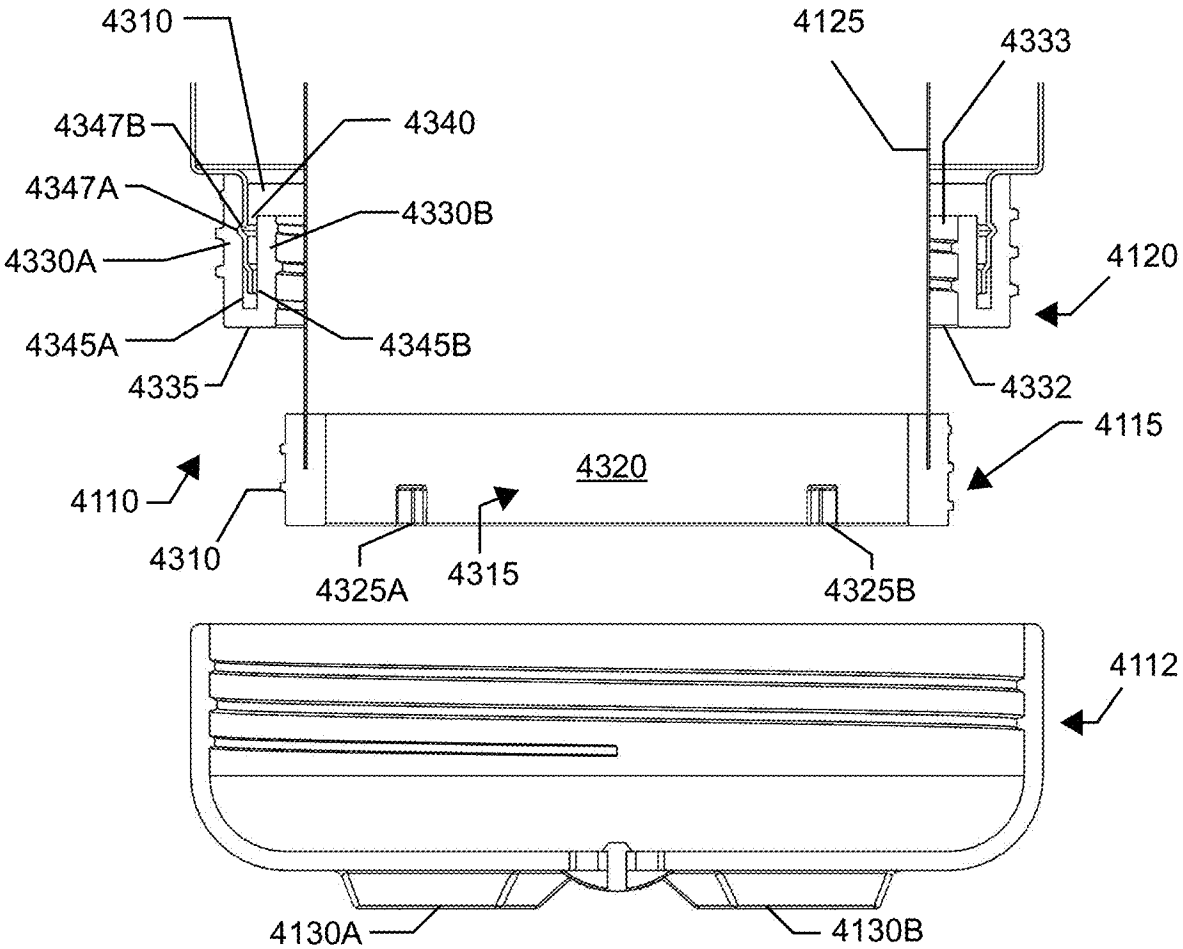
FIG. 43 shows a separated section view of a bottom portion of the bottle.
Figure 42:
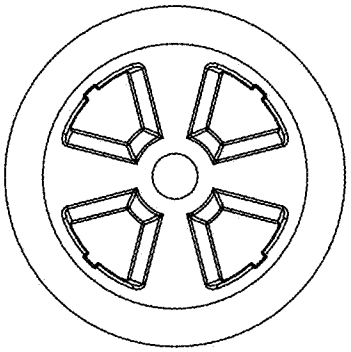
FIG. 42 shows a bottom view of the bottle.
Figure 45:
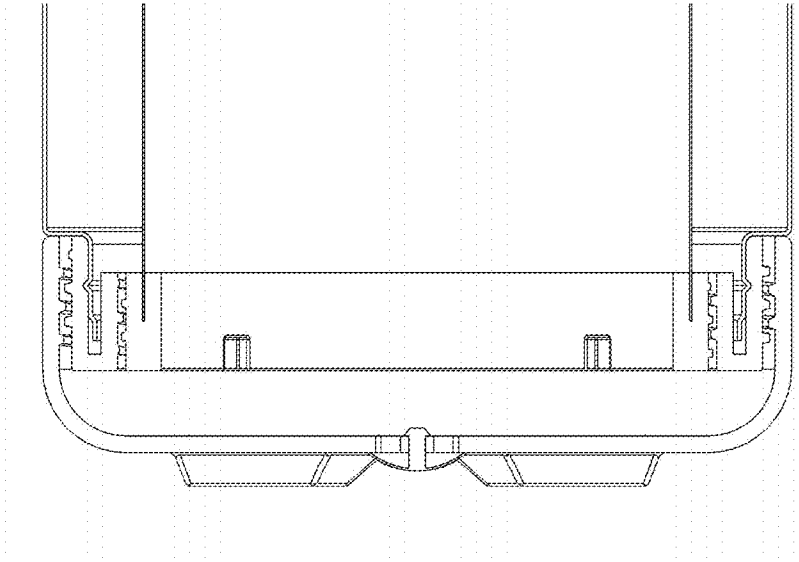
FIG. 45 shows a section view of a bottom portion of the bottle as assembled.
Figure 44:
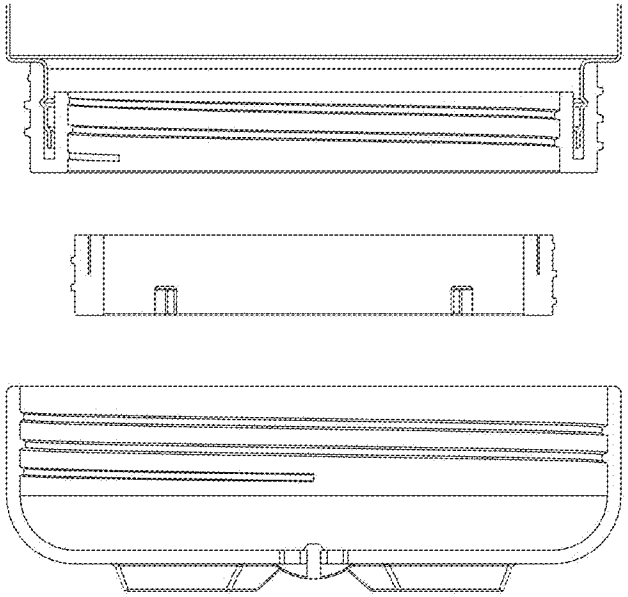
FIG. 44 shows another separated section view of a bottom portion of the bottle.

FIG. 36 shows a trimetric view of another specific embodiment of a bottle 3605 having self-adjusting drink and storage compartments. In this specific embodiment, the bottle incorporates a built-in tool for removing and re-inserting the bag assembly. FIG. 37 shows an exploded trimetric view of the bottle shown in FIG. 36. FIG. 38 shows a front view of the bottle. FIG. 39 shows a section view of the bottle taken along a section line A-A as indicated in FIG. 38. FIG. 40 shows an exploded front view of the bottle. FIG. 41 shows an exploded section view of the bottle taken along a section line B-B as indicated in FIG. 40. FIG. 42 shows a bottom view of the bottle. FIG. 43 shows a separated section view of a bottom portion of the bottle. FIG. 44 shows a separated section view of a bottom portion of the bottle without the bag. FIG. 45 shows a section view of a bottom portion of the bottle in an assembled state.

Referring now to FIG. 41, bottle 3605 includes a bag assembly 4110 and a bottom cap 4112. The bag assembly includes a first connector 4115, a second connector 4120, and a bag 4125 connected to the first connector. The bottom cap includes a set of feet 4130 extending from a bottom surface of the bottom cap.

FIG. 43 shows a detailed section view of a bottom portion of the bottle where bag 4125 is partially inserted through a bottom neck 4310 of the bottle. FIG. 44 shows a view without the bag. Referring now to FIG. 43, there is bag assembly 4110, bag 4125, first connector 4115, and second connector 4120. There is bottom cap 4112 which includes a set of feet including feet 4130A, B.

The first connector is shaped like a ring. The first connector includes male threads 4310 and a first central bore 4315. The bag is sandwiched between an outside surface of the first connector having the male threads and an inside surface 4320 of the first connector, opposite the outside surface. Inside surface 4320 defines the first central bore. The inside surface includes a set of notches such as notches 4325A, B.

The second connector includes an outer ring 4330A and an inner ring 4330B. The inner ring includes a second central bore 4332 that is defined by an inside surface 4333. The inner and outer rings are connected at their bottom edges 4335. Top edges, opposite the bottom edges, of the rings are unconnected to each other such that an annular gap, slot, or opening 4340 is formed between an inside surface 4345A of the outer ring and an outside surface 4345B of the inner ring. The inside surface of the outer ring includes a groove 4347A. An outside surface of the bottle bottom neck includes a corresponding protrusion 4347B.

The second connector may be joined to the bottle bottom neck by positioning the annular gap formed by the inner and outer rings in-line with the perimeter of the bottom neck. The connector can be pushed or snapped onto the bottom neck such that protrusion 4347B catches groove 4347A. The second connector may be configured to be permanently or removably attached to the bottle bottom neck.

The inner ring of the second connector include female threads which engage the male threads of the first connector. The female threads of the bottom cap engage the male threads formed on the outer ring of the second connector.

The notches on the first connector and the feet on the bottom cap form a keying mechanism. More particularly, FIGS. 46-52 show various views of a sequence for removing a bag assembly of the bottle shown in FIG. 36 by using the bottom cap as a tool. In brief, a sequence of operation is:

1. A user unscrews the bottom cap from the bottle.

2. The user flips the bottom cap and aligns the bottom cap feet with the notches.

3. The user inserts the bottom cap feet into the first central bore of the first connector so that the bottom cap feet are received by the notches in the first connector.

4. The user rotates the bottom cap relative to the bottle body to unscrew the first connector from the second connector.

Figure 46:
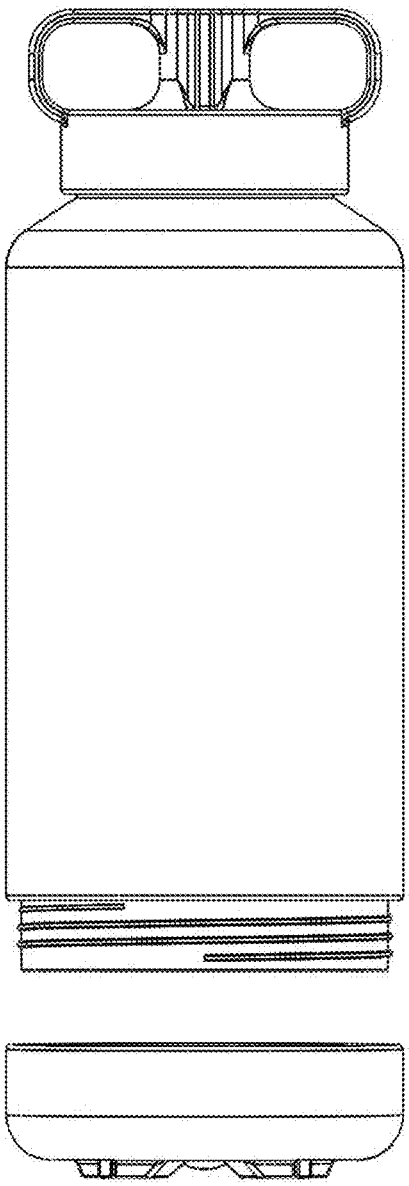
FIG. 46 shows a front view of the bottle with the bottom cap removed.
Figure 47:
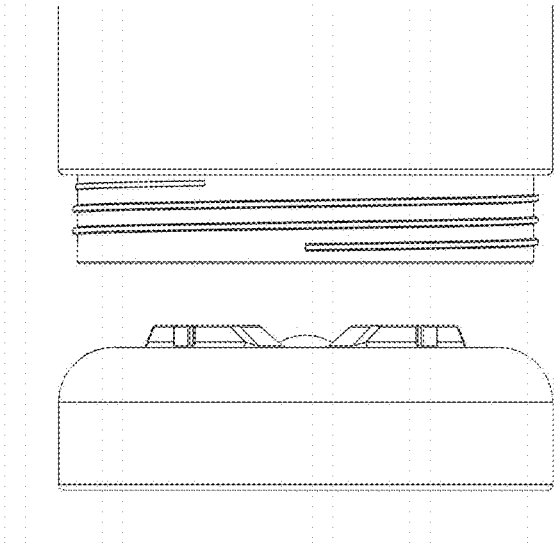
FIG. 47 shows an enlarged front view of the bottle with the bottom cap flipped.
Figure 48:
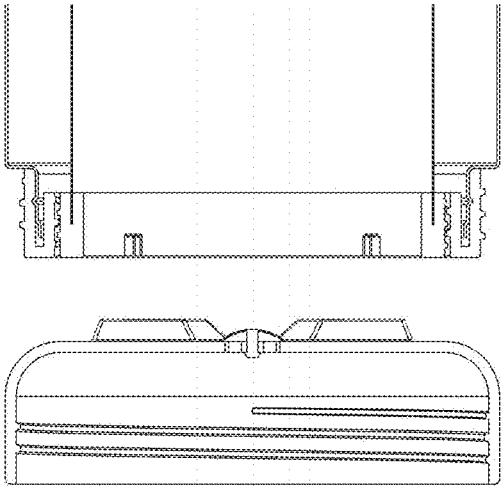
FIG. 48 shows a section view of the bottom cap flipped.
Figure 50:
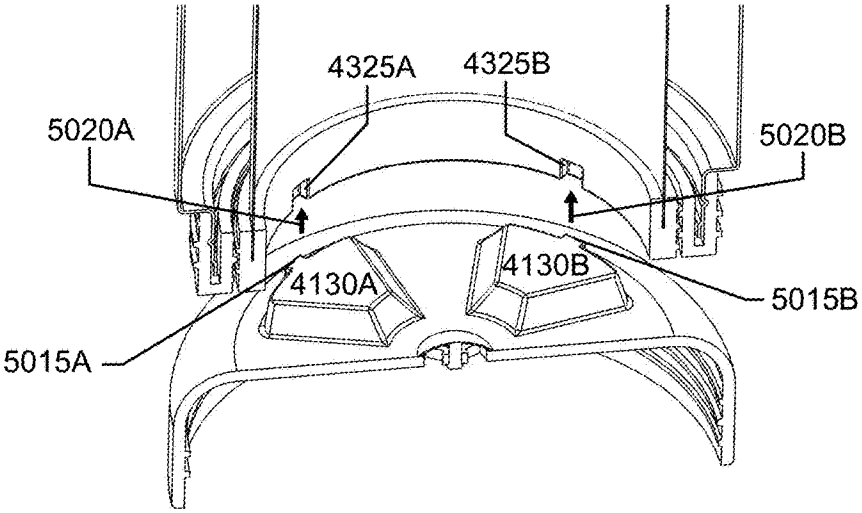
FIG. 50 shows another section view of the bottom cap removed and flipped.
Figure 49:
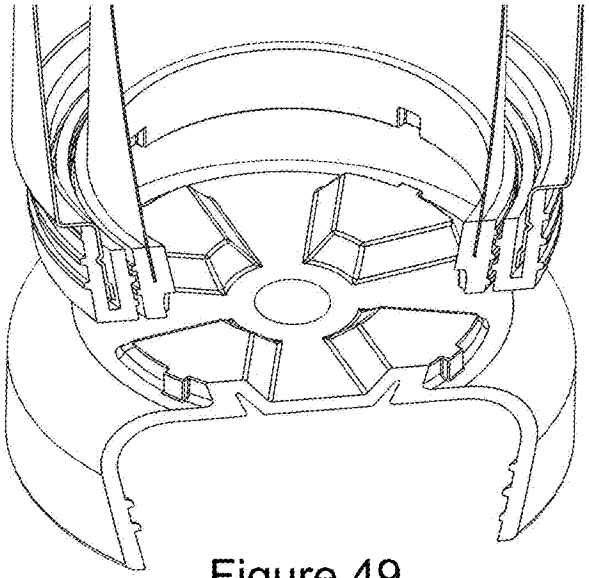
FIG. 49 shows a diagonal section view of the bottom cap removed and flipped.

Specifically, FIG. 46 shows a front view of the bottle with the bottom cap removed (step 1). FIG. 47 shows an enlarged front view of the bottle with the bottom cap removed and flipped (step 2). FIG. 48 shows a section view of the bottom cap removed and flipped (step 2). FIG. 49 shows a diagonal section view of the bottom cap removed and flipped (step 2). FIG. 50 shows another section view of the bottom cap removed and flipped (step 2).

As shown in FIG. 50, bottom cap feet 4130A, B include keying nubs 5015A, B, respectively. The keying nubs are formed on or extend from a side surface on an outer perimeter or circumference of the feet. The keying nubs fit into the notches. In particular, keying nub 5015A fits 5020A into corresponding notch 4325A. Keying nub 5015B fits 5020B into corresponding notch 4325B.

Figure 52:
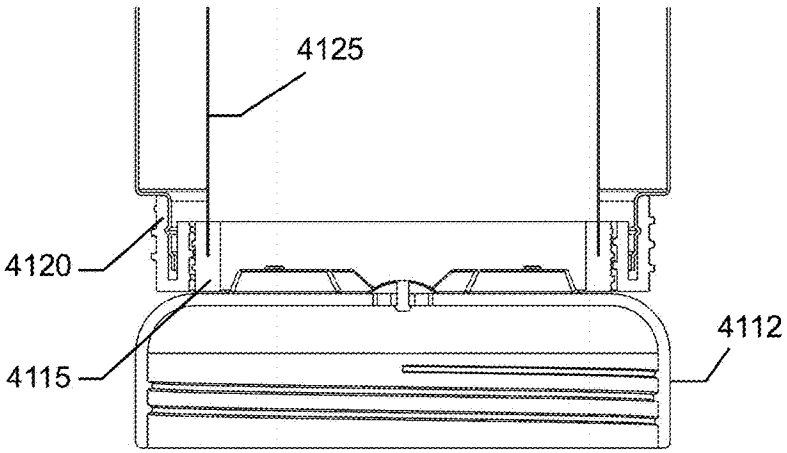
FIG. 52 shows a section view of the bottle with the bottom cap flipped and mated to a bag assembly of the bottle.
Figure 51:
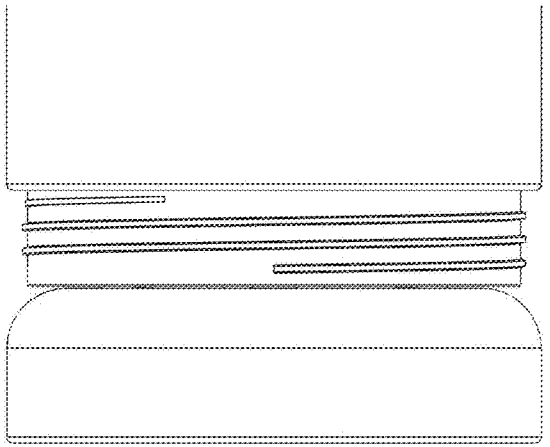
FIG. 51 shows an enlarged front view of the bottle with the bottom cap flipped and mated to a bag assembly of the bottle.

FIG. 51 shows an enlarged front view of the bottle with the bottom cap flipped and mated to a bag assembly of the bottle. FIG. 52 shows a section view of the bottle with the bottom cap flipped and mated to a bag assembly of the bottle. Once the user mates the keying nubs of the bottom cap feet to the corresponding notches of first connector 4115, the user rotates bottom cap 4112 to unscrew the first connector (including bag 4125) from second connector 4120 which remains attached to the bottle bottom neck. Insertion of the bag assembly into the bottle body is the reverse sequence to removal.

Generally, it is desirable for the second connector to not rotate with the first connector. In a specific embodiment, the second connector is designed so that the friction between the second connector and the bottle bottom neck is sufficient to prevent the second connector from rotating with the first connector. Instead or additionally, an adhesive (e.g., epoxy) may be used to secure the second connector to the bottle bottom neck. In another specific embodiment, a protrusion on the bottle bottom neck (and corresponding groove on the outer ring of the second connector) may be oriented vertically or parallel to the central axis of the bottle. The orientation can help to ensure that the protrusion does not slide or slip within the groove as the first connector is rotated.

Figure 53:
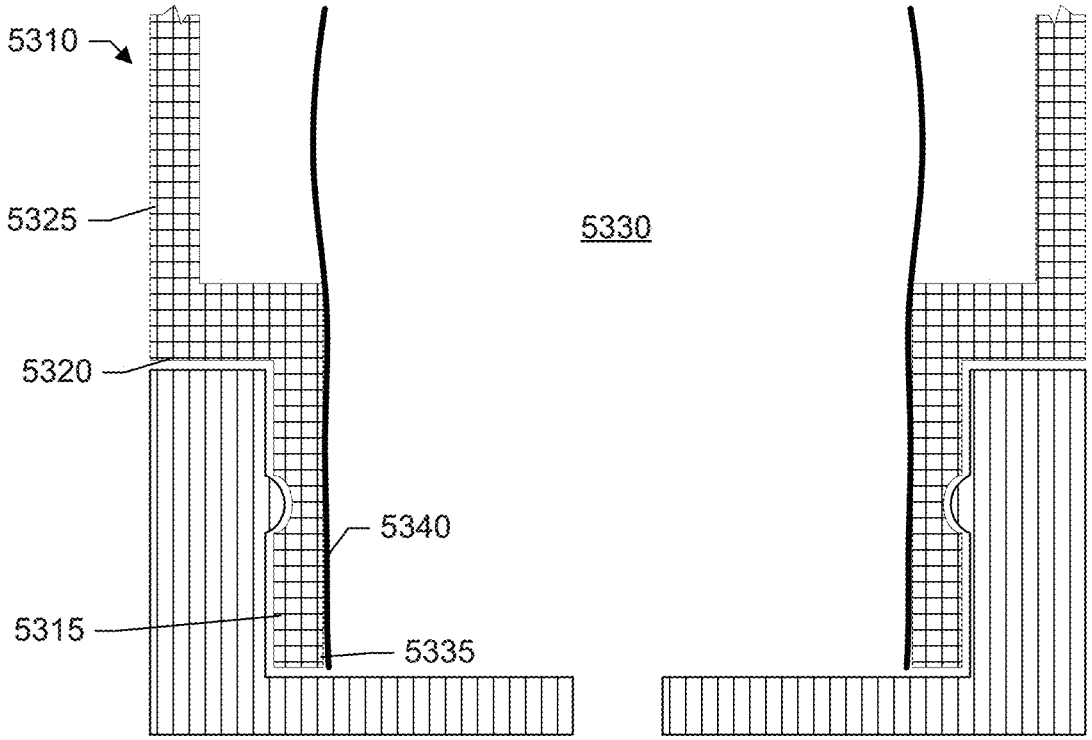
FIG. 53 shows a section view of a bottle according to another specific embodiment.

FIG. 53 shows an enlarged section view of a bottom end 5310 of a bottle according to another specific embodiment. In this specific embodiment, the bottom end includes a bottom neck 5315 and a bottom shoulder 5320. The bottom shoulder is between the bottom neck and a bottle body 5325. A bag 5330 is attached to the bottom neck of the bottle. More specifically, in this specific embodiment, an inside surface 5335 of the bottom neck is joined to an outside surface 5340 of a rim of the bag. Any competent joining technique that creates a permanent airtight seal or bond between the bottom neck and the bag may be used. Having an airtight seal helps to ensure that fluid stored in the drink compartment does not leak out and into the storage compartment.

The joining may include sonic welding, plastic welding, or radio frequency (RF) bonding. Some examples of specific welding techniques that may be used include hot gas welding, freehand welding, speed tip welding, extrusion welding, contact welding, hot plate welding, high frequency welding, injection welding, ultrasonic welding, friction welding, spin welding, laser welding, or solvent welding. The bag may be connected to the bottle using an adhesive (e.g., glue), or epoxy.

To help facilitate bonding, a bonding agent can be used. For example, portions or the entire surface of the inside neck surface, outside bag surface, or both can include a temperature activated adhesive that helps bond the bag and bottle together when heat, pressure, or both is applied. Such an adhesive can be in the form of a coating, powder, or lacquer, such as a heat sealing lacquer. Sufficient heat is applied in order to bring the temperature up to or above the activation temperature of the adhesive. Curing can occur upon cooling. Using such a bonding or adhesive process to make the bottle allows the bottle to be made quickly and cost effectively and can reduce the amount of required labor.

Figure 54:
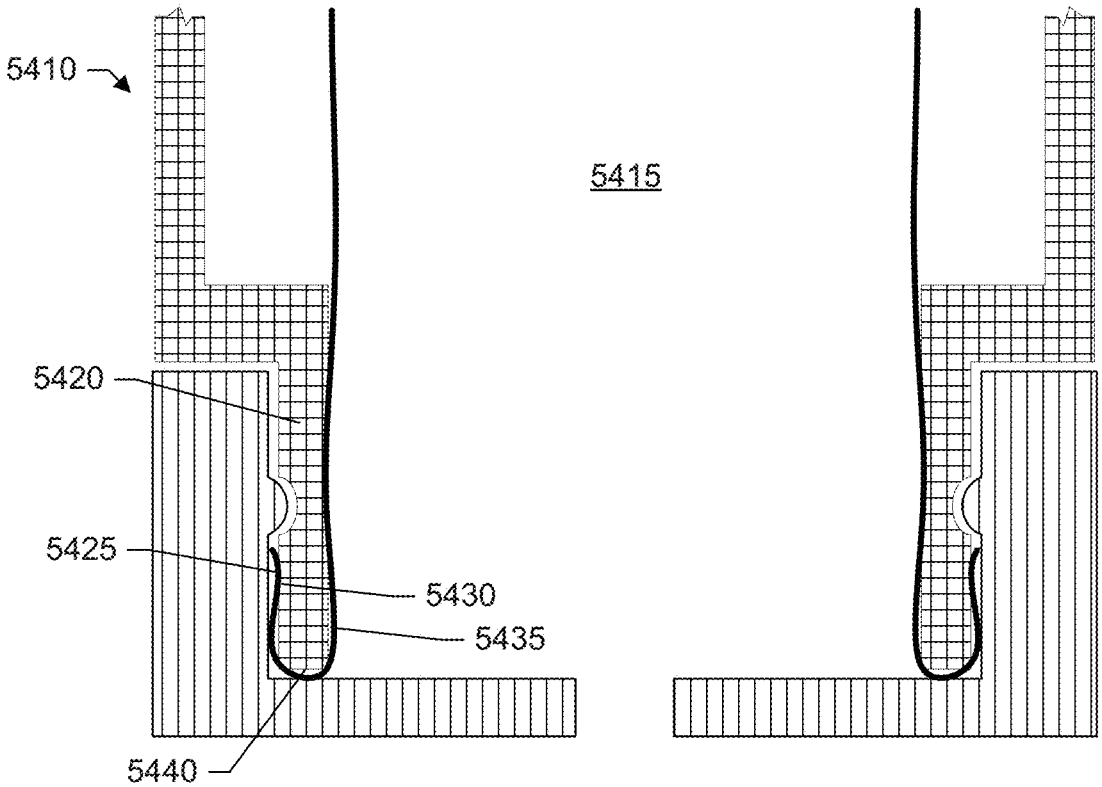
FIG. 54 shows a section view of a bottle according to another specific embodiment.

FIG. 54 shows an enlarged section view of a bottom end 5410 of a bottle according to another specific embodiment. The bottle shown in FIG. 54 is similar to the bottle shown in FIG. 53. For the bottle shown in FIG. 54, however, a portion of a bag 5415 is flipped over a bottom neck 5420. In this specific embodiment, an outside surface 5425 of a rim of the bag may be attached to an outside surface 5430 of the bottom neck, an inside surface 5435 of the bottom neck, an edge 5440 of the neck between the outside and inside surfaces, or combinations of these.

In some cases, the attachment configuration of the bag shown in FIG. 54 can provide a greater surface area for bonding between the bag and bottle as compared to the attachment configuration shown in FIG. 53. The configuration shown in FIG. 53, however, may use less bag material as compared to the configuration shown in FIG. 54. In some cases, the attachment configuration shown in FIG. 53 is desired. In other cases, the attachment configuration shown in FIG. 54 is desired. Factors to consider include the desired strength of the bond between the bag and the bottle, expected tensile pull-off strength between the bag and the bottle, cost of bag material, labor, desired product lifetime, and other factors.

Figure 55:
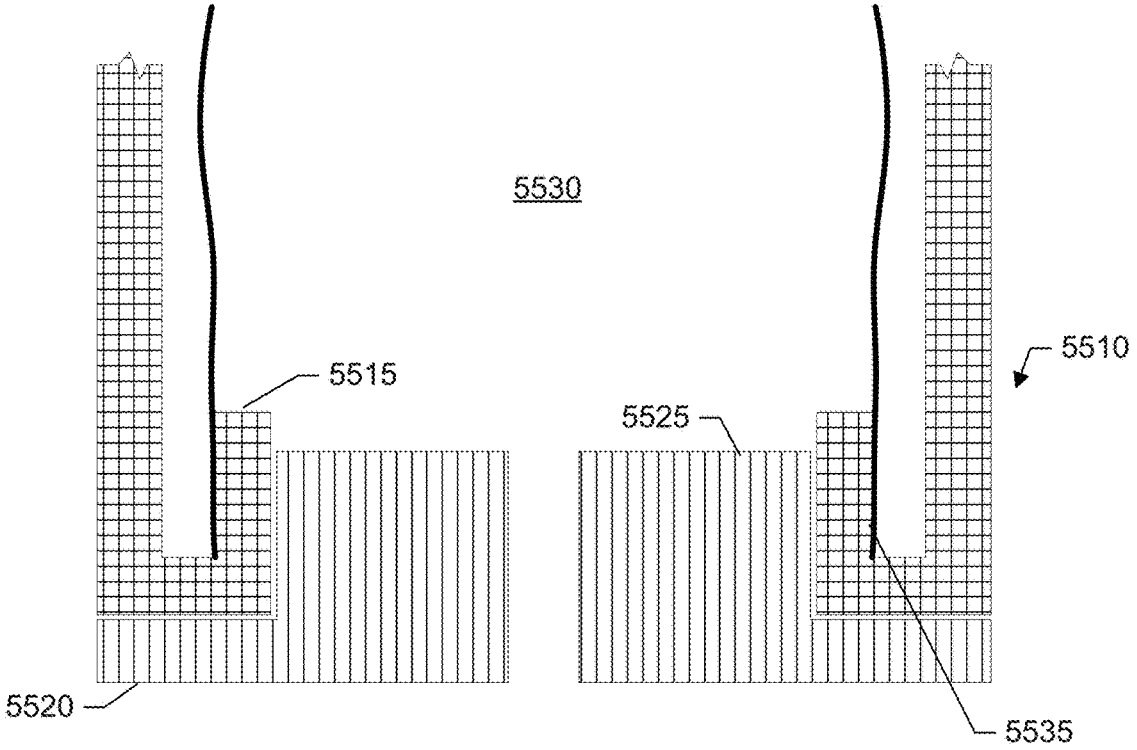
FIG. 55 shows a section view of a bottle according to another specific embodiment.

FIG. 55 shows an enlarged section view of a bottom end 5510 of a bottle in another specific embodiment. The bottle shown in FIG. 55 is similar to the bottle shown in FIG. 53. For the bottle shown in FIG. 55, however, a bottom neck 5515 of the bottle is inverted relative to the bottom neck of the bottle shown in FIG. 53. For example, in FIG. 53, bottom neck 5315 extends away from the top end of the bottle. In FIG. 55, bottom neck 5515 extends towards the top end of the bottle. A bottom cap 5520 includes a plug portion 5525 that extends into the bag opening. A bag 5530 is attached to an outside surface 5535 of the bottom neck.

Figure 56:
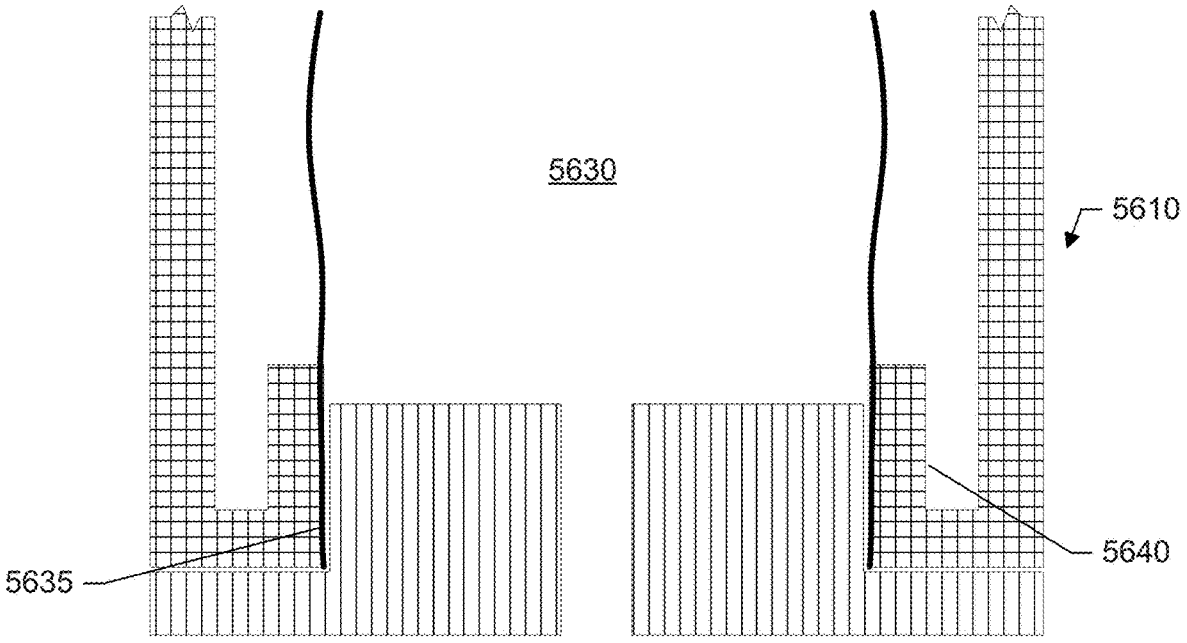
FIG. 56 shows a section view of a bottle according to another specific embodiment.

FIG. 56 shows an enlarged section view of a bottom end 5610 of a bottle in another specific embodiment. The bottle shown in FIG. 56 is similar to the bottle shown in FIG. 55. For the bottle shown in FIG. 56, however, a bag 5630 is attached to an inside surface 5635 of a bottom neck 5640.

Figure 57:
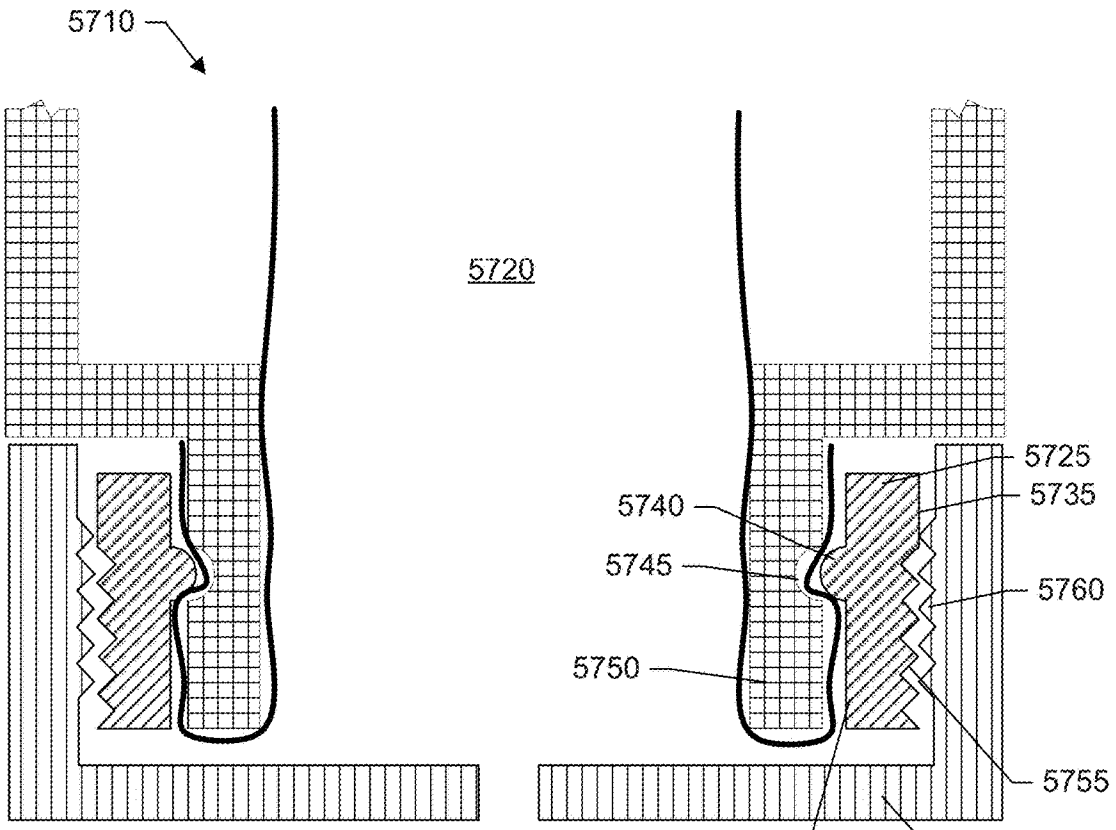
FIG. 57 shows a section view of a bottle according to another specific embodiment.

FIG. 57 shows an enlarged section view of a bottom end 5710 of a bottle in another specific embodiment. In this specific embodiment, a bag 5720 is attached to the bottle using a mechanical arrangement. The mechanical arrangement includes a ring or collar 5725 having an inside surface 5730 and an outside surface 5735, opposite the inside surface. The inside surface includes a ridge 5740 that snaps into a channel 5745 formed on an outer surface of a bottom neck 5750 of the bottle. In another specific embodiment, the ridge and channel may be swapped. That is, the ring may include the channel and the bottom neck may include the ridge. The outside surface of the ring includes threads 5755 that mate with threads 5760 of a bottom cap 5765 of the bottle.

In another specific embodiment, the ring mates with the bottom cap using a channel and groove configuration. For example, the outside surface of the ring may include a nub that engages with a channel on an inside surface of the bottom cap. In another specific embodiment, the nub and channel configuration may be swapped so that the ring includes the channel and the bottom cap includes the nub. Any attachment mechanism or design that allows the bottom cap to be removably connected to the ring may be used.

In the example shown in FIG. 57, the ring is configured to engage an outside surface of the bottom neck so that the bag is sandwiched between an inside surface of the ring and an outside surface of the bottom neck. In another specific embodiment, the ring is configured to engage an inside surface of the bottom neck so that the bag is sandwiched between an outside surface of the ring and an inside surface of the bottom neck. The bag may be attached to the bottle body using a snap ring or circlip (e.g., internal circlip) or other fastener or combination of fasteners.

To assemble the bottle, a closed end of the bag may be inserted through an opening of the bottom neck and a rim of the bag may be flipped over the bottom neck. The ring may then be pushed onto the bottom neck so that the bag is sandwiched between the ring and bottom neck. In a specific embodiment, the ring is designed to be removable so that the user can disassemble the bottle for cleaning. In another specific embodiment, the ring is designed to be permanently attached. A ring designed to be permanently attached can help to reduce manufacturing costs because the ring will not have to be designed to endure repeated removal and reattachment. For example, less material may be used as compared to a ring that must endure repeated removal and reattachment.

A combination of techniques may be used to attach the bag to the bottle. For example, the bag may be attached or fastened to the bottom neck using both sonic welding and mechanical techniques (e.g., ring). Using a combination of techniques can help to ensure that the bag does not inadvertently separate or break off from the bottle.

Figure 58:
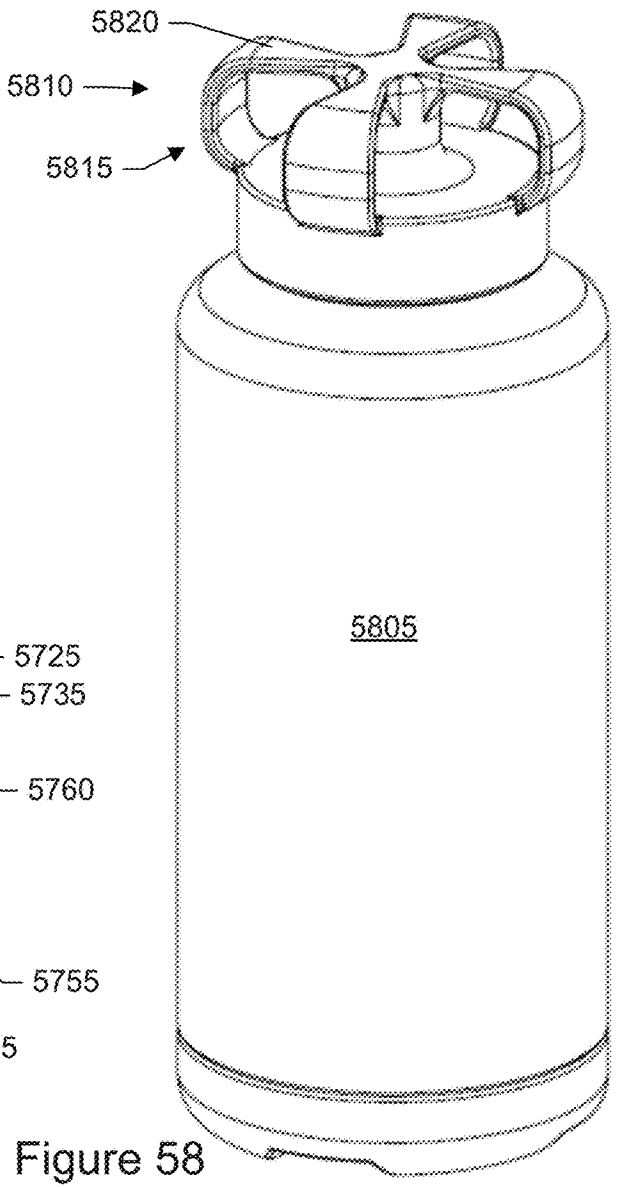
FIG. 58 shows a dimetric view of a bottle according to another specific embodiment.

FIG. 58 shows a dimetric view of a bottle 5805 according to another specific embodiment. A top cap 5810 of the bottle includes a set of spokes or loops 5815 and a top surface 5820. The spokes or loops provide a handle for carrying the bottle. For example, a user may loop their fingers through the spokes in order to carry the bottle. Alternatively, a hook, rope, or carbineer may be placed through a spoke for carrying. In the example shown in FIG. 58, the top cap includes four spokes. It should be appreciated, however, that there can be any number of spokes. Top surface 5820 is flat so that the bottle can remain stable when flipped upside down.

Figure 61:
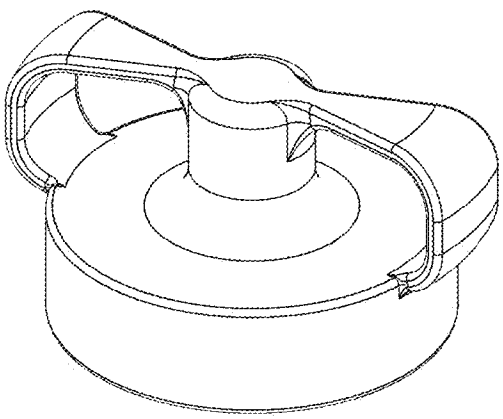
FIG. 61 shows a dimetric view of a top cap having two spokes.
Figure 60:
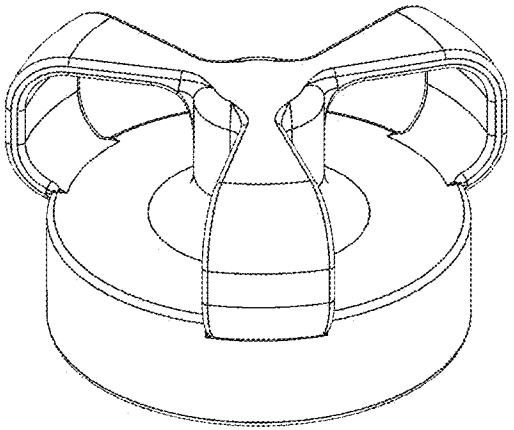
FIG. 60 shows a dimetric view of a top cap having three spokes.
Figure 59:
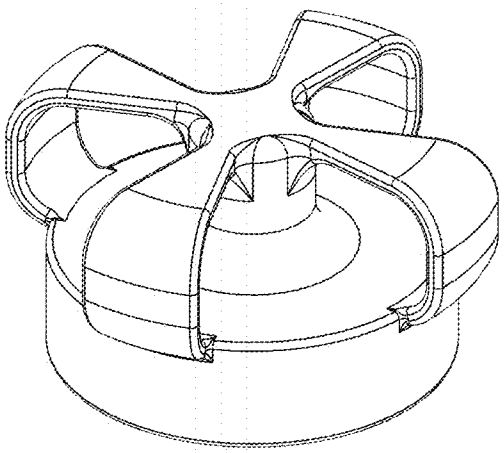
FIG. 59 shows a dimetric view of a top cap having four spokes.
Figure 63:
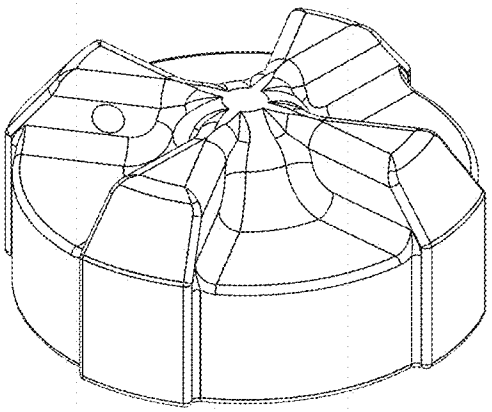
FIG. 63 shows a dimetric view of a top cap having spokes without finger holes.
Figure 62:
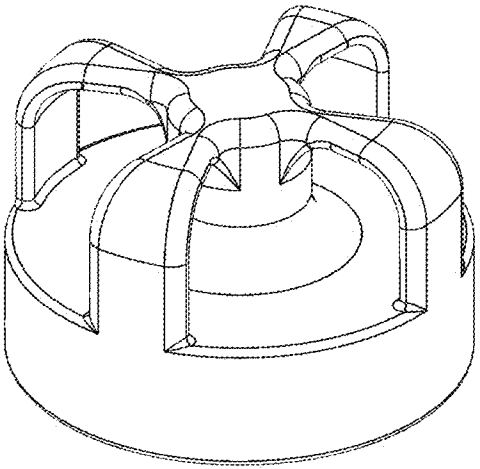
FIG. 62 shows a dimetric view of another top cap having four spokes.

FIG. 59 shows a dimetric view of a top cap having four spokes according to another specific embodiment. FIG. 60 shows a dimetric view of a top cap having three spokes according to another specific embodiment. FIG. 61 shows a dimetric view of a top cap having two spokes according to another specific embodiment. FIG. 62 shows a dimetric view of a top cap having four spokes according to another specific embodiment. FIG. 63 shows a dimetric view of a top cap according to another specific embodiment. In this specific embodiment, the set of spokes do not include finger holes. There is, however, an eyelet hole on a spoke.

Figure 64:
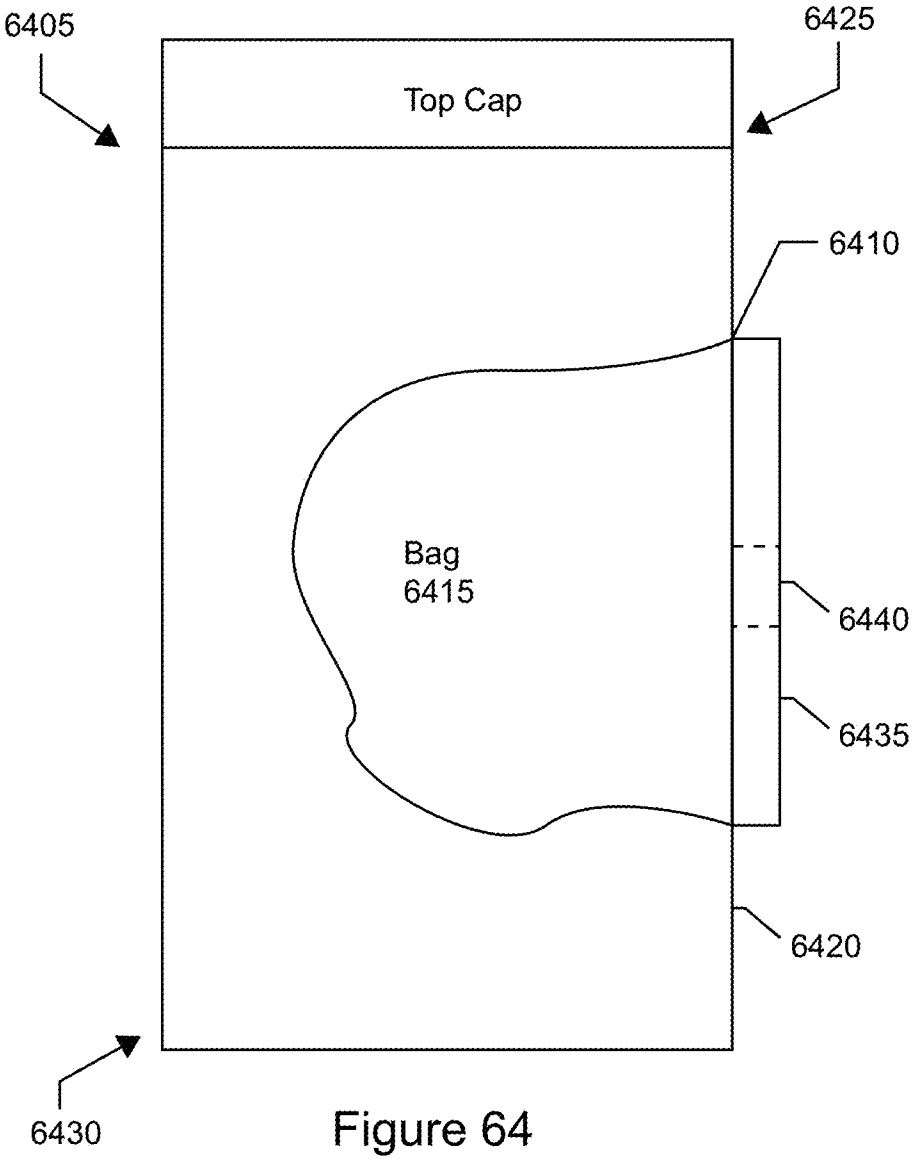
FIG. 64 shows a block diagram of a bottle with a side cap.

FIG. 64 shows a block diagram of a container or bottle 6405 according to another specific embodiment. This bottle is similar to the bottle shown in FIG. 1. In this specific embodiment, however, an opening 6410 into a bag 6415 is located on a side 6420 of the bottle between a top end 6425 of the bottle and bottom end 6430 of the bottle, opposite the top end. A side cap 6435 is removably connected over the bag opening. The side cap includes at least one hole 6440 that allows air in the bag to escape. In this specific embodiment, the storage compartment is accessible without flipping the bottle upside down.

Figure 65:
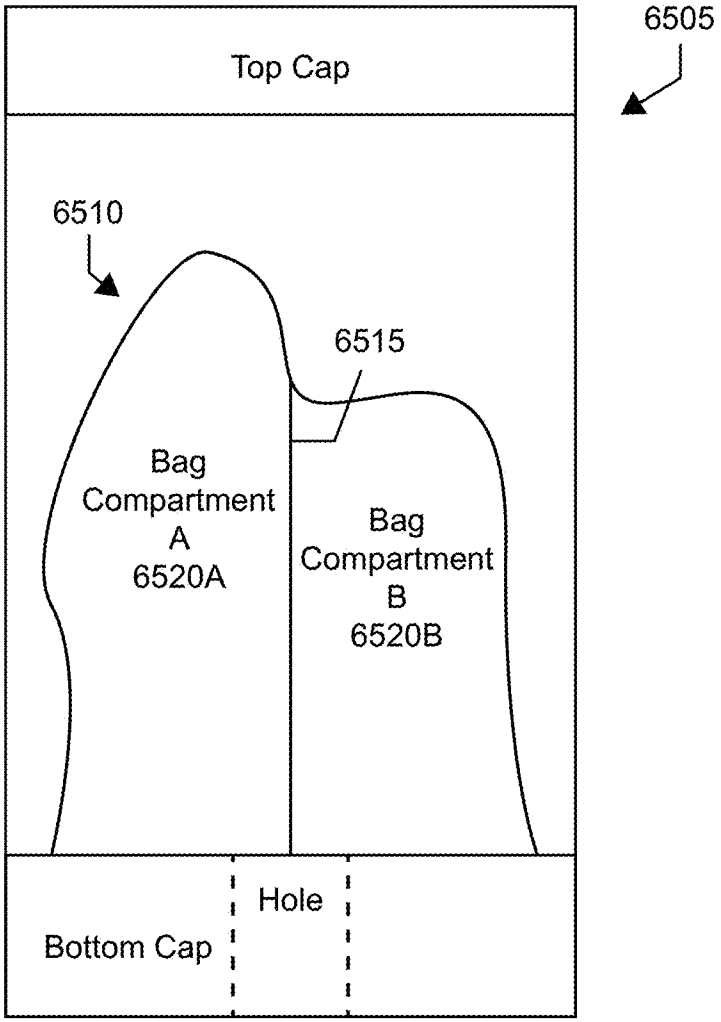
FIG. 65 shows a block diagram of a bottle having a multi-compartment bag.

FIG. 65 shows a block diagram of a container or bottle 6505 according to another specific embodiment. This bottle is similar to the bottle shown in FIG. 1. In this specific embodiment, however, a bag 6510 includes a divider 6515. The divider separates an interior space of the bag into a first bag compartment 6520A and a second bag compartment 6520B. A volume of the first bag compartment may be the same as or different from a volume of the second bag compartment. The volume of the first bag compartment may be greater than or less than the volume of the second bag compartment.

The two compartments help to facilitate organization of multiple items. For example, keys can be stored in the first compartment, while supplements can be stored in the second compartment, separate from the first compartment. Storing the items separately helps to prevent the items from crushing or scratching each other. Although FIG. 65 shows two bag compartments, it should be appreciated that a bag may be divided into any number of compartments.

Figure 66:
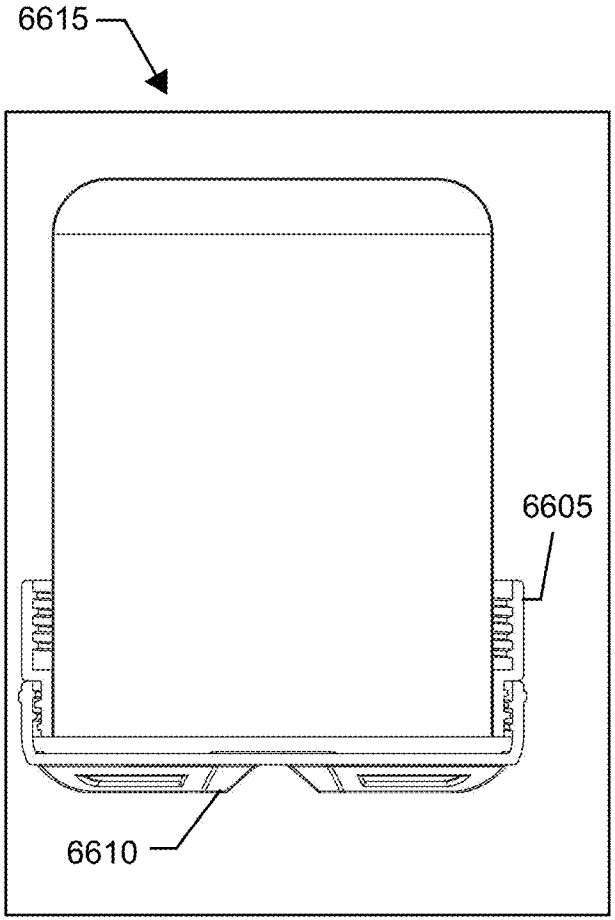
FIG. 66 shows a packaging option for a bag assembly and bottom cap.

FIG. 66 shows a packaging option for a bag assembly 6605 and bottom cap 6610. In a specific embodiment, a kit 6615 includes the bag assembly and bottom cap. The bottle body, top cap, or both is not included or is omitted from the kit. In this specific embodiment, a user can purchase the kit to install the bag assembly (and bottom cap) onto a bottle that is provided by a third-party.

Figure 67:
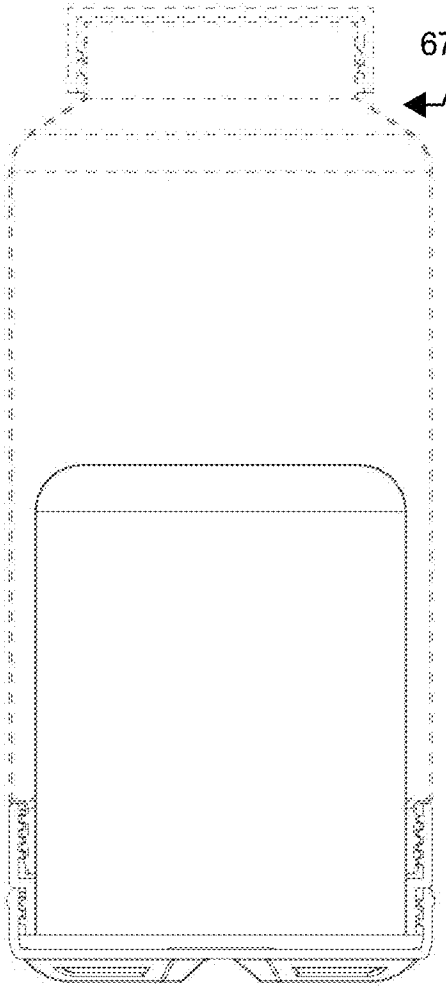
FIG. 67 shows the bag assembly attached to a third party bottle.

For example, FIG. 67 shows a bottle 6705 having openings at both ends that may be available from a third party. The bottle is shown in broken lines to indicate that the bottle is supplied by a third party. The user can purchase the kit shown in FIG. 66 to use with the third-party bottle.

Figure 68:
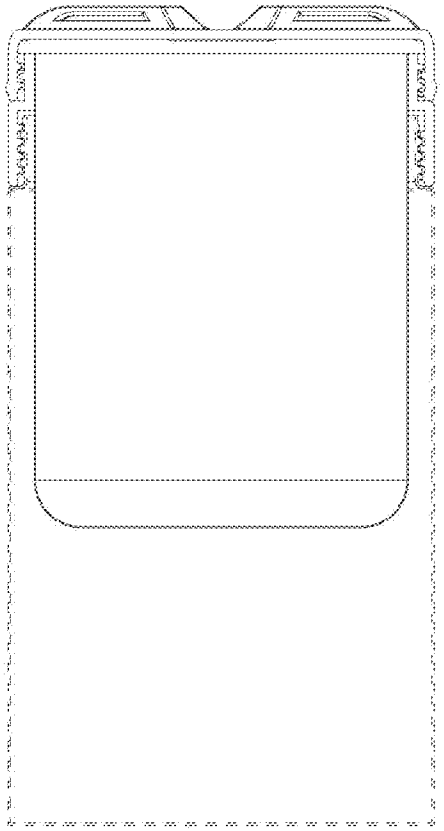
FIG. 68 shows the bag assembly attached to another third party bottle.

As another example, FIG. 68 shows a bottle 6805 having a single opening that may be available from a third party. The bottle is shown in broken lines to indicate that the bottle is supplied by a third party. The user can purchase the kit shown in FIG. 66 in order to replace the top cap of the bottle with the bag assembly. In this specific embodiment, the bag assembly is installed at the top of the bottle.

Figure 69:
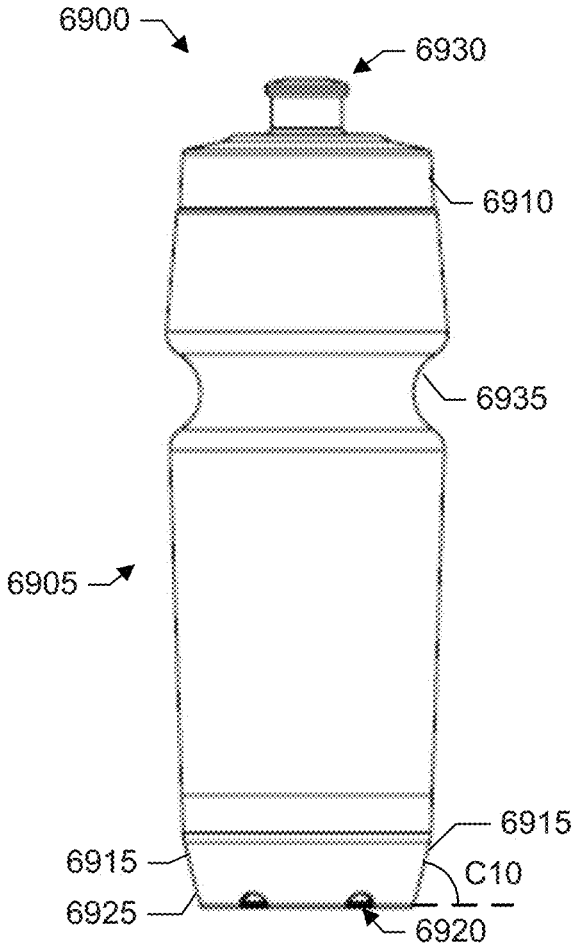
FIG. 69 shows a front view of a bottle according to another specific embodiment.

FIGS. 69-72 shows a specific embodiment of a bottle 6900 having self-adjusting compartments. In this specific embodiment, the bottle may be referred to as a bicycle water bottle. FIG. 69 shows a front view of the bottle. This bottle includes a body 6905, a top cap 6910, and a bottom cap 6915. The bottom cap includes a set of holes 6920 and a chamfer or bevel 6925. The top cap includes a nozzle 6930. The body includes a groove 6935.

Figure 70:
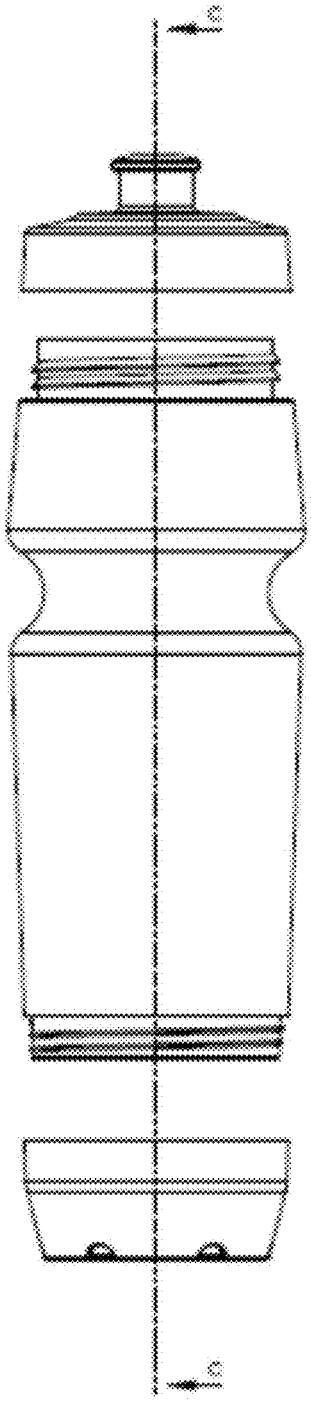
FIG. 70 shows an exploded view of the bottle shown in FIG. 69.
Figure 71:
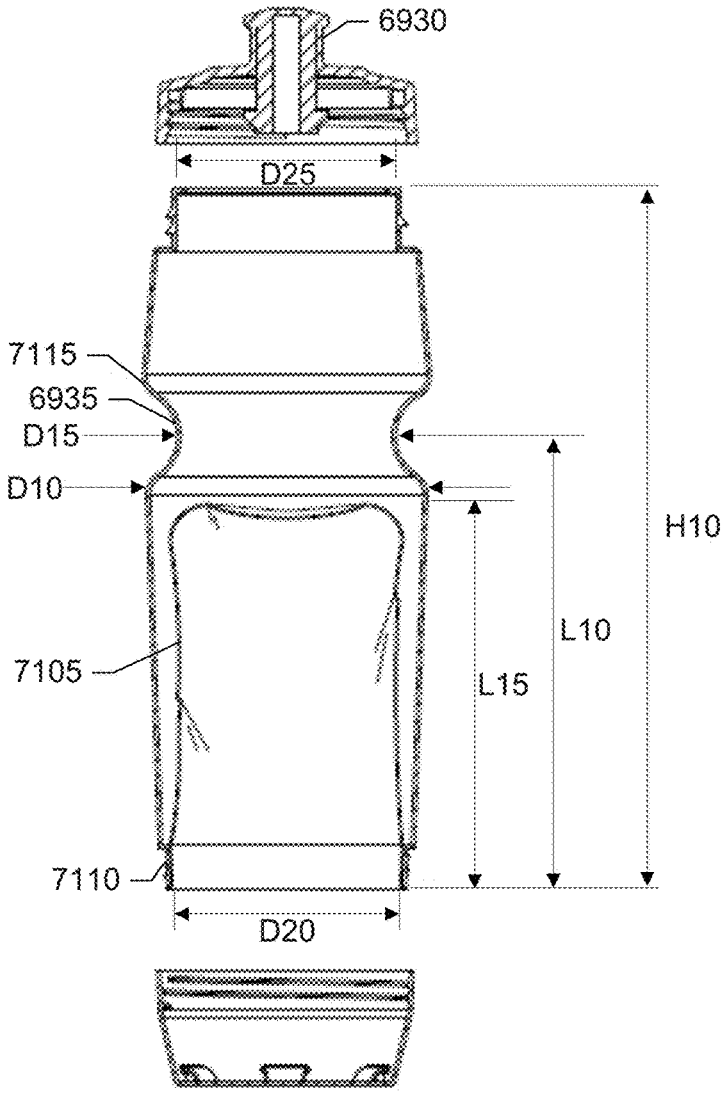
FIG. 71 shows an exploded section view of the bottle shown in FIG. 69.
Figure 72:
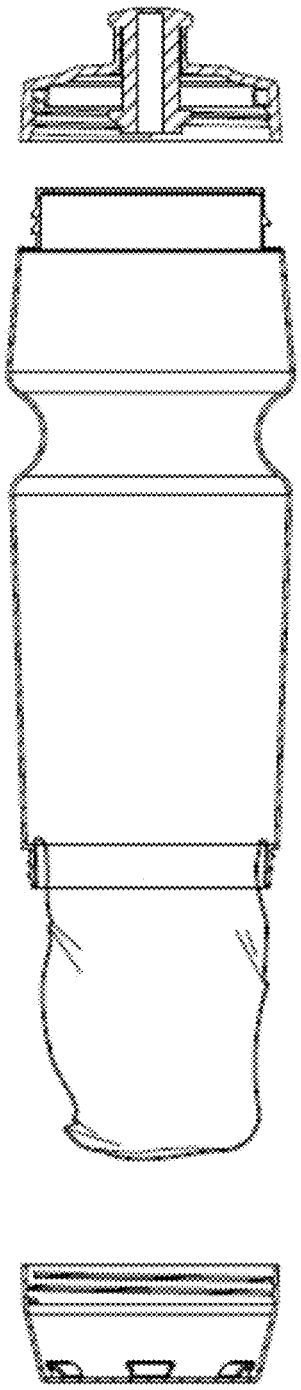
FIG. 72 shows another exploded section view of the bottle shown in FIG. 69.
Figure 73:
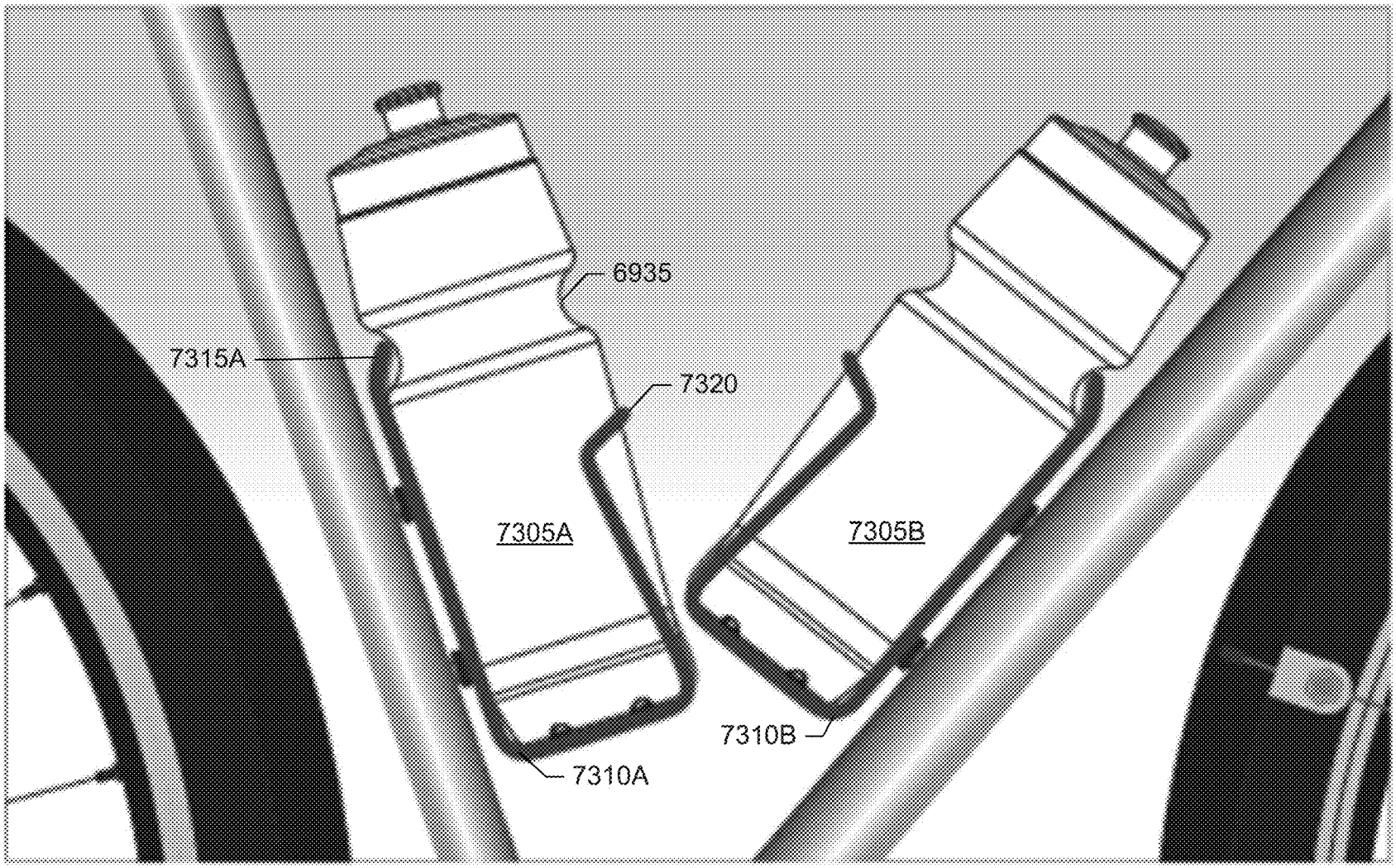
FIG. 73 shows a side view of two bottles held in water bottle cages of a bicycle.

FIG. 70 shows an exploded view of bottle 6900. FIG. 71 shows a section view of bottle 6900 taken as indicated by section C-C in FIG. 70. As shown in the example of FIG. 71, bottle 6900 includes a bag 7105 connected to a bottom end 7110 of the bottle. FIG. 72 shows a section view of the bottle with bag 7105 having been flipped inside out such as during cleaning. FIG. 73 shows a side view of a bicycle where two bottles 7305A and 7305B have been mounted into two corresponding bicycle water bottle cages 7310A and 7310B, respectively.

Referring now to FIG. 69, in this specific embodiment, the chamfer or bevel on the bottom cap facilitates insertion of the bottle into a bottle cage. The chamfer helps to guide the bottle into the opening of the bottle cage. The chamfer allows a user, such as a cyclist, to safely insert the bottle back into the bottle cage while riding. Because of the chamfer, it is not necessary for the user to precisely position the bottle into the bottle cage opening because the chamfer allows some flexibility in the positioning. In FIG. 69, a dimension C10 indicates an angle of chamfer 6925. In a specific embodiment, the angle is about 69 degrees. The angle can range from about 50 degrees to about 80 degrees including, for example, 55, 60, 65, 70, 75, or more than 80 degrees. The angle may be less than 50 degrees.

Referring now to FIG. 71, groove 6935 includes contoured or rounded edges 7115. The groove provides a catch to allow the bottle to be removably secured by the bottle cage. For example, as shown in FIG. 73, bottle cage 7310A includes a tab 7315A and a retainer or clamp portion 7320. Typically, bicycle water bottle cages are designed to be slightly flexible. As the bottle is slid into the cage, the retainer portion flexes outward like a spring to accept the bottle. As the bottle continues to slide towards the bottom of the cage, the tab engages groove 6935 and the retainer portion clamps the bottle against an opposite side of the cage. The rounded edges of the groove allow the bottle to be easily removed and re-inserted into the cage. For example, during removal of the bottle from the cage the rounded edges of the groove allow the cage tab to easily slip out of the groove. During re-insertion of the bottle into the cage the rounded edges of the groove allow the cage tab to easily slip into the groove.

In a specific embodiment, the groove encircles or at least partially encircles the bottle body. This allows the bottle to be removed and re-inserted into the cage without having to be oriented in a particular rotational direction. In another specific embodiment, the bottle may include a dimple or set of dimples that can be engaged by the bottle cage tab. For example, there can be one, two, three, four, five, six, seven, eight, or more than eight dimples positioned around the bottle body. A dimple may be referred to as a notch, depression, indentation, recess, dent, or cavity.

The bottle cage shown in FIG. 73 is merely an example of a specific design that may be used to secure the bottle to the bicycle. There can be other designs which do not include tab 7315A. For example, the bottle may be secured to the bicycle using magnets or other cage designs that do not include tab 7315A. In these specific embodiments, the bottle may accordingly not include the groove. The bottle may be designed or configured for a particular type of attachment mechanism that allows the bottle to be removably attached to the bicycle.

Referring back to FIG. 71, nozzle 6930 helps to direct the flow of fluid from the bottle. For example, when the nozzle is opened and the user squeezes the bottle, fluid (e.g., a drink) may be forced out of the nozzle. When the nozzle is closed, the nozzle forms a seal to prevent fluid from leaking out of the bottle. In a specific embodiment, the nozzle is opened by pulling on the nozzle. The nozzle is closed by pushing on the nozzle. In another specific embodiment, the nozzle is opened and closed using a twisting motion (e.g., twist in one direction to open, twist in an opposite direction to close). In various other specific embodiments, other nozzle configurations and designs may be used. There can be a cap (e.g., a hinged cap) that covers the nozzle to help keep the nozzle clean and free from dirt, dust, and other debris.

In a specific embodiment, a height H10 of the bottle is about 203 millimeters (mm). An outside diameter D10 of the bottle is about 74 mm. An outside diameter D15 of the bottle at the groove is about 52 millimeters (mm). A distance L10 between the groove and the bottom end of the body is about 140 mm. The distance between the groove and the bottom end of the bottle body is greater than a distance between the groove and the top end of the bottle body. In other words, distance between the groove and the top end of the bottle body is less than a distance between the groove and the bottom end of the bottle body. These dimensions allow the bottle to be inserted into a typical bicycle water bottle cage and retained by the engagement between the cage tab and bottle groove.

These dimensions, however, and other dimensions described in this application can vary depending upon factors such as the intended use of the bottle (e.g., bicycle water bottle versus general sports water bottle), desired volume available for drink storage, desired volume available for item storage, and so forth. A taller bottle can provide more room for drinks, tools, and spare parts as compared to a shorter bottle. The shorter bottle, however, may be easier to handle than the taller bottle. Further, depending upon factors such as the size of the frame, the shorter bottle may be easier than the taller bottle to remove from and reinsert into the water bottle cage. For example, smaller sized frames typically have a more compact front triangle as compared to larger sized frames. The front triangle is the triangle formed by the top tube, down tube, and seat tube. The top tube on a small bicycle may interfere with the removal and insertion of a bottle that happens to be very tall. Similarly, the width or diameter of the bottle may vary greatly depending upon factors such as the desired type and size of items to be carried, and other factors.

In another specific embodiment, the height of the bottle is about 183 mm. In various specific embodiments, the height of the bottle can range from about 115 mm to about 300 mm. This includes, for example, 120, 130, 145, 150, 155, 160, 165, 170, 175, 180, 185, 190, 195, 200, 205, 210, 215, 220, 225, 230, 235, 240, 245, 250, 255, 260, 265, 270, 275, 280, 285, 290, 295, or more than 300 mm. In some embodiments, the height may be less than 115 mm.

In a specific embodiment, an inside diameter D20 of the bottom opening (e.g., diameter of bag opening) is about 55 mm. An inside diameter D25 of the top opening is about 55 mm. A diameter of the bottom opening may be the same as or different from a diameter of the top opening. A length L15 of the bag is about 120 mm. As discussed above, however, it should be appreciated that these dimensions can vary greatly. For example, in another specific embodiment, a length of the bag is about 160 mm. The outside length of the bag can be equal to or less than the overall length of the bottle. A diameter of the bag opening can range from about 40 mm to about 90 mm. This includes, for example, 45, 50, 55, 60, 65, 70, 75, 80, 85, or more than 90 mm. In some embodiments, the diameter of the bag opening is less than 45 mm.

The bag can be a straight or tapered bag. A straight bag can include a bag in which a cross-sectional area of the bag remains constant along a length of the bag. A tapered bag can include a bag in which a cross-sectional area of the bag varies along a length of the bag. For example, the cross-sectional area of the bag may decrease from the closed end of the bag towards the open end of the bag. A tapered bag can provided additional storage space for items. For a bottle having a tapered bag, the actual length of the tapered bag may be greater than the overall length of the bottle. The outer diameter of the bag can be equal to or less than the inside diameter of the bottle.

In FIG. 71, the outside diameter of the bottle tapers or at least partially tapers along a length or portion of a length of the bottle. In a specific embodiment, the outside diameter of the bottle is constant or at least partially constant along a length or a portion of the length of the bottle. For example, an outside diameter of a bottle may be constant along at least a portion of a length of the bottle.

A diameter of the bottle (e.g., diameter D10) can range from about 50 mm to about 100 mm. This can include, for example, 55, 60, 65, 70, 75, 80, 85, 90, 95, or more than 100 mm. In some embodiments, the diameter may be less than 55 mm.

A feature of the bottle allows items to be discretely carried inside the bottle and separated from the water or other drink that may also be inside the bottle. For example, with this bottle, a cyclist may carry tools, spare parts, or both. Some specific examples of tools and spare parts include tire levers, multi-tools, CO2 cartridges, chain links, inner tube patches, inner tubes, sealants, and so forth. These tools and spare parts can be used in cases of emergencies.

Traditionally, such items are carried in the pockets of the cyclist's jersey. A cycling jersey typically includes one, two, or three pockets sewn into the back of the jersey. This allows the cyclist to easily access the items with one or both hands while riding. These pockets, however, are very small. As a result, little or no room may be left for other items that a cyclist may desire to carry such as extra clothing (e.g., vest, gloves, rain jacket, arm warmers, or leg warmers), food (e.g., energy bars or energy gels), cell phone, and the like. Stuffing too many items into a pocket can also stretch and tear the fabric of the jersey. The weight of items will pull on the jersey and make the jersey uncomfortable to wear. A bulging pocket also has a higher likelihood of snagging the nose of the bicycle saddle when the rider stands up to pedal.

Further, it can be difficult to safely remove items from the pockets while riding. For example, when removing an item from a back pocket that is stuffed with other items one or more of these other items may inadvertently fall out. In addition to the loss of the item, this falling item can present a hazard to the cyclists and others. For example, a vest that happens to fall out while the cyclist is reaching for an energy bar may become wedged and tangled in the back wheel of the bicycle. This can bring the wheel to an abrupt halt and cause the rider to lose control of the bicycle. The vest may become tangled in the wheels of other riders. A rider who loses control of their bicycle while struggling to remove an item from a stuffed jersey pocket may cause others to swerve and crash.

Instead or additionally, these items may be carried in a saddle bag that is attached to the bicycle. A saddle bag typically includes straps that attach to the bottom rails of the saddle and straps that attach to the bicycle seatpost or seat tube. Saddle bags often sway while the bicycle is being ridden. The swaying motion can cause the straps to rub against the paint and finish of the bicycle like sandpaper. Over time, this can ruin the finish. Furthermore, depending upon the width of the saddle bag, the saddle bag may interfere with the back of the cyclist's thigh during pedaling.

A saddle bag may also interfere with the operation of particular seatpost types such as aero seatposts, suspension seatposts, and height adjustable seatposts (also referred to as dropper seatposts). For example, some height adjustable seatposts include a telescopic tube arrangement and mechanism that allows the user to change the seat height (e.g., raise or lower the saddle). A saddle bag attached to a height adjustable seatpost may interfere with the telescoping action or mechanism of the seatpost. Instead or additionally, the presence of a saddle bag may prevent the user from lowering the saddle past a certain point due to interference of the saddle bag and rear tire of the bicycle. A saddle bag may interfere with the seatpost clamp that fastens the saddle to the seatpost. Attaching a large and bulky bag to a bicycle can also interfere with the overall aesthetics of the bicycle and degrade the user experience.

A bottle, such as the one shown in the examples of FIGS. 69-72 and elsewhere, however, allows the user to discretely carry a set of emergency items or supplies (e.g., tool or spare parts) along with a drink for hydration. Thus, items that would otherwise not be carried or be stuffed into a rear jersey pocket or saddle bag can be concealed inside the bottle bag.

The handling of the bicycle can be improved because there can be a lowering of the center of gravity. For example, a bicycle will typically accommodate a water bottle being mounted on a down tube of the bicycle and a water bottle being mounted on a seat tube of the bicycle (see, e.g., FIG. 73). Both locations are typically lower than the location of the saddle and thus saddle bag. The center of gravity can be lowered by relocating items from the saddle bag, jersey pocket, or both to the bottle.

Storing emergency items in the bottle that would otherwise be carried in rear jersey pockets increases the available space in the pockets for other items that may be accessed more frequently than the emergency items. For example, energy bars and gels which are frequently consumed on a bicycle ride may be stored in the jersey pockets where they are easily accessible. The less frequently accessed emergency items (e.g., tools or spare parts) may be stored in the bottle.

Figure 74:
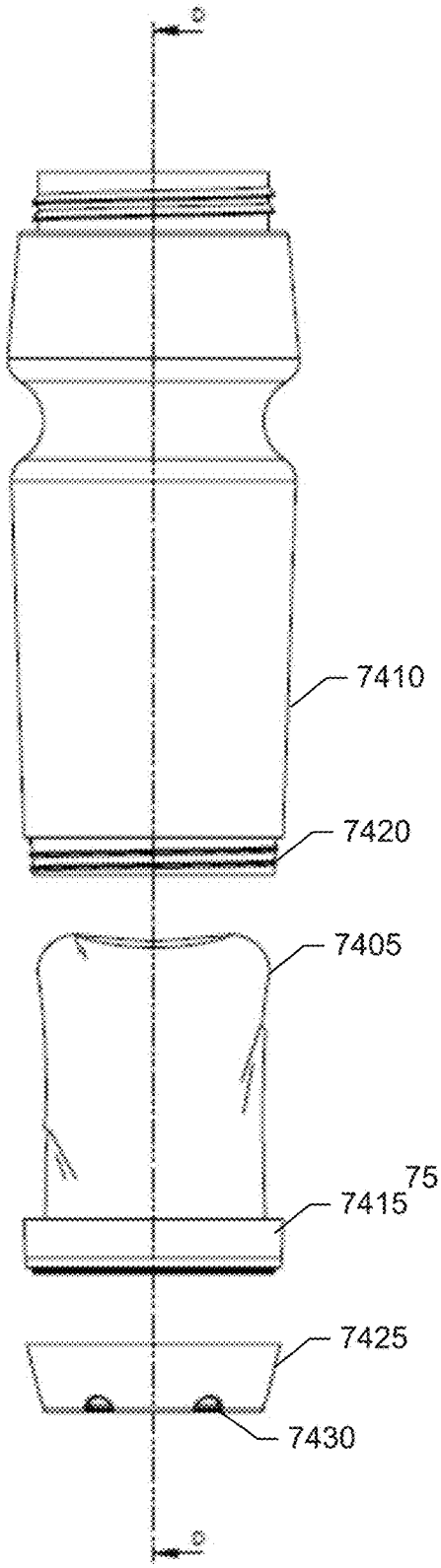
FIG. 74 shows an exploded view of a bottle according to another specific embodiment.
Figure 75:
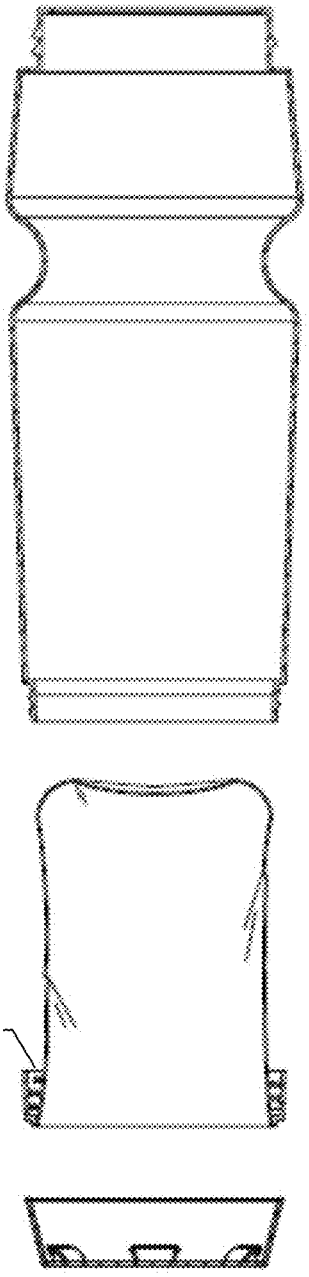
FIG. 75 shows an exploded section view of the bottle shown in FIG. 74.

FIG. 74 shows a bag 7405 that can be detached and reattached to a bottle body 7410 by a user. In this specific embodiment, the bag includes a connector 7415. An inside surface of the connector includes a set of threads 7515 (FIG. 75) which threadably engage or mate with a corresponding set of threads 7420 (FIG. 74) at the bottom end of the bottle body. In this specific embodiment, joint between the rim and end of the bottle body is designed to be airtight so that fluid (e.g., a drink) in the bottle body does not leak out. Thus, the rim may include a gasket or O-ring to help create a hermetic seal between the rim and the end of the bottle body. The rim may include a channel to receive the gasket or O-ring.

There is a bottom cap 7425 that can be removably connected to the bottom of the rim. The bottom cap covers an opening of the bag to help contain any items placed inside the bag. The bottom cap includes one or more holes 7430 to allow air to escape from the bag so that the bag can be at least partially collapsed by the pressure from a drink introduced into the bottle body.

In a specific embodiment, the bag and bottom cap may be provided as a single unit separate from the bottle body. This can help facilitate cleaning of the bag and bottom cap unit and bottle body unit. The bag and bottom cap unit may be designed to be attached to third-party dual-capped hydration bottles.

Figure 76A:
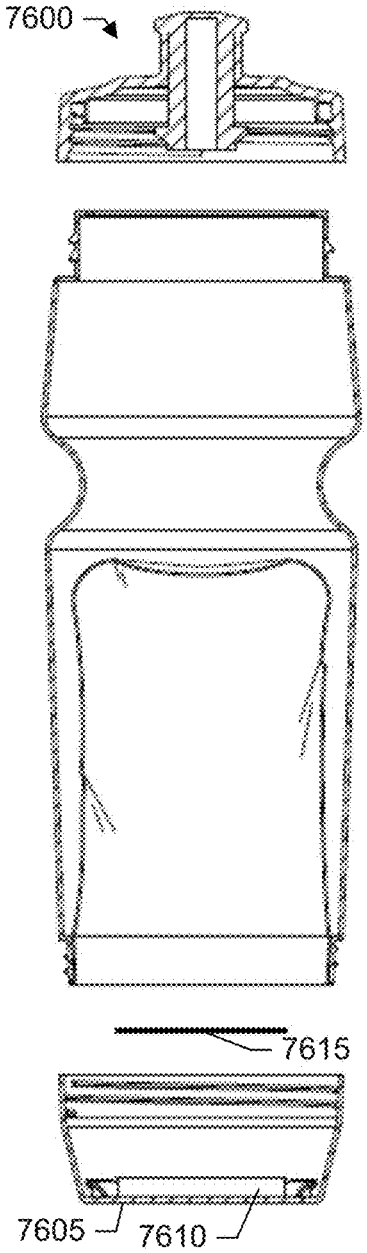
FIG. 76A shows an exploded front section view of a bottle according to another specific embodiment.

FIG. 76A shows an exploded section view of another specific embodiment of a bottle 7600 having self-adjusting compartments. In this specific embodiment, a bottom cap 7605 includes a secondary storage compartment 7610 and a lid 7615 that fits over the secondary storage compartment. The volume of the secondary storage compartment may be less than the volume of the bag. The secondary storage compartment can be used to hold small items such as inner tube patches.

Figure 76B:
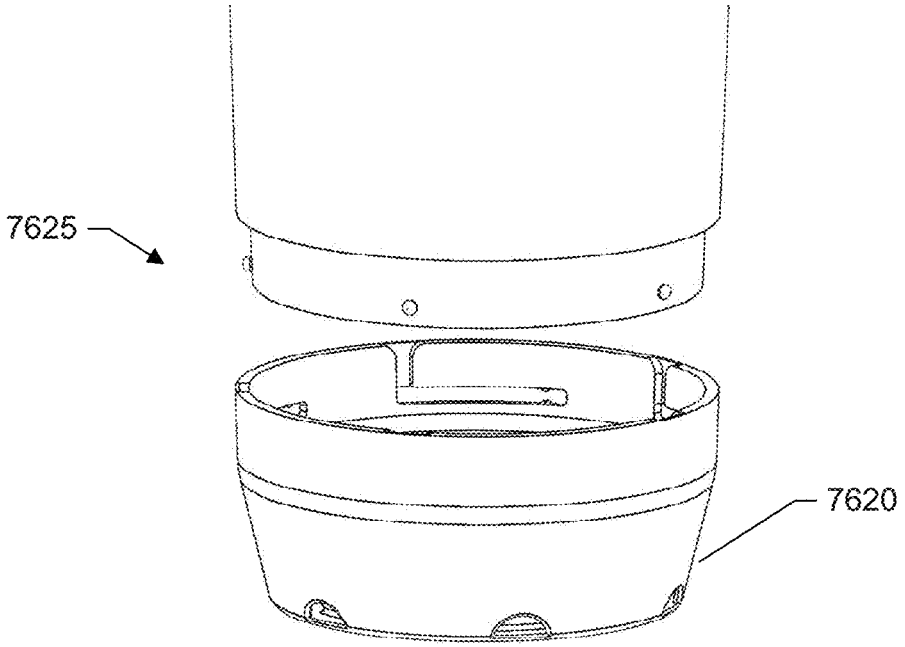
FIG. 76B shows a bottle and bottom cap according to another specific embodiment.
Figure 76C:
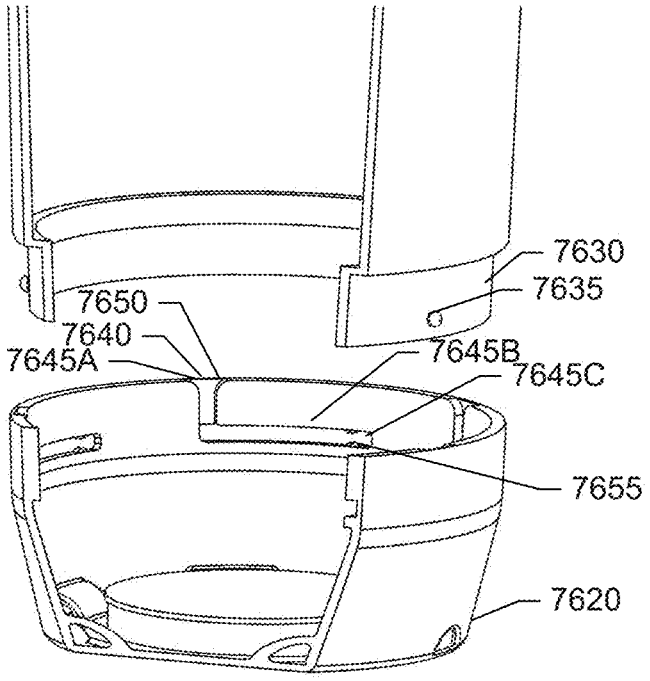
FIG. 76C shows a section view of the bottle and bottom cap shown in FIG. 76B.

FIG. 76B shows a view of a bottom portion of another specific embodiment of a bottle where a bottom cap 7620 is removably joined to a bottom end 7625 of the bottle using a nub and channel configuration. FIG. 76C shows a section view of the bottle shown in FIG. 76B. In this specific embodiment, a bottom neck 7630 of the bottle includes one or more nubs 7635 and an inside surface of the bottom cap includes one or more corresponding channels 7640. The channel includes a first portion 7645A, a second portion 7645B, and a third portion 7645C.

The first portion is positioned orthogonally to the second portion. For example, the first portion is positioned vertically and the second portion is positioned horizontally. An opening 7650 into the first portion includes a set of rounded corners. The third portion of the channel includes a set of tabs 7655. The bottom cap may be attached to the bottle by aligning a nub with an opening of a channel, pushing the bottom cap and bottle together such that the nub slides through the first portion of the channel. The bottom cap can then be rotated relative to the bottle such that the nub slides through the second portion of the channel, past the set of tabs, and into the third portion of the channel.

The rounded corners of the channel help the user to align the nub and channel. The spacing between the set of tabs is slightly less than the width of the nub. The set of tabs temporarily deform as the nub is slid past the space between the set of tabs and help to ensure that the bottom cap does not inadvertently twist off. In another specific embodiment, the configuration of the nub and channel may be swapped from what is shown in FIGS. 76B, C. For example, in another specific embodiment, the nub may be formed on an inside surface of the bottom cap and the channel may be formed on an outside surface of the bottom neck of the bottle. The nub and channel attachment mechanism shown in FIGS. 76B, C allow the bottom cap to be removed (and replaced) without having to make a full 360 degree (or more) twist or rotation of the bottom cap relative to the bottle body.

Figure 77:
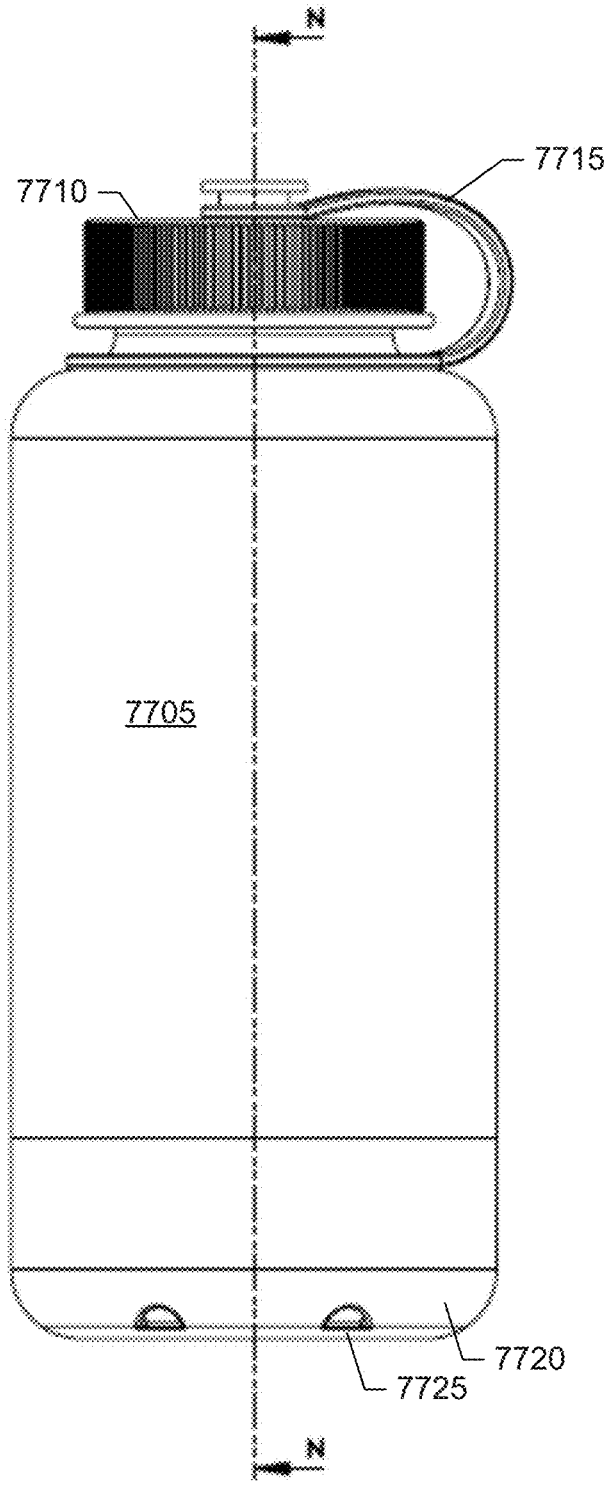
FIG. 77 shows a front of a bottle according to another specific embodiment.
Figure 78:
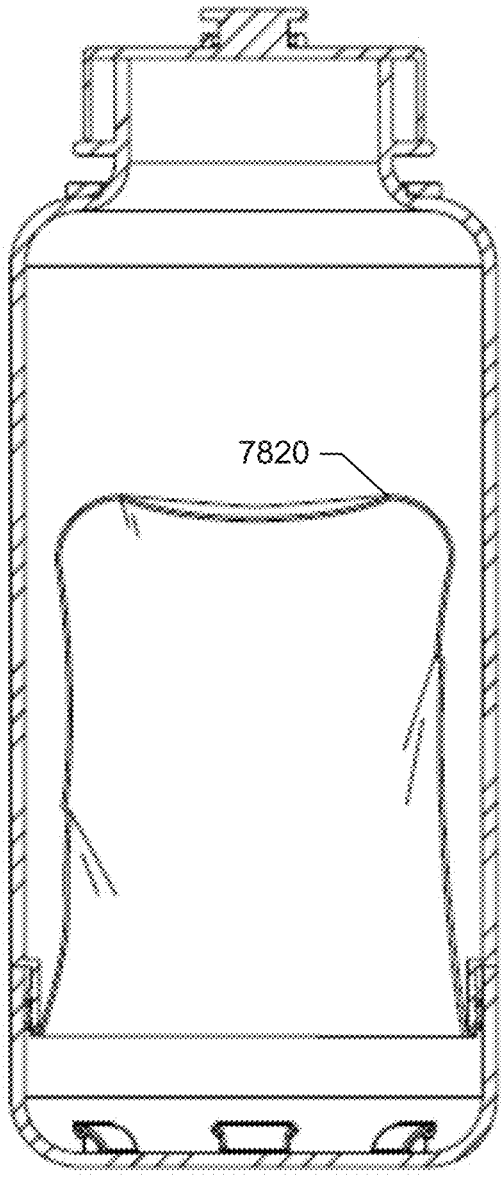
FIG. 78 shows a section view of the bottle shown in FIG. 77.

FIGS. 77-78 show a bottle 7705 having self-adjusting compartments provided by a bag 7820 (FIG. 78) according to another specific embodiment. FIG. 77 shows a front view of the bottle. FIG. 78 shows a section view of the bottle taken along a section line N-N as indicated in FIG. 77. In this specific embodiment, the bottle includes a top cap 7710 and a strap 7715 connecting the top cap to the bottle body. The strap helps to prevent the top cap from being misplaced. Instead or additionally, there can be a strap connecting a bottom cap 7720 to the bottle body. The bottom cap includes at least one hole 7725. In this specific embodiment, the bottle does not include a groove and the top cap does not include a nozzle. Thus, some embodiments of the bottle do not include a groove, nozzle, or both.

Figure 79:
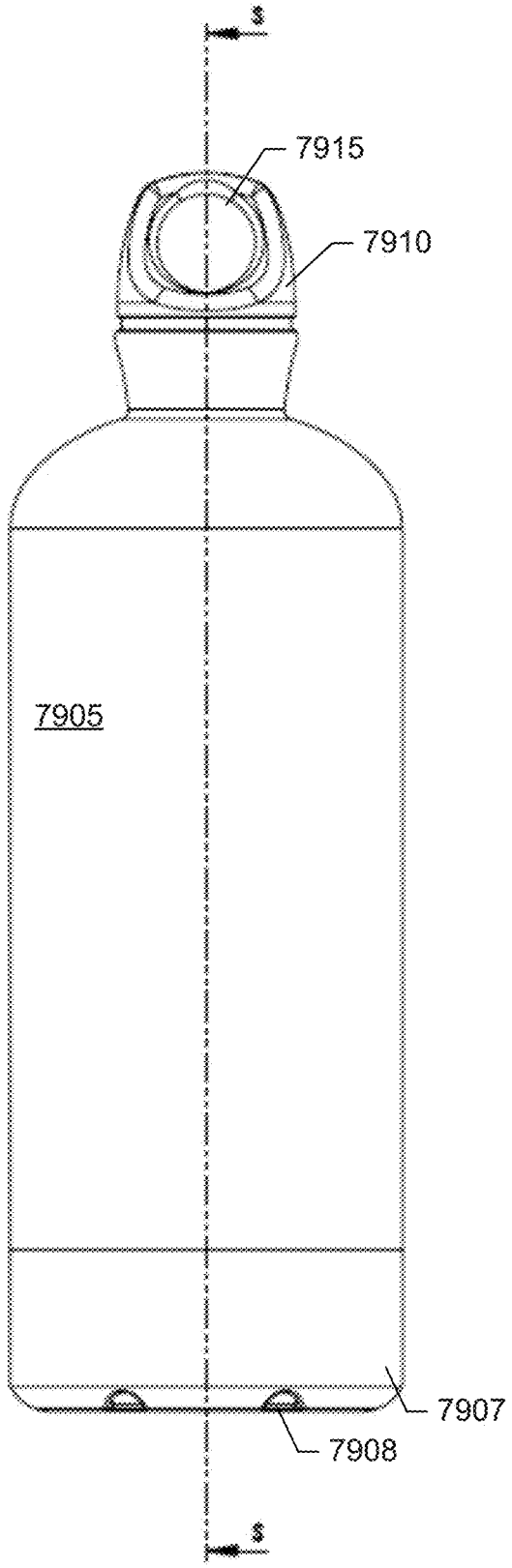
FIG. 79 shows a front view of a bottle according to another specific embodiment.
Figure 80:
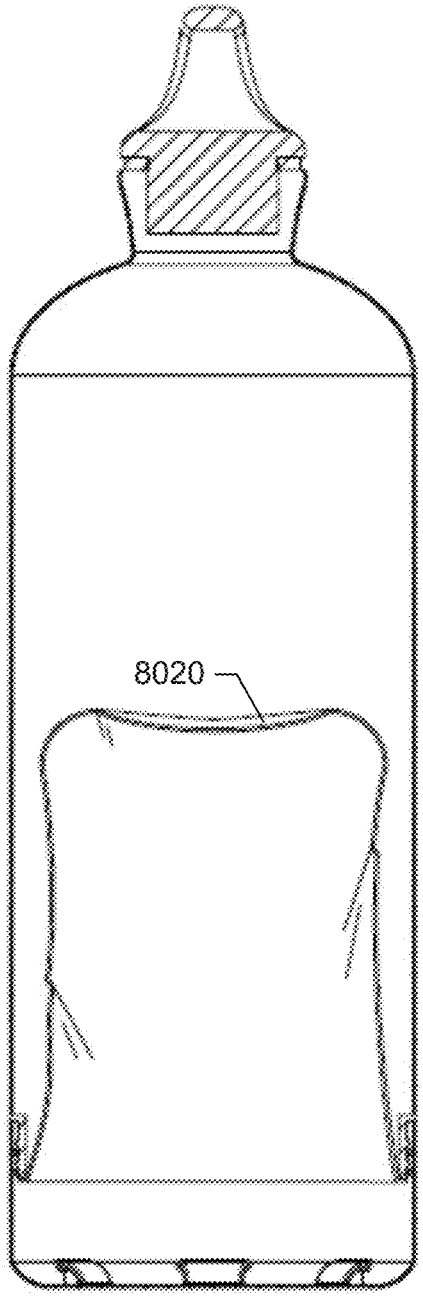
FIG. 80 shows a section view of the bottle shown in FIG. 79.

FIGS. 79-80 show a bottle 7905 having self-adjusting compartments provided by a bag 8020 (FIG. 80) according to another specific embodiment. FIG. 79 shows a front view of the bottle. FIG. 80 shows a section view of the bottle taken along a section line S-S as indicated in FIG. 79. The bottle includes a bottom cap 7907 having at least one hole 7908. In this specific embodiment, a top cap 7910 of the bottle includes an eyelet 7915. The eyelet can be used as a handle for carrying the bottle (e.g., insert finger through eyelet and hook or curl finger). Alternatively, the bottle may be carried by passing a cord, hook, or carabineer through the eyelet.

Figure 81:
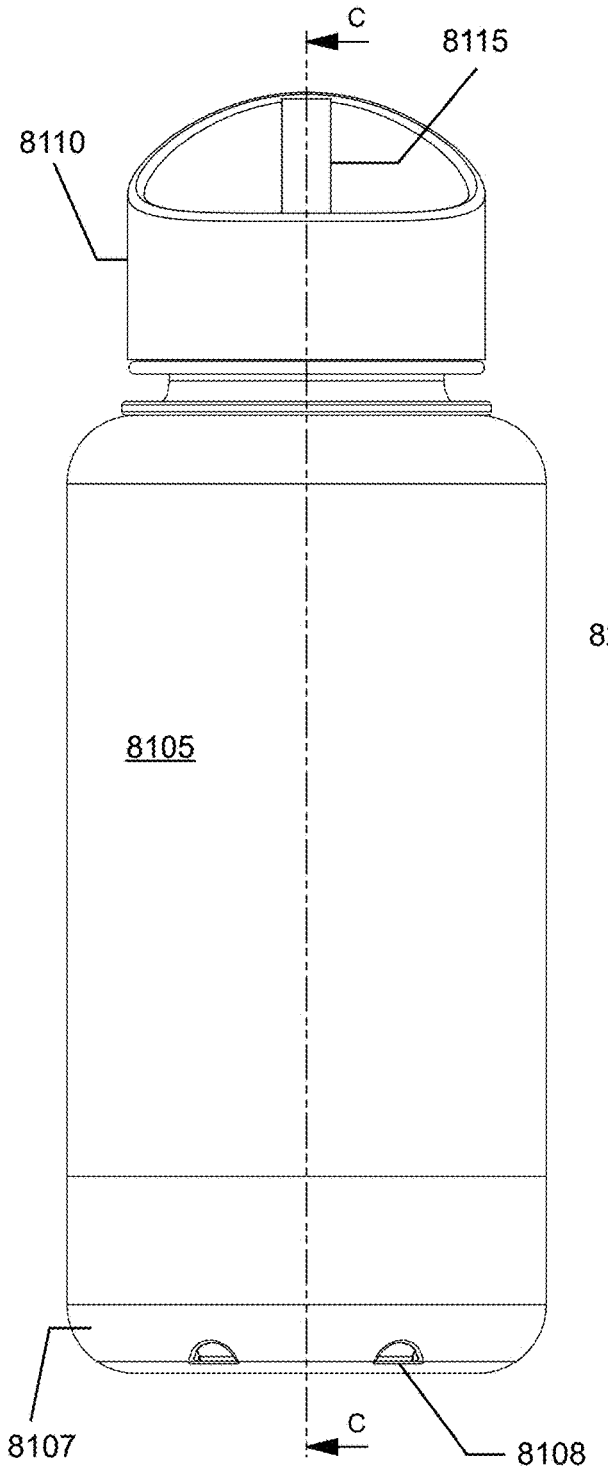
FIG. 81 shows a front view of a bottle according to another specific embodiment.
Figure 82:
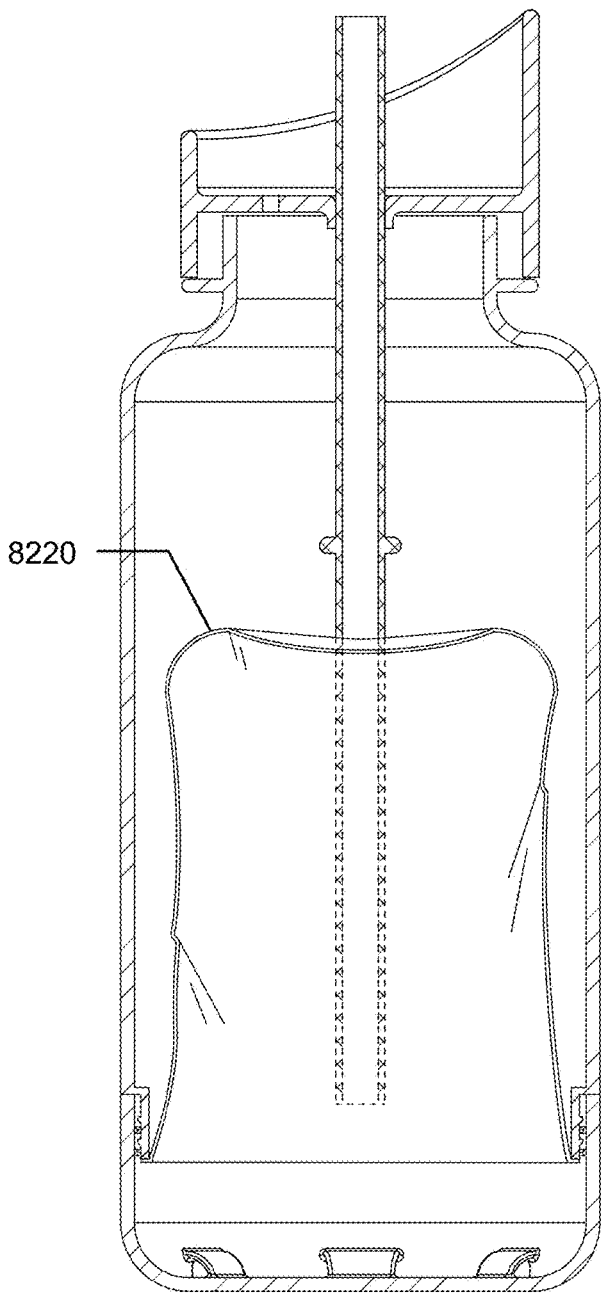
FIG. 82 shows a section view of the bottle shown in FIG. 81.

FIGS. 81-82 show a bottle 8105 having self-adjusting compartments provided by a bag 8220 (FIG. 82) according to another specific embodiment. FIG. 81 shows a front view of the bottle. FIG. 82 shows a section view of the bottle taken along a section line C-C as indicated in FIG. 81. The bottle includes a bottom cap 8107 having at least one hole 8108. In this specific embodiment, a top cap 8110 of the bottle includes a straw 8115. The straw extends into the drink compartment of the bottle.

Figure 83:
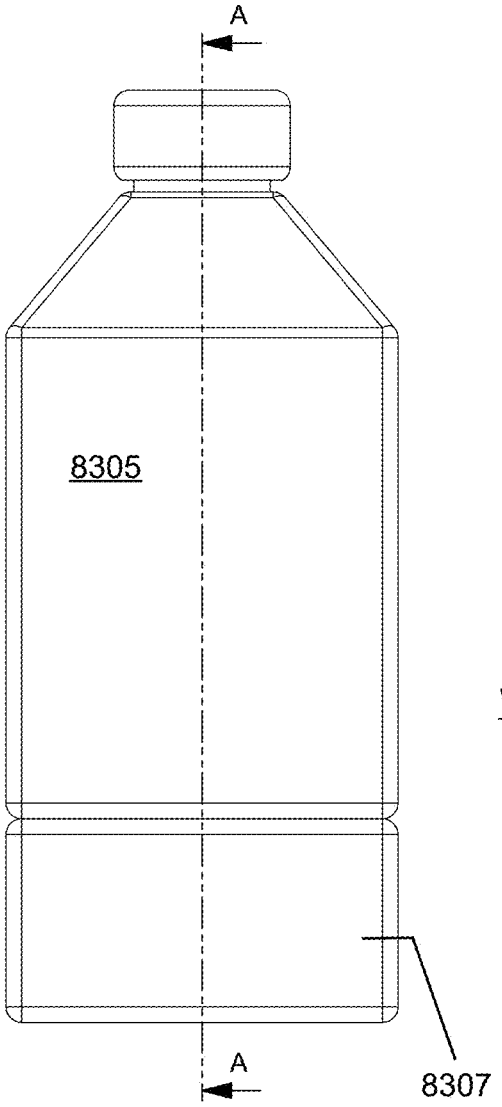
FIG. 83 shows a front view of a bottle according to another specific embodiment.
Figure 84:
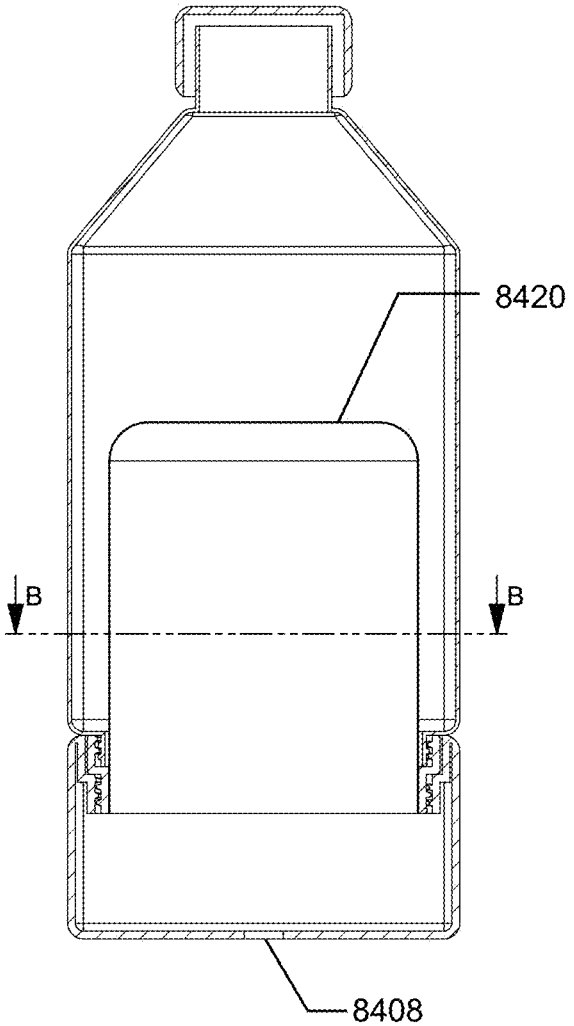
FIG. 84 shows a section view of the bottle shown in FIG. 83.
Figure 86:
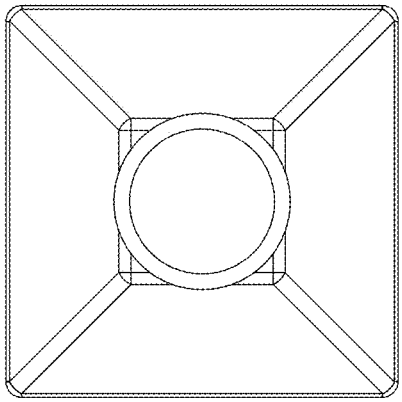
FIG. 86 shows a top view of the bottle shown in FIG. 83.
Figure 85:
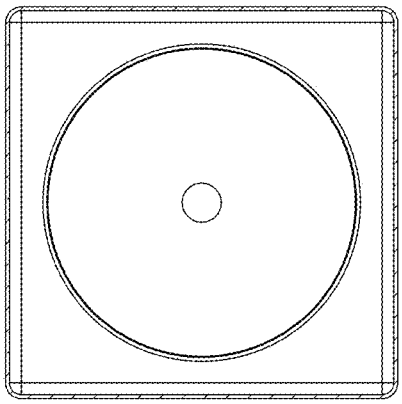
FIG. 85 shows another section view of the bottle shown in FIG. 83.
Figure 89:
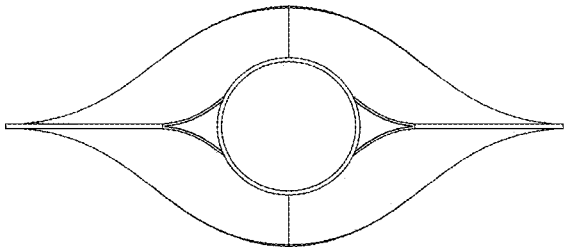
FIG. 89 shows a top view of the bottle shown in FIG. 87.

FIGS. 83-86 show a bottle 8305 having self-adjusting compartments provided by a bag 8420 (FIG. 84) according to another specific embodiment. FIG. 83 shows a front view of the bottle. FIG. 84 shows a section view of the bottle taken along a section line A-A as indicated in FIG. 83. The bottle includes a bottom cap 8307 having at least one hole 8408. In this specific embodiment, a shape of a cross section of the bottle includes a square. For example, FIG. 85 shows a section view of the bottle taken along a section line B-B as indicated in FIG. 84. FIG. 86 shows a top view of the bottle.

Figure 87:
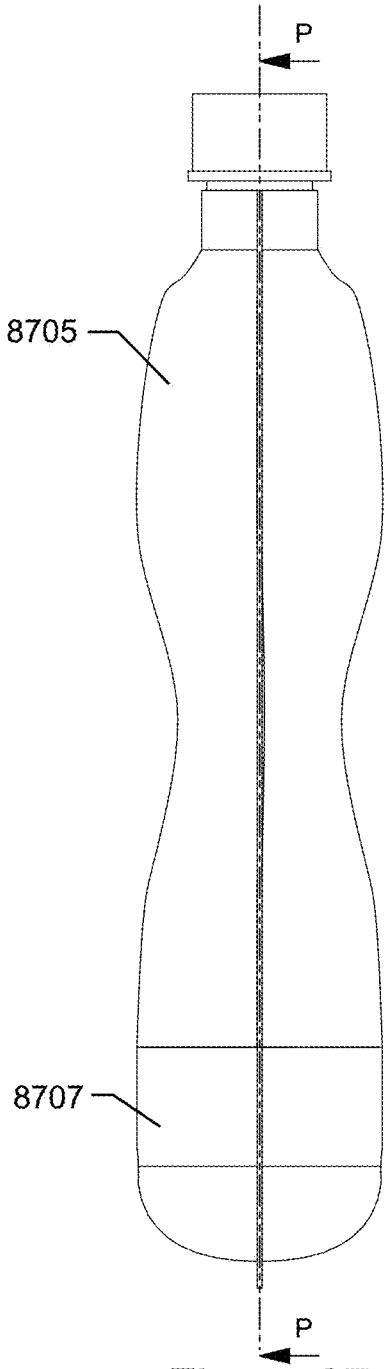
FIG. 87 shows a side view of a bottle according to another specific embodiment.
Figure 88:
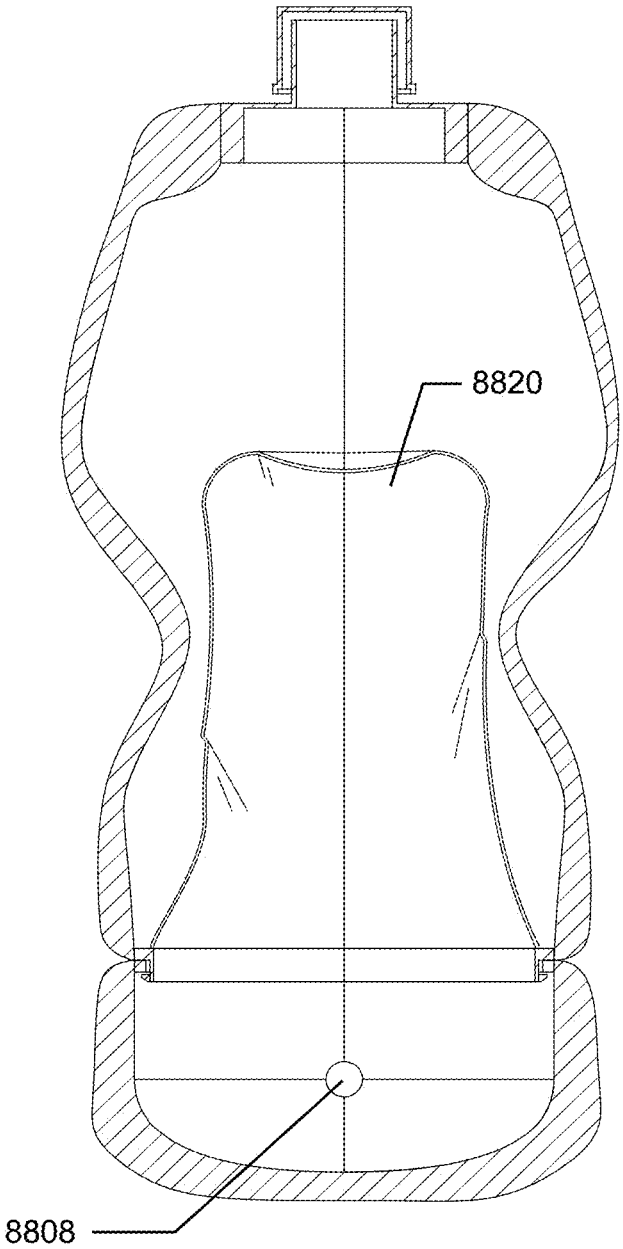
FIG. 88 shows a section view of the bottle shown in FIG. 87.

FIGS. 87-88 show a collapsible container 8705 having self-adjusting compartments provided by a bag 8820 (FIG. 88) according to another specific embodiment. FIG. 87 shows a right side view of the bottle. FIG. 88 shows a section view of the bottle taken along a section line P-P as indicated in FIG. 87. The bottle includes a bottom cap 8707 having at least one hole 8808. Container 8705 may be referred to as a soft bottle. This container can be folded or rolled. The container may be formed by sealing the edges of two panels. A panel may include a laminate of at least two sheets or films. A first sheet may include polyethylene ("PE"). A second sheet may include polyurethane ("PU").

As one of skill in the art will recognize, variables such as thread gender (e.g., male versus female threads), connection gender (e.g., male plug versus female jack), mating connectors, mating fasteners, connection mechanisms, dimensions, material selection, and so forth can be varied. The mechanical arrangements of elements including the bag assembly, connector, valve, bottom cap openings, thread gender, connection gender, and so forth that are shown in the figures are merely examples of particular implementations. In other implementations, other similar and equivalent elements and functions may be used or substituted in place of what is shown. For example, a connection gender may be swapped. A bottle may include a top cap having male plug which is received by a top end of the bottle having a female jack. An implementation of the bottle may include genderless mechanical interconnections (e.g., interlocking protrusions), hermaphroditic or androgynous connections (e.g., mating surfaces having simultaneous male and female aspects, involving complementary paired identical parts each containing both protrusions and indentations).

Some specific flows and techniques are described in this application, but it should be understood that the invention is not limited to the specific flows and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the data.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A bottle having a storage compartment to store an item comprising:

a top opening;

a bag positioned inside the bottle and defining the storage compartment;

a bottom opening, opposite the top opening, the bottom opening being formed by an opening of the bag; and a bottom cap comprising at least one hole, wherein the bottom cap is removably coupled over the bottom opening to provide access to the storage compartment, wherein a size of the bottom opening is greater than a size of the top opening, and wherein when a liquid is poured into the bottle through the top opening, the liquid at least partially collapses the bag around the item as air in the bag is allowed to escape through the bottom opening and out through the at least one hole in the bottom cap.

2. The bottle of claim 1 comprising:

a bottom neck, opposite the top opening;

first threads on the bottom neck; and second threads on the bottom cap, wherein the bag is coupled to the bottom neck, and the second threads of the bottom cap threadably engage with the first threads on the bottom neck.

3. The bottle of claim 2 wherein a size of the opening of the bag is substantially similar to a size of the bottom neck.

4. The bottle of claim 1 comprising:

a bottom neck, opposite the top opening;

first threads on an outside of the bottom neck;

second threads on an inside of the bottom neck, opposite the outside of the bottom neck;

a connector, coupled around the bag opening, and comprising third threads that engage with the second threads on the inside of the bottom neck; and fourth threads on the bottom cap that engage with the first threads on the outside of the bottom neck.

5. The bottle of claim 1 comprising:

a bottom neck, opposite the top opening;

a first portion of a first joining mechanism on an outside of the bottom neck;

a first portion of a second joining mechanism on an inside of the bottom neck;

a connector, coupled around the bag opening, and comprising a second portion of the second joining mechanism that engages with the first portion of the second joining mechanism to fasten the connector to the bottom neck; and a second portion of the first joining mechanism on the bottom cap that engages with the first portion of the first joining mechanism to fasten the bottom cap to the bottom neck.

6. The bottle of claim 1 comprising:

a bottom neck, opposite the top opening;

first threads on the bottom neck;

a connector, coupled around the bag opening, and comprising second threads, and third threads; and fourth threads on the bottom cap, wherein the second threads of the connector engage the first threads of the bottom neck, and the fourth threads of the bottom cap engage the third threads of the connector.

7. The bottle of claim 1 comprising:

a bottom neck, opposite the top opening;

a first portion of a first joining mechanism on the bottom neck;

a connector, coupled around the bag opening, and comprising a second portion of the first joining mechanism, and a first portion of a second joining mechanism; and a second portion of the second joining mechanism on the bottom cap, wherein the first portion of the first joining mechanism on the bottom neck joins with the second portion of the first joining mechanism on the connector to fasten the connector to the bottom neck, and wherein the first portion of the second joining mechanism on the connector joins with the second portion of the second joining mechanism on the bottom cap to fasten the bottom cap to the connector.

8. The bottle of claim 1 wherein the bag comprises silicone.

9. The bottle of claim 1 wherein the bottom cap comprises two or more holes.

10. The bottle of claim 1 wherein an inside surface of the bag is textured.

11. The bottle of claim 1 wherein an inside surface of the bag comprises a plurality of bumps.

12. The bottle of claim 1 comprising a top cap removably coupled over the top opening of the bottle.

13. The bottle of claim 12 wherein the top cap comprises a nozzle.

14. The bottle of claim 1 comprising a straw.

15. An item storage device for a bottle comprising:

a bag comprising a bag opening and defining an adjustable storage compartment to store an item;

a connector, coupled around the bag opening, and comprising first threads, and a first portion of a joining mechanism; and a bottom cap comprising at least one hole, and a second portion of the joining mechanism, wherein the first threads of the connector engages with second threads on a bottom neck of the bottle to join the connector to the bottle, wherein the first portion of the joining mechanism on the connector engages with the second portion of the joining mechanism on the bottom cap to join the bottom cap to the connector, wherein a size of the bag opening is substantially similar to a size of the bottom neck of the bottle, and wherein when a liquid is poured into the bottle through a top opening of the bottle, the liquid at least partially collapses the bag around the item as air in the bag is allowed to escape through the bag opening and out through the at least one hole in the bottom cap.

16. The item storage device of claim 15 wherein the joining mechanism comprises threads.

17. The item storage device of claim 15 wherein the joining mechanism comprises a lug-closure.

18. The item storage device of claim 15 wherein the size of the bag opening is greater than a size of the top opening of the bottle.

19. An item storage device for a bottle comprising:

a bag comprising a bag opening and defining an adjustable storage compartment to store an item;

a connector, coupled about the bag opening, and comprising a first portion of a first joining mechanism; and a bottom cap comprising at least one hole, and a first portion of a second joining mechanism, wherein the first portion of the first joining mechanism on the connector engages with a second portion of the first joining mechanism on a bottom neck of the bottle to join the connector to the bottom neck, wherein the first portion of the second joining mechanism on the bottom cap engages with a second portion of the second joining mechanism on the bottom neck of the bottle to join the bottom cap to the bottom neck, wherein a size of the bag opening is greater than a size of a top opening of the bottle, and wherein when a liquid is poured into the bottle through the top opening, the liquid at least partially collapses the bag around the item as air in the bag is allowed to escape through the bag opening and out through the at least one hole in the bottom cap.

20. The item storage device of claim 19 wherein the first joining mechanism comprises threads.

* * * * *